US009357298B2

(12) United States Patent
Hiroe

(10) Patent No.: US 9,357,298 B2
(45) Date of Patent: May 31, 2016

(54) SOUND SIGNAL PROCESSING APPARATUS, SOUND SIGNAL PROCESSING METHOD, AND PROGRAM

(71) Applicant: Sony Corporation, Minato-ku (JP)

(72) Inventor: Atsuo Hiroe, Kanagawa (JP)

(73) Assignee: SONY CORPORATION, Tokyo (JP)

( * ) Notice: Subject to any disclaimer, the term of this patent is extended or adjusted under 35 U.S.C. 154(b) by 84 days.

(21) Appl. No.: 14/221,598

(22) Filed: Mar. 21, 2014

(65) Prior Publication Data

US 2014/0328487 A1 Nov. 6, 2014

(30) Foreign Application Priority Data

May 2, 2013 (JP) ..... 2013-096747

(51) Int. Cl.

| | |
|---|---|
| ***H04R 29/00*** | (2006.01) |
| ***H04R 3/00*** | (2006.01) |
| ***G10L 21/0272*** | (2013.01) |
| *H04R 27/00* | (2006.01) |

(52) U.S. Cl.

CPC ..... *H04R 3/005* (2013.01); *G10L 21/0272* (2013.01); *H04R 27/00* (2013.01); *H04R 2227/009* (2013.01)

(58) Field of Classification Search

CPC ..... H04R 29/005; H04R 3/005; H04R 2227/009; H04R 27/00; G10L 21/0272

USPC ..... 381/56, 92, 94.1, 94.3, 94.7, 119; 700/94; 704/226, 233, 200, 211, 248, 704/275; 434/185

See application file for complete search history.

(56) References Cited

U.S. PATENT DOCUMENTS

| | | | | |
|---|---|---|---|---|
| 7,478,041 | B2 * | 1/2009 | Ichikawa et al. | 704/233 |
| 7,797,153 | B2 * | 9/2010 | Hiroe | G10L 21/0272 704/200 |
| 7,809,146 | B2 * | 10/2010 | Hiroe | G10L 21/0272 381/94.3 |
| 8,085,949 | B2 * | 12/2011 | Kim et al. | 381/94.1 |
| 8,112,272 | B2 * | 2/2012 | Nagahama et al. | 704/226 |
| 8,139,788 | B2 * | 3/2012 | Hiroe | H04R 3/005 381/71.1 |
| 8,189,806 | B2 * | 5/2012 | Yuzuriha et al. | 381/92 |
| 2006/0020473 | A1 * | 1/2006 | Hiroe | G10L 13/027 704/275 |

(Continued)

FOREIGN PATENT DOCUMENTS

| | | |
|---|---|---|
| JP | 10-051889 | 2/1998 |
| JP | 2006-072163 | 3/2006 |

(Continued)

*Primary Examiner* — Gerald Gauthier

(74) *Attorney, Agent, or Firm* — Oblon, McClelland, Maier & Neustadt, L.L.P

(57) ABSTRACT

A sound signal processing apparatus includes an observed signal analysis unit that receives as an observed signal a sound signal for channels obtained by a sound signal input unit formed of microphones and estimates a sound direction and a sound segment of a target sound which is sound to be extracted and a sound source extraction unit that receives the sound direction and sound segment of the target sound estimated by the observed signal analysis unit and extracts the sound signal for the target sound. The observed signal analysis unit includes a short time Fourier transform unit that generates an observed signal in time-frequency domain by applying short time Fourier transform to the sound signal for the channels received and a direction/segment estimation unit that receives the observed signal generated by the short time Fourier transform unit and detects the sound direction and sound segment of the target sound.

11 Claims, 21 Drawing Sheets

(56) References Cited

U.S. PATENT DOCUMENTS

| | | | | |
|---|---|---|---|---|
| 2006/0177802 | A1* | 8/2006 | Hiroe | G10L 13/00 434/185 |
| 2008/0228470 | A1* | 9/2008 | Hiroe | G10L 21/0272 704/200 |
| 2010/0185308 | A1* | 7/2010 | Yoshida et al. | 700/94 |
| 2011/0261977 | A1* | 10/2011 | Hiroe | G10L 21/0272 381/119 |
| 2012/0183149 | A1* | 7/2012 | Hiroe | G01S 3/8083 381/56 |
| 2012/0263315 | A1* | 10/2012 | Hiroe | 381/92 |
| 2013/0142343 | A1* | 6/2013 | Matsui et al. | 381/56 |
| 2014/0328487 | A1* | 11/2014 | Hiroe | 381/56 |
| 2016/0005394 | A1* | 1/2016 | Hiroe | G10L 15/04 704/248 |

FOREIGN PATENT DOCUMENTS

| | | |
|---|---|---|
| JP | 2010-121975 | 6/2010 |
| JP | 2012-150237 | 8/2012 |
| JP | 2012-234150 | 11/2012 |

* cited by examiner

FIG. 20

| SCHEME | NUMBER OF ITERATIONS | | | | |
|---|---|---|---|---|---|
| | 0 (RELATED-ART METHOD) | 1 | 2 | 5 | 10 |
| RELATED-ART METHOD 1 | 13.42 | | | | |
| RELATED-ART METHOD 2 | 12.98 | | | | |
| PROPOSED METHOD 1 | | 21.11 | 21.73 | 21.58 | 21.53 |
| PROPOSED METHOD 2 | | 21.76 | 22.93 | 23.14 | 23.16 |
| PROPOSED METHOD 3 | | 14.99 | 14.71 | 13.71 | |

SOUND SIGNAL PROCESSING APPARATUS, SOUND SIGNAL PROCESSING METHOD, AND PROGRAM

CROSS REFERENCE TO RELATED APPLICATIONS

This application claims the benefit of Japanese Priority Patent Application JP 2013-096747 filed May 2, 2013, the entire contents of which are incorporated herein by reference.

BACKGROUND

The present disclosure relates to a sound signal processing apparatus, sound signal processing method, and program. More particularly, the present disclosure relates to a sound signal processing apparatus, sound signal processing method, and program for executing a sound source extraction process to isolate a specific sound from mixtures of multiple source signals, for example.

Sound source extraction is a process to extract a single target source signal from signals in which multiple source signals are mixed and which is observed with microphones (hereinafter referred to as observed signal or mixed signal). In the following description, a source signal as the target (that is, the signal to be extracted) will be referred to as target sound and the other source signals will be referred to as interfering sounds.

It is desirable to accurately extract the target sound when the sound source direction and segment of the target sound are known to some degree in an environment where multiple sound sources are present.

In other words, it is desirable to eliminate interfering sounds from observed signals in which the target sound and interfering sounds are mixed and leave only the target sound by use of information on sound source direction and/or segment.

Sound source direction used herein means the direction of arrival (DOA) for a sound source as seen from a microphone, and a segment refers to a pair of a start time of sound (when it starts being emitted) and an end time (when it stops being emitted) and signals falling in the time interval between them.

For direction estimation and segment detection in the case of multiple sound sources, a number of schemes have been already proposed. Listed below are some specific examples of related art.

(Related-Art Scheme 1) a Scheme Using Images, Especially Face Position and/or Lip Movement A scheme of this type is disclosed in Japanese Unexamined Patent Application Publication No. 10-51889, for instance. Specifically, this scheme assumes that the direction in which the face is positioned is the sound source direction and the segment during which the lips are moving represents an utterance segment.

(Related-Art Scheme 2) Speech Segment Detection Based on Sound Source Direction Estimation Designed for Multiple Sound Sources Disclosures of this scheme include Japanese Unexamined Patent Application Publication No. 2012-150237 and Japanese Unexamined Patent Application Publication No. 2010-121975, for instance. In this scheme, an observed signal is divided into blocks of a certain length and direction estimation designed for multiple sound sources is performed for each of the blocks. Then, temporal tracking is conducted in terms of sound source direction and adjacent direction points present at certain intervals on the time axis are connected across blocks.

Further related arts that disclose a sound source extraction process for extracting a particular sound source by making use of known sound source direction and speech segment include Japanese Unexamined Patent Application Publication No. 2012-234150 and Japanese Unexamined Patent Application Publication No. 2006-72163, for example.

Examples of specific processing with these techniques will be described later.

However, proposed related art is not capable of detecting the direction of the target sound and/or interfering sounds and/or their segments with high accuracy, inevitably calling for sound source extraction using sound source direction information or speech segment information of low accuracy. Related-art sound source extraction processes are however problematic because the accuracy of sound source extraction results obtained using sound source direction or speech segment information of low accuracy are also very low.

SUMMARY

It is therefore desirable to provide a sound signal processing apparatus, sound signal processing method, and program capable of accurately extracting the target sound even when precise sound source direction information and the like for the target sound is not available, for example.

According to an embodiment of the present disclosure, there is provided a sound signal processing apparatus including:

an observed signal analysis unit that receives as an observed signal a sound signal for a plurality of channels obtained by a sound signal input unit formed of a plurality of microphones placed at different positions and estimates a sound direction and a sound segment of a target sound which is sound to be extracted; and a sound source extraction unit that receives the sound direction and sound segment of the target sound estimated by the observed signal analysis unit and extracts the sound signal for the target sound, wherein the observed signal analysis unit includes a short time Fourier transform unit that generates an observed signal in time-frequency domain by applying short time Fourier transform to the sound signal for the plurality of channels received; and a direction/segment estimation unit that receives the observed signal generated by the short time Fourier transform unit and detects the sound direction and sound segment of the target sound, and wherein the sound source extraction unit executes iterative learning in which an extracting filter U' is iteratively updated using a result of application of the extracting filter to the observed signal, prepares, as a function to be applied in the iterative learning, an objective function G(U') that assumes a local minimum or a local maximum when a value of the extracting filter U' is a value optimal for extraction of the target sound, and computes a value of the extracting filter U' which is in a neighborhood of a local minimum or a local maximum of the objective function G(U') using an auxiliary function method during the iterative learning, and applies the computed extracting filter to extract the sound signal for the target sound.

In an embodiment of the sound signal processing apparatus according to the present disclosure, the sound source extraction unit computes a temporal envelope which is an outline of a sound volume of the target sound in time direction based on the sound direction and the sound segment of the target sound received from the direction/segment estimation unit and substitutes the computed temporal envelope value for each frame t into an auxiliary variable b(t), prepares an auxiliary function F that takes the auxiliary variable b(t) and an extracting filter U'(ω) for each frequency bin (ω) as arguments, executes an iterative learning process in which (1) extracting filter computation for computing the extracting filter U'(ω) that minimizes the auxiliary function F while fixing the auxiliary variable b(t), and (2) auxiliary variable computation for computing the auxiliary variable b(t) based on Z(ω,t) which is the result of application of the extracting filter U'(ω) to the observed signal are repeated to sequentially update the extracting filter U'(ω), and applies the updated extracting filter to extract the sound signal for the target sound.

In an embodiment of the sound signal processing apparatus according to the present disclosure, the sound source extraction unit computes a temporal envelope which is an outline of the sound volume of the target sound in time direction based on the sound direction and sound segment of the target sound received from the direction/segment estimation unit, substitutes the computed temporal envelope value for each frame t into the auxiliary variable b(t), prepares an auxiliary function F that takes the auxiliary variable b(t) and the extracting filter U'(ω) for each frequency bin (ω) as arguments, executes an iterative learning process in which (1) extracting filter computation for computing the extracting filter U'(ω) that maximizes the auxiliary function F while fixing the auxiliary variable b(t), and (2) auxiliary variable computation for computing the auxiliary variable b(t) based on Z(ω,t) which is the result of application of the extracting filter U'(ω) to the observed signal are repeated to sequentially update the extracting filter U'(ω), and applies the updated extracting filter to the observed signal to extract the sound signal for the target sound.

In an embodiment of the sound signal processing apparatus according to the present disclosure, the sound source extraction unit performs, in the auxiliary variable computation, processing for generating Z(ω,t) which is the result of application of the extracting filter U'(ω) to the observed signal, calculating an L-2 norm of a vector [Z(1,t), . . . , Z(Ω,t)] (Ω being a number of frequency bins) which represents a spectrum of the result of application for each frame t, and substituting the L-2 norm value to the auxiliary variable b(t).

In an embodiment of the sound signal processing apparatus according to the present disclosure, the sound source extraction unit performs, in the auxiliary variable computation, processing for further applying a time-frequency mask that attenuates sounds from directions off the sound source direction of the target sound to Z(ω,t) which is the result of application of the extracting filter U'(ω) to the observed signal to generate a masking result Q(ω,t), calculating for each frame t the L-2 norm of the vector [Q(1,t), . . . , Q(Ω, t)] representing the spectrum of the generated masking result, and substituting the L-2 norm value to the auxiliary variable b(t).

In an embodiment of the sound signal processing apparatus according to the present disclosure, the sound source extraction unit generates a steering vector containing information on phase difference among the plurality of microphones that collect the target sound, based on sound source direction information for the target sound, generates a time-frequency mask that attenuates sounds from directions off the sound source direction of the target sound based on an observed signal containing interfering sound which is a signal other than the target sound and on the steering vector, applies the time-frequency mask to observed signals in a predetermined segment to generate a masking result, and generates an initial value of the auxiliary variable based on the masking result.

In an embodiment of the sound signal processing apparatus according to the present disclosure, the sound source extraction unit generates a steering vector containing information on phase difference among the plurality of microphones that collect the target sound, based on sound source direction information for the target sound, generates a time-frequency mask that attenuates sounds from directions off the sound source direction of the target sound based on an observed signal containing interfering sound which is a signal other than the target sound and on the steering vector, and generates the initial value of the auxiliary variable based on the time-frequency mask.

In an embodiment of the sound signal processing apparatus according to the present disclosure, the sound source extraction unit, if a length of the sound segment of the target sound detected by the observed signal analysis unit is shorter than a prescribed minimum segment length T_MIN, selects a point in time earlier than an end of the sound segment by the minimum segment length T_MIN as a start position of the observed signal to be used in the iterative learning, and if the length of the sound segment of the target sound is longer than a prescribed maximum segment length T_MAX, selects the point in time earlier than the end of the sound segment by the maximum segment length T_MAX as the start position of the observed signal to be used in the iterative learning, and if the length of the sound segment of the target sound detected by the observed signal analysis unit falls within a range between the prescribed minimum segment length T_MIN and the prescribed maximum segment length T_MAX, uses the sound segment as the sound segment of the observed signal to be used in the iterative learning.

In an embodiment of the sound signal processing apparatus according to the present disclosure, the sound source extraction unit calculates a weighted covariance matrix from the auxiliary variable b(t) and a decorrelated observed signal, applies eigenvalue decomposition to the weighted covariance matrix to compute eigenvalue(s) and eigenvector(s), and sets an eigenvector selected based on the eigenvalue(s) as an in-process extracting filter to be used in the iterative learning.

According to another embodiment of the present disclosure, there is provided a sound signal processing method for execution in a sound signal processing apparatus, the method including:

performing, at an observed signal analysis unit, an observed signal analysis process in which a sound signal for a plurality of channels obtained by a sound signal input unit formed of a plurality of microphones placed at different positions is received as an observed signal and a sound direction and a sound segment of a target sound which is sound to be extracted are estimated; and performing, at a sound source extraction unit, a sound source extraction process in which the sound direction and sound segment of the target sound estimated by the observed signal analysis unit are received and the sound signal for the target sound is extracted, wherein the observed signal analysis process includes executing a short time Fourier transform process for generating an observed signal in time-frequency domain by applying short time Fourier transform to the sound signal for the plurality of channels received; and executing a direction and segment estimation process for receiving the observed signal generated in the short time Fourier transform process and detecting the sound direction and sound segment of the target sound, and wherein the sound source extraction process includes executing iterative learning in which an extracting filter U' is iteratively updated using a result of application of the extracting filter to the observed signal, preparing, as a function to be applied in the iterative learning, an objective function G(U') that assumes a local minimum or a local maximum when a value of the extracting filter U' is a value optimal for extraction of the target sound, and computing a value of the extracting filter U' which is in a neighborhood of a local minimum or a local maximum of the objective function G(U') using an auxiliary function method during the iterative learning, and applying the computed extracting filter to extract the sound signal for the target sound.

According to yet another embodiment of the present disclosure, there is provided a program for causing a sound signal processing apparatus to execute sound signal processing, the program including:

causing an observed signal analysis unit to perform an observed signal analysis process for receiving as an observed signal a sound signal for a plurality of channels obtained by a sound signal input unit formed of a plurality of microphones placed at different positions and estimating a sound direction and a sound segment of a target sound which is sound to be extracted; and causing a sound source extraction unit to perform a sound source extraction process for receiving the sound direction and sound segment of the target sound estimated by the observed signal analysis unit and extracting the sound signal for the target sound, wherein the observed signal analysis process includes executing a short time Fourier transform process for generating an observed signal in time-frequency domain by applying short time Fourier transform to the sound signal for the plurality of channels received; and executing a direction and segment estimation process for receiving the observed signal generated in the short time Fourier transform process and detecting the sound direction and sound segment of the target sound, and wherein the sound source extraction process includes executing iterative learning in which an extracting filter U' is iteratively updated using a result of application of the extracting filter to the observed signal, preparing, as a function to be applied in the iterative learning, an objective function G(U') that assumes a local minimum or a local maximum when a value of the extracting filter U' is a value optimal for extraction of the target sound, and computing a value of the extracting filter U' which is in a neighborhood of a local minimum or a local maximum of the objective function G(U') using an auxiliary function method during the iterative learning, and applying the computed extracting filter to extract the sound signal for the target sound.

The program according to an embodiment of the present disclosure is a program that can be provided on a storage or communications medium that supplies program code in a computer readable form to an image processing apparatus or a computer system that is capable of executing various kinds of program code, for example. By providing such a program in a computer readable form, processing corresponding to the program is carried out in the information processing apparatus or computer system.

Further objects, features, and advantages of the present disclosure will become apparent from the following detailed description given in connection with embodiments thereof and the accompanying drawings. A system as used herein means a logical collection of multiple apparatuses, and apparatuses from different configurations are not necessarily present in the same housing.

With the configuration according to an embodiment of the present disclosure, an apparatus and method for extracting the target sound from a sound signal in which multiple sounds are mixed is provided.

Specifically, the observed signal analysis unit estimates the sound direction and sound segment of the target sound from an observed signal which represents sounds obtained by multiple microphones, and the sound source extraction unit extracts the sound signal for the target sound. The sound source extraction unit executes iterative learning in which the extracting filter U' is iteratively updated using the result of application of the extracting filter to the observed signal. The sound source extraction unit prepares, as a function to be applied in the iterative learning, an objective function G(U') that assumes a local minimum or a local maximum when the value of the extracting filter U' is a value optimal for extraction of the target sound, and computes a value of the extracting filter U' which is in a neighborhood of a local minimum or a local maximum of the objective function G(U') using an auxiliary function method during the iterative learning, and applies the computed extracting filter to extract the sound signal for the target sound.

With the above-described configuration, for example, an apparatus and method for extracting the target sound from a sound signal in which multiple sounds are mixed is realized.

Note that the effects set forth herein are merely illustrative and not limitative, and that additional effects may exist.

BRIEF DESCRIPTION OF THE DRAWINGS

FIG. 20 is a diagram showing SIR improvement data for the sound source extraction implemented according to an embodiment of the present disclosure and related-art schemes.

DETAILED DESCRIPTION OF EMBODIMENTS

Figure 1:
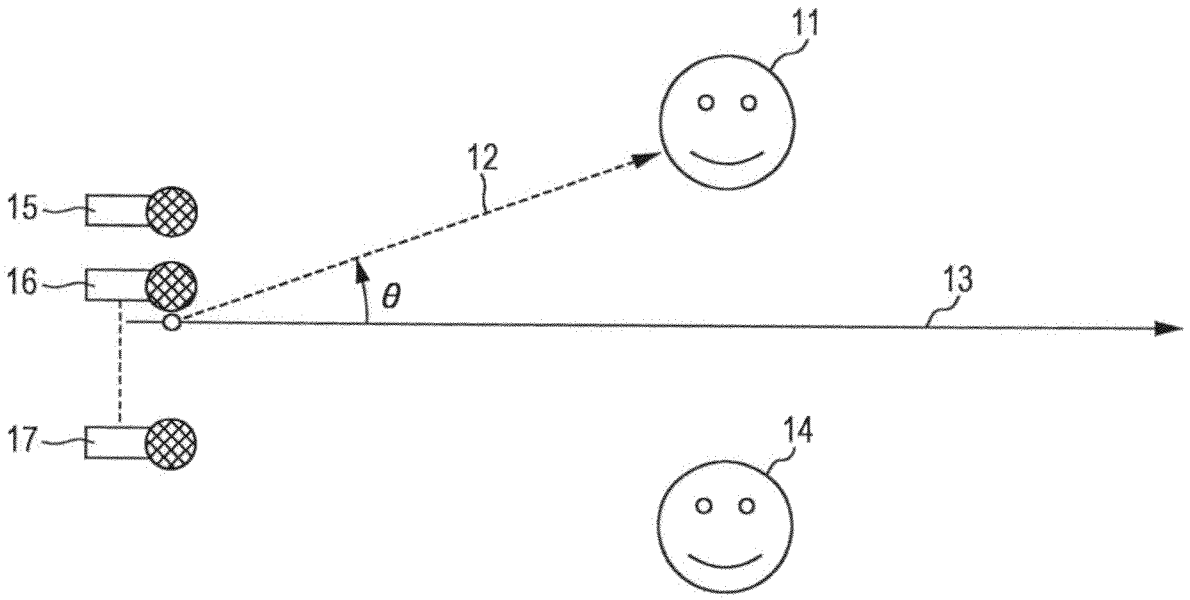
FIG. 1 illustrates a specific example of an environment in which sound source extraction is performed.

The sound signal processing apparatus according to an embodiment of the present disclosure, sound signal processing method, and program will be described in detail below with reference to drawings.

Details of processes will be described under the following headings:

1. Overview of a process performed by the sound signal processing apparatus according to an embodiment of the present disclosure
2. Overview and problems of related-art sound source extraction and separation processes
3. Problems with related-art processes
4. Overview of the process according to an embodiment of the present disclosure which solves the problems of related art
4-1. Deflation method for time-domain ICA
4-2. Introduction of the auxiliary function method
4-3. A process using time-frequency masking using the target sound direction and the phase difference between microphones as initial values for the learning
4-4. Process that uses time-frequency masking also on extraction results generated in the course of learning
5. Other objective functions and masking methods
5-1. Process that uses other objective functions and auxiliary functions
5-2. Other examples of masking
6. Differences between the sound source extraction process according to an embodiment of the present disclosure and related-art schemes
6-1. Differences from related art 1 (Japanese Unexamined Patent Application Publication No. 2012-234150)
6-2. Differences from related art 2
7. Exemplary configuration of the sound signal processing apparatus according to an embodiment of the present disclosure
8. Processing executed by the sound signal processing apparatus
8-1. Overall sequence of process performed by the sound signal processing apparatus
8-2. Detailed sequence of sound source extraction
8-3. Detailed sequence of extracting filter generation
8-4. Detailed sequence of initial learning
8-5. Detailed sequence of iterative learning
9. Verification of effects of the sound source extraction implemented by the sound signal processing apparatus according to an embodiment of the present disclosure
10. Summary of the configuration according to an embodiment of the present disclosure Hereinbelow, description will be presented under these headings.

To start with, the meanings of denotations used herein are described.

A_b means a denotation of A with subscript b, and

A^b means a denotation of A with superscript b.

Conj(X) represents a complex conjugate of complex number X. In equations, a complex conjugate of X is denoted with a line over X.

Substitution of a value is represented by "=" or "←". An operation in which the equal sign does not hold between the both sides (e.g., "x←x+1") in particular is denoted with "←".

The terminology used herein is also described.

(1) In the present specification, "sound (signal)" and "speech (signal)" are distinguished. "Sound" means sound of every kind, including human voice, sounds emitted by various kinds of substance, and natural sound. "Speech", in contrast, is used in a limited sense as a term representing human voice and utterance.

(2) In the present specification, "separation" and "extraction" are used in different senses as follows. Separation is the reverse of mixing, meaning the process of breaking down signals in which multiple source signals are mixed into the individual source signals. In separation, both input and output signals are composed of multiple signals.

Extraction means the process of isolating a single source signal from signals in which multiple source signals are mixed. In extraction, each input signal contains multiple sound signals from multiple sound sources, whereas an output signal contains a sound signal from a single sound source derived through extraction.

(3) In the present specification, "applying a filter" and "performing filtering" are interchangeably used. Similarly, "applying a mask" and "performing masking" are interchangeably used.

[1. Overview of a Process Performed by the Sound Signal Processing Apparatus According to an Embodiment of the Present Disclosure]

The process performed by the sound signal processing apparatus disclosed herein will be generally described first with reference to FIG. 1.

Assume that multiple sound sources (signal generating sources) are present in a certain environment, in which one of the sound sources is a target sound source 11 which emits the target sound to be extracted and the remaining sound sources are interfering sound sources 14 which emit interfering sound not to be extracted.

The sound signal processing apparatus according to an embodiment of the present disclosure executes processing for extracting the target sound from observed signals for an environment in which both the target sound and interfering sound are present as illustrated in FIG. 1 for example, that is, observed signals obtained by microphones 1,15 to n,17.

It is assumed that there is only one target sound source 11 while there are one or more interfering sound sources. Although FIG. 1 illustrates a single interfering sound source 14, there may be additional interfering sound sources.

The direction of arrival of the target sound is already known and represented by a variable θ. In FIG. 1, this is a sound source direction θ, 12. The reference of direction (a line representing direction=0) may be established as appropriate. In the example illustrated in FIG. 1, it is set as a reference direction 13.

The target sound is assumed to be primarily utterance of human voice. The position of its sound source does not vary during an utterance but may change on each utterance.

For interfering sound, any kind of sound source can be interfering sound. For example, human voice can also be interfering sound.

In such a problem setting, for estimation of the segment in which the target sound is being emitted (the interval from the start of utterance to its end) and the direction of the target sound, the methods described above in BACKGROUND and outlined below may be applied, for example.

(Related-Art Scheme 1) a Scheme Using Images, Especially Face Position and/or Lip Movement A scheme of this type is disclosed in Japanese Unexamined Patent Application Publication No. 10-51889, for instance. Specifically, this scheme assumes that the direction in which the face is positioned is the sound source direction and the segment in which the lips are moving represents an utterance segment.

(Related-Art Scheme 2) Speech Segment Detection Based on Sound Source Direction Estimation Designed for Multiple Sound Sources Disclosures of this scheme include Japanese Unexamined Patent Application Publication No. 2012-150237 and Japanese Unexamined Patent Application Publication No. 2010-121975, for instance. In this scheme, an observed signal is divided into blocks of a certain length and direction estimation designed for multiple sound sources is performed for each of the blocks. Then, tracking is conducted in terms of sound source direction and directions close to each other are connected across blocks.

By employing one of these schemes, the segment and direction of the target sound can be estimated.

The remaining challenge is therefore to generate a clean target sound containing no interfering sound using information on the target sound segment and direction obtained by any of the above schemes for example, namely sound source extraction.

If the sound source direction θ is estimated using any of the above related-art schemes, however, the estimated sound source direction θ may contain an error. For instance, θ can be estimated as π/6 radian)(=30° when the actual sound source direction is a different value (e.g., 35°).

For interfering sound, it is assumed that its direction is not known or, if known, contains an error. The segment of the interfering sound likewise contains an error. For example, in an environment in which interfering sound continues to be emitted, it is possible that only a part of the segment is detected or the segment is not detected at all.

As illustrated in FIG. 1, n microphones are prepared. In FIG. 1, the first microphone 15 to the n-th microphone 17 are provided. The relative positions of the microphones are known in advance.

Next, variables for use in sound source extraction will be described with reference to equations shown below (1.1 to 1.3).

As noted above,

A_b means a denotation of A with subscript b, and

A^b means a denotation of A with superscript b.

$$X(\omega, t) = \begin{bmatrix} X_1(\omega, t) \\ \vdots \\ X_n(\omega, t) \end{bmatrix} \quad [1.1]$$

$$Z(\omega, t) = U(\omega)X(\omega, t) \quad [1.2]$$

$$U(\omega) = [U_1(\omega), \ldots, U_n(\omega)] \quad [1.3]$$

A signal observed with the k-th microphone is denoted as x_k(τ)(where τ is time).

Applying short time Fourier transform (STFT) to the signal (described in detail later) results in an observed signal in time-frequency domain X_k(ω,t), where ω represents frequency bin number (index); and t represents frame number (index).

A column vector including observed signals X_1(ω,t) to X_n(ω,t) from the respective microphones is denoted as X(ω, t) (equation [1.1]).

The sound source extraction contemplated by the configuration according to an embodiment of the present disclosure is basically to multiply an extracting filter U(ω) to the observed signal X(ω,t) to obtain the extraction result Z(ω,t) (equation [1.2]). The extracting filter U(ω) is a row vector including n elements and represented as equation [1.3].

Schemes of sound source extraction can be basically classified according to how they calculate the extracting filter U(ω).

Some sound source extraction schemes estimate the extracting filter using observed signals, and this type of extracting filter estimation based on observed signals is also called adaptation or learning.

[2. Overview and Problems of Related-Art Sound Source Extraction and Separation Processes]

Next, an overview and problems of related-art sound source extraction and separation processes are discussed.

Here, schemes for enabling extraction of a target sound from a mixed signal received from multiple sound sources are classified into:

(2A) sound source extraction scheme, and (2B) sound source separation scheme.

Related art based on these schemes will be described below.

(2A. Sound Source Extraction Scheme)

Examples of sound source extraction schemes that use already known sound source direction and segment to perform extraction include:

(2A-1) delay-and-sum array, (2A-2) minimum variance beam former, (2A-3) maximum SNR beam former, (2A-4) a scheme based on target sound removal and subtraction, and (2A-5) time-frequency masking based on phase difference.

These techniques all use a microphone array (multiple microphones placed at different positions). For details of these techniques, see Japanese Unexamined Patent Application Publication No. 2012-234150 or Japanese Unexamined Patent Application Publication No. 2006-72163, for instance.

These schemes will be generally described below.

(2A-1. Delay-and-Sum Array)

If delays of different amounts of time are given to observed signals from microphones that form a microphone array and the observed signals are summed up after aligning the phases of signals from the target sound direction, the target sound is emphasized because the signals are aligned in phase and sounds from other directions are attenuated because the phases of signals are slightly different from each other.

More specifically, the result of extraction is yielded through processing utilizing a steering vector $S(\omega,\theta)$.

A steering vector is a vector representing the phase difference between microphones for a sound originating from a certain direction. A steering vector corresponding to the direction $\theta$ of the target sound is computed and the extraction result is obtained according to equation [2.1] given below.

$$Z(\omega,t)=S(\omega,\theta)^{H}X(\omega,t) \quad [2.1]$$

$$Z(\omega,t)=M(\omega,t)X_k(\omega,t) \quad [2.2]$$

In equation [2.1], the superscript "H" represents Hermitian transpose, which is a process to transpose a vector or matrix and also convert its elements into conjugate complex numbers.

(2a-2. Minimum Variance Beam Former)

In this scheme, a filter is produced so as to have such directional characteristics that the gain for the target sound direction is 1 (i.e., do not emphasize or attenuate sound) and null beams are formed in the interfering sound directions, that is, have a gain close to 0 for each interfering sound direction. The filter is then applied to observed signals to extract only the target sound.

(2A-3. Maximum SNR Beam Former)

This scheme determines a filter $U(\omega)$ that maximizes the ratio $V_s(\omega)/V_n(\omega)$ of a) and b):

a) $V_s(\omega)$, the variance (power) of the result of application of filter $U(\omega)$ to a segment in which only the target sound is being emitted;

b) $V_n(\omega)$,the variance (power) of the result of application of filter $U(\omega)$ to a segment in which only interfering sound is being emitted.

This scheme does not involve information on the target sound direction if the segments (a) and (b) can be detected.

(2A-4. Scheme Based on Target Sound Removal and Subtraction)

A signal in which the target sound contained in the observed signal has been eliminated (a target-sound eliminated signal) is once generated and the target-sound eliminated signal is subtracted from the observed signal (or a signal with the target sound emphasized with a delay-and-sum array or the like). Through this process, a signal containing only the target sound is obtained.

Griffith-Jim beam former, a technique employing this scheme, uses normal subtraction. There are also schemes that employ non-linear subtraction, such as spectral subtraction.

(2A-5. Time-Frequency Masking Based on Phase Difference)

Frequency masking is a technique to extract the target sound by multiplying different coefficients corresponding to different frequencies to thereby mask (reduce) frequency components in which interfering sound is dominant and leave frequency components in which the target sound is dominant.

Time-frequency masking is a scheme that changes the mask coefficient over time rather than fixing it. Extraction can be represented by the equation [2.2] given above, where the mask coefficient is denoted as $M(\omega,t)$. For the second term of the right-hand side, a result of extraction derived by other scheme may be used instead of $X_k(\omega,t)$. For example, a result of extraction with a delay-and-sum array (equation [2.1]) may be multiplied by the mask $M(\omega,t)$.

Since a sound signal is generally sparse both in frequency and time directions, in many cases times and frequencies in which the target sound is dominant exist even when the target sound and interfering sounds are being simultaneously emitted. One way to find such time and frequency is use of the phase difference between microphones.

For details of time-frequency masking based on phase difference, see Japanese Unexamined Patent Application Publication No. 2012-234150, for instance.

(2B. Sound Source Separation Scheme)

While related-art techniques for sound source extraction have been presented above, sound source separation techniques may be applicable depending on the circumstances. Sound source separation is a method that identifies multiple sound sources that are emitting sound simultaneously through a separation process and then selects a particular sound source corresponding to the target signal using information on the sound source direction or the like.

Available techniques for sound source separation include the followings, for example.

2B-1. Independent Component Analysis (ICA)

General description of this scheme is provided below and the techniques shown below, which are variations of ICA, will be also described as they are highly relevant to the process according to an embodiment of the present disclosure.

2B-2. Auxiliary Function Method 2B-3. Deflation Method (2B-1. Independent Component Analysis (ICA))

Independent component analysis (ICA), a kind of multivariate analysis, is a technique to separate a multi-dimensional signal by making use of statistical properties of the signal. For details of ICA itself, see the book below, for example.

["Independent Component Analysis", written by Aapo Hyvarinen, Juha Karhunen, and Erkki Oja, or its Japanese translation translated by Iku Nemoto and Masaki Kawakatsu]

In the following, ICA on sound signals, especially ICA in time-frequency domain, will be discussed.

Independent component analysis (ICA) involves a process for determining a separating matrix in which components of the separation result are statistically independent of each other.

The equation for separation is represented by equation [3.1] given below.

Equation [3.1] is an equation for applying a separating matrix $W(\omega)$ to an observed signal vector $X(\omega,t)$ to calculate a separation result vector $Y(\omega,t)$.

$$Y(\omega, t) = W(\omega)X(\omega, t) \quad [3.1]$$

$$Y(\omega, t) = \begin{bmatrix} Y_1(\omega, t) \\ \vdots \\ Y_n(\omega, t) \end{bmatrix} \quad [3.2]$$

$$W(\omega) = \begin{bmatrix} W_{11}(\omega) & \dots & W_{1n}(\omega) \\ \vdots & \ddots & \vdots \\ W_{n1}(\omega) & \dots & W_{nn}(\omega) \end{bmatrix} \quad [3.3]$$

$$Y(t) = WX(t) \quad [3.4]$$

$$Y(t) = \begin{bmatrix} Y_1(t) \\ \vdots \\ Y_n(t) \end{bmatrix} \quad [3.5]$$

$$Y_k(t) = \begin{bmatrix} Y_k(1, t) \\ \vdots \\ Y_k(\Omega, t) \end{bmatrix} \quad [3.6]$$

-continued $$X(t) = \begin{bmatrix} X_1(t) \\ \vdots \\ X_n(t) \end{bmatrix} \quad [3.7]$$

$$X_k(t) = \begin{bmatrix} X_k(1, t) \\ \vdots \\ X_k(\Omega, t) \end{bmatrix} \quad [3.8]$$

$$W = \begin{bmatrix} W_{11} & \dots & W_{1n} \\ \vdots & \ddots & \vdots \\ W_{n1} & \dots & W_{nn} \end{bmatrix} \quad [3.9]$$

$$W_{ki} = \begin{bmatrix} W_{ki}(1) & & 0 \\ & \ddots & \\ 0 & & W_{ki}(\Omega) \end{bmatrix} \quad [3.10]$$

$$I(Y) = \sum_k H(Y_k) - H(Y) \quad [3.11]$$

$$H(Y_k) = \langle -\log p(Y_k(t)) \rangle_t \quad [3.12]$$

$$p(Y_k(t)) \propto \exp(-K\|Y_k(t)\|_2) \quad [3.13]$$

$$\|Y_k(t)\|_m = \left( \sum_\omega |Y_k(\omega, t)|^m \right)^{1/m} \quad [3.14]$$

$$I(Y) = \sum_k \langle -\log p(Y_k(t)) \rangle_t - \log|\det(W)| - H(X) \quad [3.15]$$

The separating matrix W(ω) is an n×n matrix represented by equation [3.3].

The separation result vector Y(ω,t) is a 1×n vector represented by equation [3.2].

That is, there are n output channels per frequency bin. Then, the separating matrix W(ω) is determined such that Y_1(ω,t) to Y_n(ω,t) which are the components of the separation result are statistically most independent of each other at t within a predetermined range. For a specific equation to determine W(ω), reference may be made to the aforementioned book.

Related-art time-frequency domain ICA has a drawback called permutation problem.

Permutation problem refers to a problem that which component is separated into which output channel differs from one frequency bin (i.e., ω) to another.

This problem however has been substantially solved by Japanese Patent No. 4449871, titled "Apparatus and method for separating audio signals", which was patented to the same applicant and inventors as the present application. As similar processing to the one disclosed in the prior Japanese Patent No. 4449871 is applicable in the present disclosure, the process of the prior patent will be briefly described.

Japanese Patent No. 4449871 uses equation [3.4] given above, which is the equation to calculate the separation result vector Y(t) obtained by expanding the equation [3.1] for all frequency bins, as an equation representing separation.

In the equation [3.4] to calculate the separation result vector Y(t), the separation result vector Y(t) is a 1×nΩ vector represented by equations [3.5] and [3.6].

Similarly, the observed signal vector X(t) is a 1×nΩ vector represented by equations [3.7] and [3.8]. Here, n and Ω are the numbers of microphones and frequency bins, respectively.

Figure 9A:
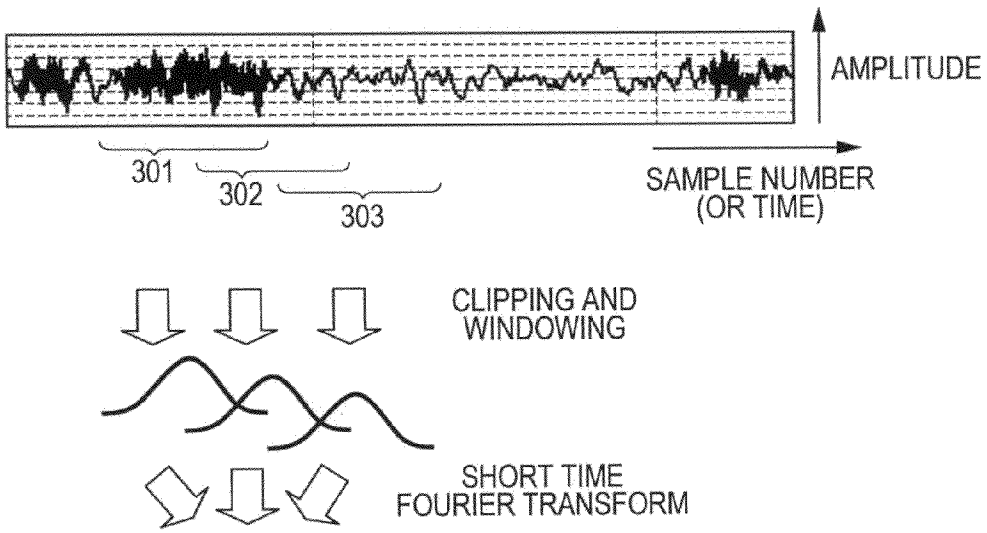
FIGS. 9A and 9B are diagrams describing details of short time Fourier transform (STFT)
Figure 9B:
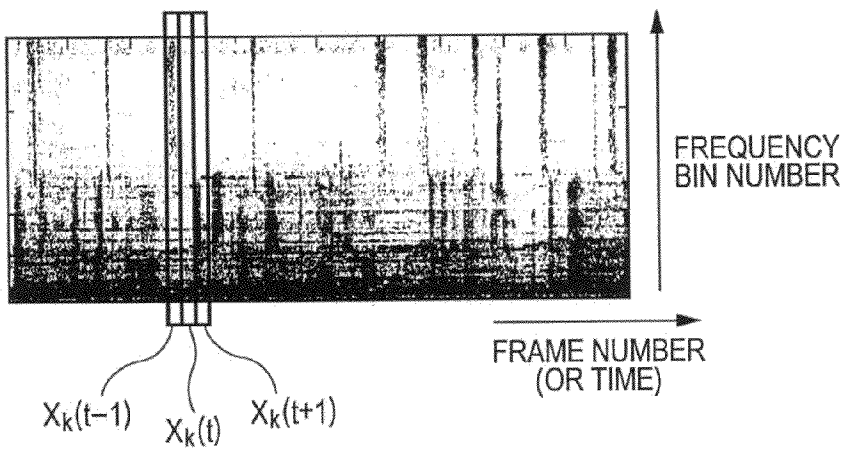

X_k(t) in equation [3.8] corresponds to the spectrum for frame number t of the observed signal observed with the k-th microphone (e.g., X_k(t) in FIG. 9B), and Y_k(t) in equation [3.6] similarly corresponds to the spectrum for frame number t of the k-th separation result. Meanwhile, the separating matrix W in equation [3.4] is an nΩ×nΩ matrix represented by equation [3.9], and the submatrix W_{ki} constituting W is a Ω×Ω diagonal matrix represented by equation [3.10].

Japanese Patent No. 4449871 makes use of the amount of Kullback-Leibler information (the KL information) uniquely calculated from all frequency bins (i.e., from the entire spectrogram) as a measure of independence.

The KL information I(Y) is calculated with equation [3.11], where H(•) represents the entropy for the variable in the parentheses. That is, H(Y_k) is a joint entropy for Y_k(1,t) to Y_k(Ω,t), which are the elements of the vector Y_k(t), while H(Y) is the joint entropy for the elements of the vector Y(t).

The KL information I(Y) calculated with equation [3.11] becomes minimum (ideally zero) when Y_1 to Y_n are independent of each other. Thus, by regarding I(Y) in equation [3.11] as an objective function and determining W that minimizes I(Y), the separating matrix W for generating a separation result (i.e., source signals before being mixed) from the observed signal X(t) can be obtained.

H(Y_k) is calculated using equation [3.12]. In this equation, <•>_t means averaging of the variable in the parentheses for frame number t. In addition, p(Y_k(t)) represents a multivariate probability density function (pdf) that takes the vector Y_k(t) as argument.

This probability density function may be interpreted either as representing the distribution of Y_k(t) at the time of interest or representing the distribution of source signals as far as solving the sound source separation problem is concerned. Japanese Patent No. 4449871 uses equation [3.13], which is a multivariate exponential distribution, as an example of the multivariate probability density function (pdf).

In equation [3.13], K is a positive constant.

||Y_k(t)||_2 is the L-2 norm of vector Y_k(t), and this value is calculated by substituting m=2 in equation [3.14].

Also, substituting equation [3.12] into equation [3.11] and further substituting the relation of H(Y)=log|det(W)|+H(X), which is derived from equation [3.4], results in equation [3.11] being modified like equation [3.15]. Here, det(W) represents the determinant of W.

Japanese Patent No. 4449871 uses an algorithm called natural gradient for minimization of equation [3.15]. Japanese Patent No. 4556875, an improvement to Japanese Patent No. 4449871, applies conversion called decorrelation to an observed signal and then uses an algorithm called gradient with orthonormality constraints, thereby accelerating convergence to the minimum value.

ICA has a drawback of high computational complexity (i.e., involving many iterations of processing until convergence of the objective function), but it has recently reported that the number of repetitions before convergence can be significantly reduced by introduction of a scheme called auxiliary function. Details of the auxiliary function method will be described later.

For example, Japanese Unexamined Patent Application Publication No. 2011-175114 discloses a process that applies the auxiliary function method to time-frequency domain ICA (ICA before Japanese Patent No. 4449871 which has the permutation problem). Also, the document shown below discloses a process that enables both reduction in computational complexity and solution of the permutation problem by applying the auxiliary function method to the minimization problem of the objective function (such as equation [3.15]) introduced in Japanese Patent No. 4449871.

"STABLE AND FAST UPDATE RULES FOR INDEPENDENT VECTOR ANALYSIS BASED ON AUXILIARY

FUNCTION TECHNIQUE", Nobutaka Ono, 2011 IEEE Workshop on Applications of Signal Processing to Audio and Acoustics, Oct. 16-19, 2011, New Paltz, N.Y.

While conventional ICA is capable of producing separation results as many as the number of microphones, there is also a distinct scheme called deflation method that estimates sound sources one by one, which method is used for signal analysis for magnetoencephalography (EG), for example.

If the deflation method is simply applied to a time-frequency domain sound signal, however, it is unpredictable which sound source will be extracted first. This constitutes the permutation problem in a broad sense. In other words, a method of reliably extracting only the intended target sound (not extracting interfering sounds) has not been established at present. Thus, the deflation method has not been effectively utilized in extraction of time-frequency domain signals.

[3. Problems with Related-Art Processes]

As described, various proposals have been made for sound source extraction and separation.

The above-described sound source extraction and separation processes rest on the premise that the direction and segment of the target sound are known, but the direction and segment of the target sound may not obtained with high accuracy at all times. That is, the following problems are imposed.

1) The target sound direction can be inaccurate (contain an error).

2) For interfering sound, its segment may not be detected.

For example, a method that acquires information on the target sound direction and/or segment using images can cause a mismatch between the sound source direction calculated from the face position and the sound source direction with respect to the microphone array due to the difference in the position of the camera and the microphone array. In addition, for a sound source not relevant to the face position or a sound source positioned outside the camera's angle of view, the segment is not detectable.

Meanwhile, a scheme based on estimation of the sound source direction has a tradeoff between the accuracy of direction and computational complexity. When the MUSIC method is used for estimation of the sound source direction, for example, as the step size of the angle used in scanning of null beams are decreased, accuracy becomes higher but computational complexity increases.

MUSIC is an acronym of multiple signal classification. The MUSIC method may be described as a process including two steps S1 and S2 shown below from the perspective of spatial filtering (processing for passing or limiting sound of a particular direction). For details of the MUSIC method, see a patent reference such as Japanese Unexamined Patent Application Publication No. 2008-175733, for instance.

(S1) Generate a spatial filter whose null beams oriented in the directions of all sound sources that are emitting sound within a certain segment (block).

(S2) Check the directional characteristics (the direction-gain relationship) of the generated spatial filter and determine the direction in which the null beam is present.

Through this process, the direction of the null beam formed by the generated spatial filter can be estimated as the sound source direction.

These existing techniques may not necessarily derive the direction and/or segment of the target sound with high accuracy but often result in an incorrect target sound direction or fail to detect interfering sound. Implementing a related-art sound source extraction process with application of such low accuracy information has the problem of the accuracy of sound source extraction (or separation) being significantly low.

When sound source extraction is used as an upstream process to other processes (such as speech recognition or recording), it is desirable to satisfy the following requirements, that is, low delay and high following ability.

(1) Low delay: the time from the end of a segment to when the extraction result (or separation result) is generated is short.

(2) High following ability: a sound source is extracted with high accuracy from the start of the segment.

However, none of the related-art sound source extraction and separation processes described above meet all of these requirements. Problems of the related-art sound source extraction and separation schemes will be explained individually below.

(3-1. Problem of Sound Source Extraction Utilizing a Delay-and-Sum Array)

In a sound source extraction process employing a delay-and-sum array, inaccuracy of the sound source direction to a certain extent would have little influence. In a case where a small number of (e.g., three to five) microphones are used to obtain observed signals, interfering sound is not attenuated very much. That is, this technique only has the effect of slightly emphasizing the target sound.

(3-2. Problem of Sound Source Extraction Employing a Minimum Variance Beam Former)

In a sound source extraction process employing a minimum variance beam former, extraction accuracy sharply lowers when there is an error in the target sound direction. This is because if the direction for which the gain is fixed at 1 differs from the actual direction of the target sound, a null beam is also formed in the target sound direction, attenuating the target sound as well. That is, the ratio between the target sound and interfering sound (SNR) does not become large.

In order to address this problem, some schemes use the observed signal for a segment in which the target sound is not being emitted for learning of an extracting filter. It is then necessary however that all sound sources except the target sound are emitting sound in that segment. In other words, even if utterance of the target sound occurs in the presence of interfering sound, that utterance segment may not be used for learning, but instead a segment during which all sound sources other than the target sound are emitting sound from past observed signals has to be found for use in learning. Such a segment is easy to find if interfering sound is constant and its position is fixed; however, in a circumstance where interfering sound is not constant and its position is variable like the problem setting contemplated herein, detection of a segment for use in filter learning itself is difficult, in which case extraction accuracy would be low.

For example, if an interfering sound that was not present in the segment for filter learning starts to be emitted during utterance of the target sound, the interfering sound is not eliminated. Also, if the target sound (more precisely, sound originating from approximately the same direction as the target sound) is contained in the learning segment, it is highly possible that a filter that attenuates not only interfering sound but the target sound will be generated.

(3-3. Problem of Sound Source Extraction Employing a Maximum SNR Beam Former)

Since a sound source extraction process employing a maximum SNR beam former does not use sound source direction, incorrectness of the direction of the target sound has no influence.

Since sound source extraction employing a maximum SNR beam former however involves both (a) a segment during which only the target sound is being emitted, and (b) a segment during which all sound sources except the target sound are emitting sound, this technique is not applicable if either of them is not available. For example, in a case where one of interfering sounds is being emitted almost continuously, the segment a) is not available.

Also in this scheme, a segment in which utterance of the target sound occurred in the presence of interfering sound is not usable for filter learning but instead a segment for filter learning has to be found from past observed signals. However, since both the target sound and interfering sound can change in position on each occurrence of utterance in the problem setting according to an embodiment of the present disclosure, there is no guarantee that an appropriate segment is found from past observed signals.

(3-4. Problem of Sound Source Extraction Employing a Scheme Based on Target Sound Removal and Subtraction)

In a sound source extraction process employing a scheme based on removal of the target sound and subtraction, extraction accuracy sharply decreases when there is an error in the target sound direction. This is because if the direction of the target sound is incorrect, the target sound is not completely removed and subtraction of such a signal from the observed signal results in removal of the target sound to some extent. That is, the ratio between target sound and interfering sound does not become large.

(3-5. Problem of Sound Source Extraction Employing Time-Frequency Masking Based on Phase Difference)

In a sound source extraction process employing time-frequency masking based on phase difference, inaccuracy of the sound source direction to a certain extent would have little influence.

However, the phase difference between microphones is inherently small at low frequencies, accurate extraction is not possible.

In addition, since discontinuities are apt to occur in a spectrum, musical noise can occur when the spectrum is converted back into a waveform.

Another problem is that even successful detection (i.e., interfering sound has been removed) may not lead to improvement in precision of speech recognition in a case where speech recognition or the like is incorporated at a downstream stage because the spectrum of a processing result for time-frequency masking is different from the spectrum of natural speech.

Further, as the degree of overlap between the target sound and the interfering sound is higher, masked portions increase, so the sound volume of the extraction result can be low or musical noise level can increase.

(3-6. Problem of Sound Source Extraction Employing Independent Component Analysis (ICA))

Since a sound source extraction process employing independent component analysis (ICA) does not use the sound source direction, the direction being incorrect does not affect separation.

Also, as an utterance segment of the target sound itself can be used as the observed signal for learning of the separating matrix, there is no problem in finding of an appropriate segment for learning from past observed signals.

Since computational complexity is still high in application of the auxiliary function method compared to other schemes, delay from the end of a segment to generation of the separation result is large. One reason of high computational complexity is that the independent component analysis is separation of n sound sources (n is the number of microphones), not extraction of a single sound source. It accordingly involves at least n times as much computational complexity as in extraction of one intended sound source.

For the same reason, memory n times as much as in extraction of a single sound source is necessary for storing separation results and the like.

Further, the process to select one intended sound source from n separation results using the sound source direction or the like is involved and a mistake can occur in this process, which is called selection error.

[4. Overview of the Process According to an Embodiment of the Present Disclosure which Solves the Problems of Related Art]

Next, the process according to an embodiment of the present disclosure which solves the problems of the related art described above will be generally discussed.

The sound signal processing apparatus disclosed herein solves the problems by applying the following processes (1) to (4), for example:

(1) Deflation method for time domain ICA (2) Introduction of the auxiliary function method (3) Use of time-frequency masking based on the target sound direction and phase difference between microphones as initial values for the learning (4) Use of time-frequency masking also on extraction results generated in the course of learning The process disclosed herein includes execution of learning employing the auxiliary function method, yielding the following effects, for example.

The number of iterations before learning convergence can be reduced.

Rough extraction results obtained with other schemes can be used as initial values for the learning.

The sound signal processing apparatus according to an embodiment of the present disclosure implements the method for generating only the intended target sound, which has been the challenge of the time-frequency domain deflation method, by introducing the processes (2) and (3) above. In other words, by using an initial value for the learning close to the target sound, extraction of only the intended source signals is enabled in the deflation method.

Here, a time-frequency masking result is used as the initial value for the deflation method as mentioned above in (3), for example. Use of such initial value is enabled by adoption of the auxiliary function method.

Hereinafter, the processes (1) to (4) will be described in sequence.

[4-1. Deflation Method in Time Domain ICA]

First, the deflation method in time domain ICA employed by the sound signal processing apparatus according to an embodiment of the present disclosure is described.

Deflation ICA is a method in which source signals are estimated one by one instead of separating all sound sources at a time. For general explanations, see "Independent Component Analysis" mentioned above, for example.

In the following, the deflation method will be discussed in the context of application to the measure of independence, which was introduced in Japanese Patent No. 4449871. As the process according to an embodiment of the present disclosure is the same as Japanese Patent No. 4556875 up to calculation of the measure of independence, reference may be made to the patent in conjunction with the present description.

The result of applying decorrelation to the observed signal vector $X(\omega,t)$ in equation [1.1] given above is denoted as decorrelated observed signal vector $X'(\omega,t)$. Decorrelation is carried out by multiplying the decorrelating matrix P(ω) as in equation [4.1] given below. How the decorrelating matrix is calculated will be shown later.

Since the elements of the decorrelated observed signal vector X'(ω,t) are mutually uncorrelated over frame number t, its covariance matrix is the identity matrix (equation [4.2]).

$$X'(\omega, t) = P(\omega)X(\omega, t) \quad [4.1]$$

$$\langle X'(\omega, t)X'(\omega, t)^H \rangle_t = I \quad [4.2]$$

$$Y(t) = W'X'(t) \quad [4.3]$$

$$W'W'^H = I \quad [4.4]$$

$$I(Y) = \sum_k H(Y_k) - H(Y) \quad [4.5]$$

$$= \sum_k H(Y_k) - \log|\det(W')| - H(X') \quad [4.6]$$

$$= \sum_k H(Y_k) + \text{const} \quad [4.7]$$

$$W' = \underset{W'}{\operatorname{argmin}} I(Y) \quad [4.8]$$

$$= \underset{W'}{\operatorname{argmin}} \sum_k H(Y_k) \quad [4.9]$$

$$W'_k = \underset{W'_k}{\operatorname{argmin}} H(Y_k) \quad [4.10]$$

$$Y_k(t) = W'_k X'(t) \quad [4.11]$$

$$W'_k = [W'_{k1}, \ldots, W'_{kn}] \quad [4.12]$$

$$Z(t) = U'X'(t) \quad [4.13]$$

$$Z(\omega, t) = U'(\omega)X'(\omega, t) \quad [4.14]$$

$$G(U') = H(Z) \quad [4.15]$$

$$U' = \underset{U'}{\operatorname{argmin}} G(U') \quad [4.16]$$

$$U'U'^H = I \quad [4.17]$$

$$U'(\omega)U'(\omega)^H = 1 \quad [4.18]$$

$$\langle |Z(\omega, t)|^2 \rangle_t = 1 \quad [4.19]$$

$$G(U') = \langle \|Z(t)\|_2 \rangle_t \quad [4.20]$$

When a vector describing the decorrelated observed signal in the same format as equation [3.7] which indicates the observed signal before decorrelation is represented as X'(t), the separation equation for equation [3.4] is represented as equation [4.3].

It has been proved that it is sufficient to find the new separating matrix W' shown in equation [4.3] from an orthonormal matrix (a matrix satisfying equation [4.4], more precisely a unitary matrix as the elements of the matrix are complex numbers). Use of this feature enables such a deflation method as shown below (estimation per sound source).

When equation [3.11] representing the KL information I(Y), which is the measure of independence, is represented using the new separating matrix W' to be applied to decorrelated observed signal X'(t) in place of the separating matrix W to be applied to the observed signal X(t), it can be represented as equation [4.6] via equation [4.5].

Here, if the separating matrix W' is an orthonormal matrix, det(W') in equation [4.6] is 1 at all times, and the decorrelated observed signal X' is invariant during learning and its entropy H(X') is a constant value. The KL information I(Y) therefore can be represented as equation [4.7], where const represents a constant.

Since the KL information I(Y) becomes minimum when Y_1(t) to Y_n(t), namely the elements of the separation result vector Y(t), are statistically most independent of each other, the separating matrix W' can be determined as the solution of a minimization problem for the KL information I(Y). That is, it is determined by solving equation [4.8]. Further, equation [4.8] can be represented as equation [4.9] due to the relation of equation [4.7]

Since a term representing the relation between separation results, such as H(Y), is no longer present in equation [4.9], only the k-th separation result can be retrieved. That is, matrix W'_k for generating only the k-th separation result from the decorrelated observed signal vector X'(t) is determined by equation [4.10] and the determined matrix W'_k is multiplied to the decorrelated observed signal vector X'(t).

This process can be represented as equation [4.11].

Here, W'_k is an Ω×nΩ matrix represented by equation [4.12], and W'_{ki} in equation [4.12] is an Ω×Ω diagonal matrix represented in the same format as W_{ki} of equation [3.10]

That is, applying decorrelation to the observed signal permits only the k-th sound source to be estimated by solving the problem of minimizing the entropy H(Y_k) of the k-th separation result. This is the principle of the deflation method using the KL information.

Hereinbelow, only the separation result for one channel that corresponds to the target sound will be considered (i.e., only Y_k is considered among Y_1 to Y_n). Since this is equivalent to sound source extraction, variable names are changed as follows in conformity with equations [1.1] to [1.3] presented above.

The separation result Y_k(t) and the separating matrix W'_k are replaced with Z(t) and U' respectively, which are called extraction result and extracting filter, respectively.

That is, they are the extraction result Z(t) and the extracting filter U'.

Consequently, equation [4.11] is rewritten as equation [4.13]. Similarly, when Y_k(ω,t) is rewritten as Z(ω,t), Z(ω,t) can be written as equation [4.14] using the matrix U'(ω) which includes elements taken from U' for frequency bin ω (in the same format as U(ω) in equation [1.3]) and the decorrelated observed signal vector X'(ω,t) for frequency bin ω.

As this rewriting allows equation [4.10] to be interpreted as the minimization problem of the function that takes the extracting filter U' as argument, equation [4.10] is then written as equations [4.15] and [4.16]. G(U') shown in these equations is called objective function.

As mentioned earlier, a process to solve the minimization problem for the KL information I(Y) shown in equation [4.8] is performed as the process for computing the separating matrix W' shown in equation [4.8]. By solving the minimization problem for the objective function G(U') shown in equation [4.16] as in this process, the extracting filter U' can be computed.

That is, in order to calculate the extracting filter U' best suited for extraction of the target sound, a filter value that makes the objective function G(U') minimum should be computed.

This process will be described more specifically later with reference to FIG. 4.

Equation [4.4] which represents constraint on the separating matrix W' is represented as equations [4.17] and [4.18] after rewriting of variables. Note that "I" in equation [4.17] is the Ω×Ω identity matrix. Further, equations [4.18], [4.2], and

[4.14] yield equation [4.19]. That is, it is equivalent to placing the constraint so that the variance of the extraction result is 1. As this constraint is different from the actual variance of the target sound, it is necessary to modify the variance (scale) of the extraction result through a process called rescaling, which will be described later, after once producing an extracting filter.

Figure 2:
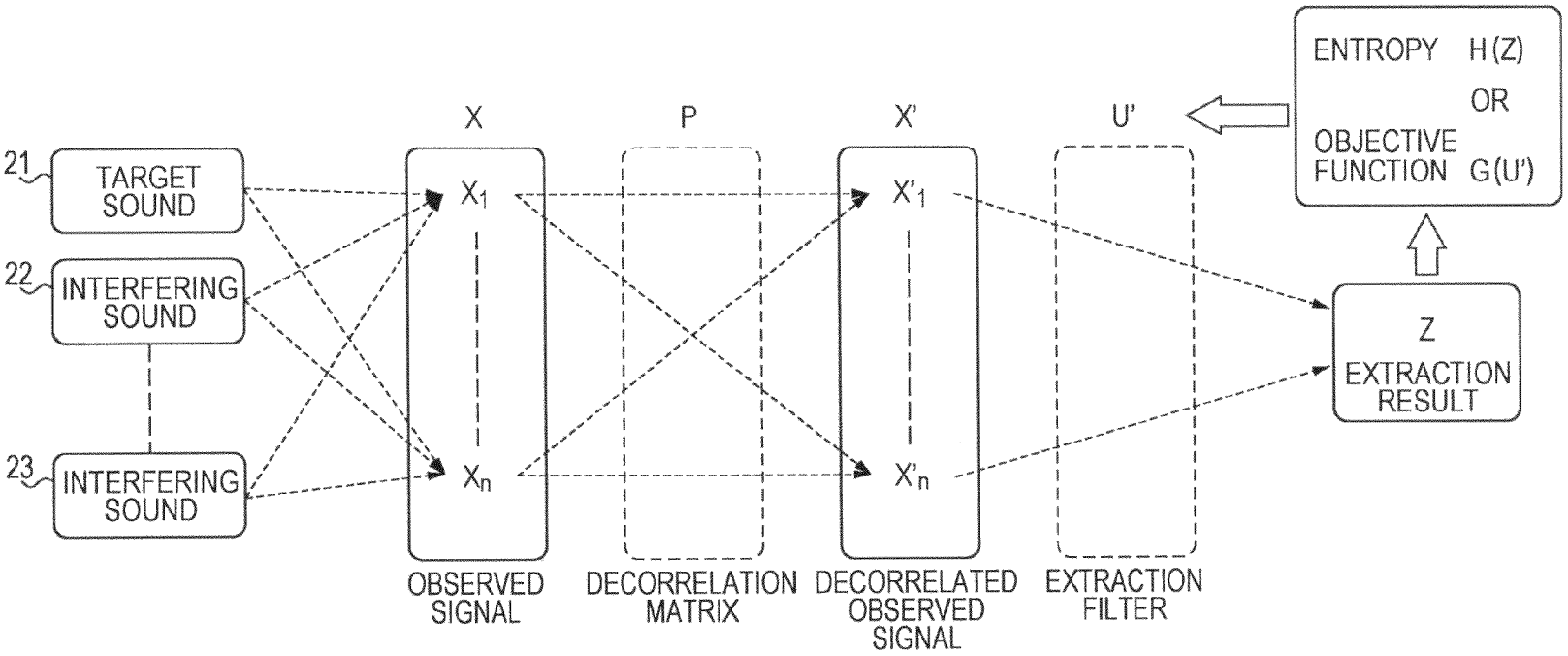
FIG. 2 is a diagram generally describing the sound source extraction according to an embodiment of the present disclosure.

The relationship among variables included in equations [4.1] to [4.20] is described using FIG. 2. FIG. 2 shows multiple sound sources 21 to 23.

The sound source 21 is the sound source of the target sound, and sound sources 22 and 23 are the sound sources of interfering sound. Multiple microphones included in the sound signal processing apparatus according to an embodiment of the present disclosure produce signals in which sounds from these sound sources are mixed.

This embodiment assumes that the sound signal processing apparatus according to an embodiment of the present disclosure has n microphones.

Signals obtained by the n microphones 1 to n are denoted as X_ 1 to X_n respectively, and a vector representation of those signals together is denoted as observed signal X.

This is the observed signal X shown in FIG. 2.

As the observed signal X is strictly data in units of time or frequency, it is denoted as X(t) or X(ω,t). This also applies to X' and Z.

As shown in FIG. 2, the result of application of the decorrelating matrix P to the observed signal X is decorrelated observed signals X'_1 to X'_n, and a vector representing them together is X'. To be exact, decorrelating matrix P is data in units of frequency bin and denoted as P(ω) per frequency ω, which also applies to the extracting filter U' hereinafter.

As shown in FIG. 2, applying the extracting filter U' to decorrelated observed signal X' yields the extraction result Z.

Entropy H(Z) or objective function G(U') is once calculated so that Z becomes the estimation signal of the target sound and the filter U is updated so as to minimize the calculated value.

As shown by equation [4.15] described earlier, the objective function G(U') is equivalent to entropy H(Z).

The process disclosed herein repeatedly executes the following operations shown in FIG. 2:

(a) acquire the extraction result Z, (b) calculate the objective function G(U'), and (c) calculate the extracting filter U'.

That is, through iterative learning in which the operations (a) to (c) are repetitively performed using the observed signal X, the optimal extracting filter U' for target sound extraction is finally calculated.

Varying the extracting filter U' causes the extraction result Z(t) to vary and the objective function G(U') becomes minimum when the extraction result Z(t) is composed of only one sound source.

Thus, through the iterative learning, the extracting filter U' that makes the objective function G(U') minimum is computed.

The specific process will be described later with reference to FIG. 4.

When equations [3.12] to [3.14] are used as probability density functions as in the processes described in Japanese Patent No. 4449871 and Japanese Patent No. 4556875 for calculating the objective function G(U'), namely entropy H(Z), the objective function G(U') can be represented as equation [4.20]. The meaning of this equation is described using FIG. 3.

Figure 3:
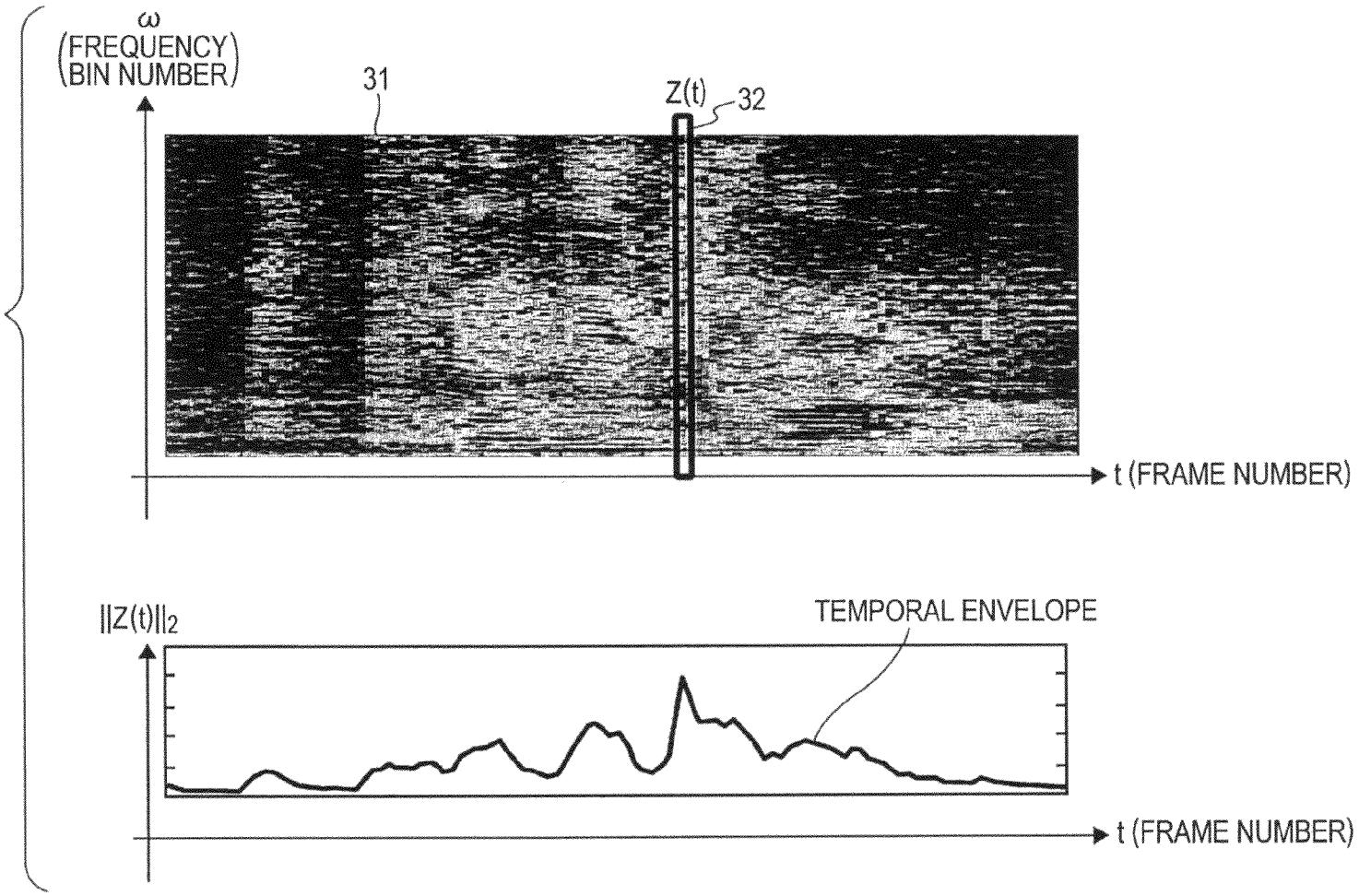
FIG. 3 is a diagram describing a spectrogram of an extraction result and a temporal envelop of a spectrum.

Referring to FIG. 3, a spectrogram 31 for the extraction result Z(ω,t) is shown, where the horizontal axis represents frame number t and the vertical axis represents frequency bin number ω.

For example, the spectrum for frame number t is spectrum Z(t) 32. Since Z(t) is a vector, a norm such as L-2 norm can be calculated.

The graph shown in the lower portion of FIG. 3 is a graph of ||Z(t)||_2, which is the L-2 norm of the spectrum Z(t), where the horizontal axis represents frame number t and the vertical axis represents ||Z(t)||_2, which is the L-2 norm of spectrum Z(t). The graph of ||Z(t)||_2 also represents the temporal envelope of Z(t) (i.e., an outline of sound volume in time direction).

Equation [4.20] represents minimization of the average of ||Z(t)||_2, which makes the temporal envelope of Z(t) for time t as sparse as possible. This means increasing the number of frames in which the L-2 norm of spectrum Z(t), ||Z(t)||_2, is zero (or a value close to zero) as much as possible.

However, simply solving the minimization problems of equations [4.16] to [4.20] with some algorithm does not guarantee that the intended sound source will be obtained without fail but conversely could result in acquisition of interfering sound. This is because, as a matter of fact, the minimization problem of equation [4.10] from which equations [4.16] to [4.20] are derived yields estimation of the target sound only when a probability density function corresponding to the distribution of the sound sources of the target sound is used in calculation of entropy H(Y_k), whereas the probability density function of equation [3.13] does not necessarily agrees with the distribution of the target sound.

As it is difficult to know the true distribution of the target sound, a solution using a probability density function that precisely corresponds to the target sound is not practical.

Consequently, the objective function G(U') of equation [4.20] has the following properties:

(1) The objective function G(U') assumes a local minimum when the extracting filter U' is designed to extract one of sound sources. That is, the objective function G(U') also assumes a local minimum when the extracting filter U' is a filter for extracting one of interfering sounds.

(2) Which one of local minimums of the objective function G(U') becomes minimum depends on combination of sound sources. That is, U that minimizes the objective function G(U') is a filter that extracts any one sound source, but there is no guarantee that the filter extracts the target sound.

Figure 4:
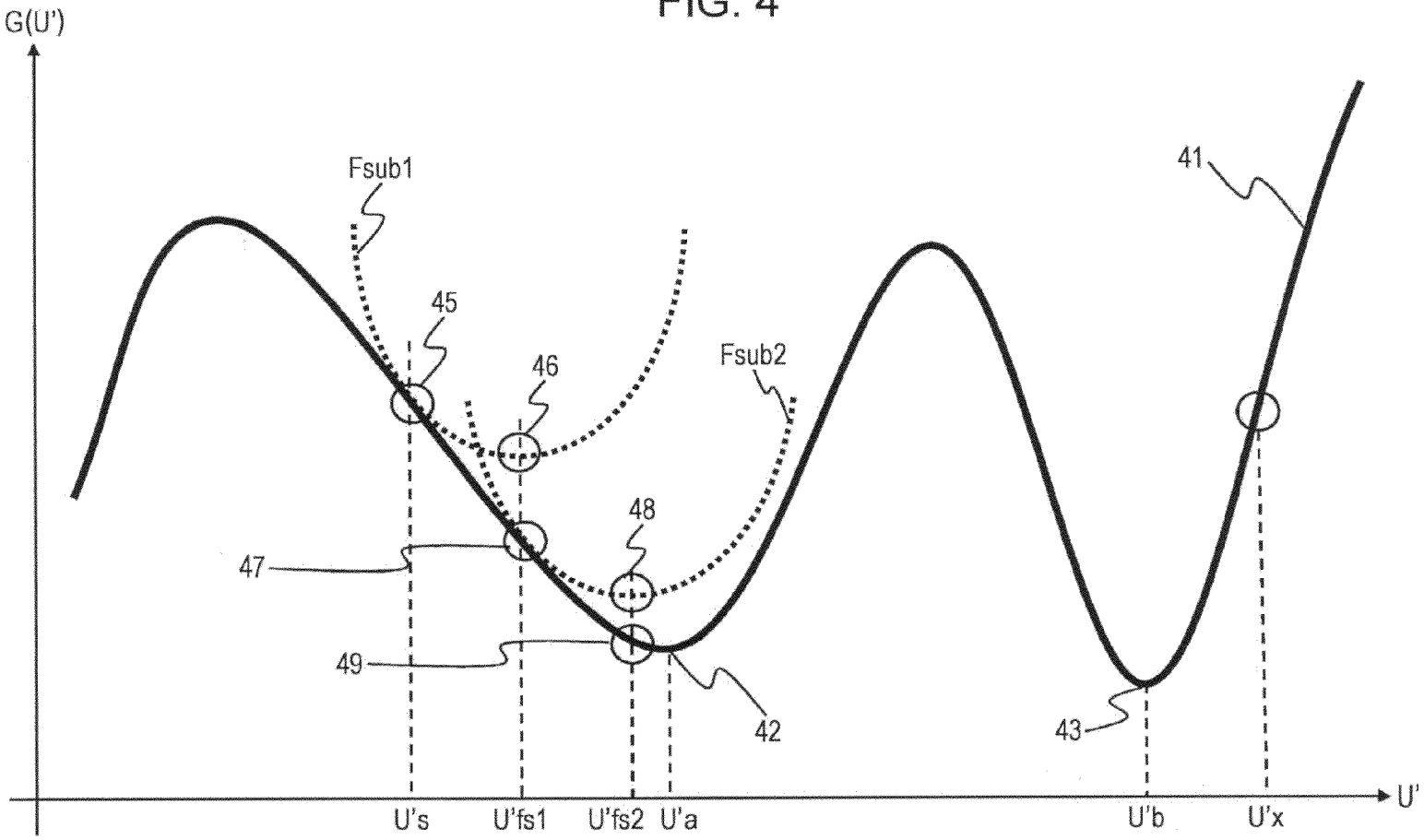
FIG. 4 is a diagram describing computation of an extracting filter employing an objective function and an auxiliary function.

These properties of the objective function are described with FIG. 4.

FIG. 4 is a graph representing the relationship between the extracting filter U' and the objective function G(U') represented by equation [4.18]. The vertical axis represents the objective function G(U'), the horizontal axis represents the extracting filter U, and a curve 41 represents the relationship between them. Since the actual extracting filter U' is formed of multiple elements and may not be represented by one axis, this graph is a conceptual representation of the correspondence between the extracting filter U' and the objective function G(U').

As mentioned earlier, varying of the extracting filter U' causes the extraction result Z(t) to vary. The objective function G(U') becomes minimum when the extraction result Z(t) is composed of only one sound source.

FIG. 4 assumes a scenario with two sound sources. Since there are two possible cases in which extraction result Z(t) is composed of a single sound source, there are also two local minimums, namely local minimum A 42 and local minimum B 43.

Referring to the environment shown in FIG. 1 again as a case with two sound sources, one of the local minimum A 42 and local minimum B 43 corresponds to the case where the extraction result Z(t) is composed only of the target sound 11 shown in FIG. 1 and the other local minimum corresponds to the case where Z(t) is composed only of the interfering sound 14 shown in FIG. 1. Which local minimum value is smaller (i.e., is the global minimum) depends on combination of sound sources.

Accordingly, for extraction of only the target sound using deflation, solving the minimization problem for the objective function is not sufficient but a local minimum corresponding to the target sound has to be found in consideration of the aforementioned properties of the objective function.

An effective way for this is to give an appropriate initial value for the learning in estimation of the extracting filter U'. Use of the auxiliary function method facilitates supply of an appropriate initial value. This will be described next.

[4-2. Introduction of Auxiliary Function Method]

The auxiliary function method is a way to efficiently solve the optimization problem for the objective function. For details, see Japanese Unexamined Patent Application Publication No. 2011-175114, for example.

In the following, the auxiliary function method will be described from a conceptual perspective, then a specific auxiliary function for use in the sound signal processing apparatus according to an embodiment of the present disclosure will be discussed. Thereafter, the relation between auxiliary function method and the initial value for the learning will be described.

(Conceptual Description of the Auxiliary Function)

Referring to FIG. 4, the auxiliary function method is described from a conceptual perspective first.

As explained earlier, the curve 41 shown in FIG. 4 is an image of the objective function G(U') shown in equation [4.20], conceptually illustrating variation in the objective function G(U') as a function of the value of the extracting filter U'.

As mentioned above, the objective function G(U') 41 has two local minimums, the local minimum A 42 and local minimum B 43. In FIG. 4, the filter U'a corresponding to the local minimum A 42 is the optimal filter for extracting the target sound and the filter U'b corresponding to the local minimum B 43 is the optimal filter for extracting interfering sound.

Since the objective function G(U') of equation [4.20] includes computation of a square root and the like, it is difficult to calculate the filter U' corresponding to a local minimum in closed form (an equation in the form "U'= . . . "). Thus, the filter U' has to be estimated with an iterative algorithm. Such repetitive estimation will be referred to as learning hereinbelow. Adoption of an auxiliary function in the learning can significantly reduce the number of iterations until convergence.

In FIG. 4, an appropriate initial value for the learning U's is prepared. An initial value for the learning is equivalent to an initial setting filter, which is described in detail later. At an initial set point 45, which is a point in the objective function G(U') on the curve 41 corresponding to the initial value for the learning U's, a function F(U') that satisfies the following conditions (a) to (c) is prepared. Specific arguments of the function F will be shown later.

(a) Function F(U') is tangent to the curve 41 of the objective function G(U') only at the initial set point 45.

(b) In the value range of the filter U' except the initial set point 45, F(U')>G(U').

(c) Filter U' corresponding to the minimum value of the function F(U') can be easily calculated in closed form.

The function F satisfying these conditions is called auxiliary function. An auxiliary function Fsub1 shown in the figure is an example of the auxiliary function.

Filter U' corresponding to the minimum value a 46 of the auxiliary function Fsub1 is denoted as U'fs1. According to condition (c), it is assumed that the filter U'fs1 corresponding to the minimum value a 46 of the auxiliary function Fsub1 can be easily calculated.

Next, an auxiliary function Fsub2 is similarly prepared at a corresponding point a 47 corresponding to the filter U'fs1, namely corresponding point (U'fs1, G(U'fs1)) 47, on the curve 41 indicating the objective function G(U').

That is, the auxiliary function Fsub2 (U') satisfies the following conditions.

(a) Auxiliary function Fsub2 (U') is tangent to the curve 41 of the objective function G(U') only at the corresponding point 47.

(b) In the value range of the filter U' except the corresponding point 47, Fsub2(U')>G(U').

(c) Filter U' corresponding to the minimum value of the auxiliary function Fsub2 (U') can be easily calculated in closed form.

Further, a filter corresponding to the minimum value b 48 of the auxiliary function Fsub2 (U') is defined as filter U'fs2. An auxiliary function is similarly prepared at a corresponding point b 49 corresponding to filter U'fs2 on the curve 41 indicating the objective function G(U'). This is an auxiliary function Fsub3 (U') that satisfies the conditions (a) to (c) but with the corresponding point a 47 replaced with corresponding point b 49.

By repeating these operations, U'a, the value of the filter U' corresponding to the local minimum A 42 can be efficiently determined.

By sequentially updating the auxiliary function from the initial set point 45, the local minimum A 42 is progressively approached and finally the filter U'a corresponding to the local minimum A 42 or a filter in its vicinity can be computed.

This process represents the iterative learning described above with reference to FIG. 2, that is, an iterative learning process that iteratively executes (a) acquisition of the extraction result Z, (b) computation of the objective function G(U'), and (c) computation of the extracting filter U'.

(An example of the auxiliary function used in the process according to an embodiment of the present disclosure)

A specific example of the auxiliary function for use in the process according to an embodiment of the present disclosure is described next in connection with how it is derived.

Given that a value b(t) based on frame number t is a variable that assumes a certain positive value, the inequality of equation [5.1] shown below holds at all times with the L-2 norm of the extraction result Z, ||Z(t)||_2. The equal sign only holds when b(t) satisfies equation [5.2]

$$(\|Z(t)\|_2 - b(t))^2 \geq 0 \quad [5.1]$$

$$b(t) = \|Z(t)\|_2 \quad [5.2]$$

$$\|Z(t)\|_2 \leq \frac{1}{2}\left(\frac{\|Z(t)\|_2^2}{b(t)} + b(t)\right) \quad [5.3]$$

$$\langle \|Z(t)\|_2 \rangle_t \leq \frac{1}{2}\left(\left\langle \frac{\|Z(t)\|_2^2}{b(t)} \right\rangle_t + \langle b(t) \rangle_t\right) \quad [5.4]$$

-continued $$= \frac{1}{2}\left(\left\langle \frac{\sum_{\omega} |Z(\omega, t)|^2}{b(t)} \right\rangle_t + \langle b(t) \rangle_t\right) \quad [5.5]$$

$$= \frac{1}{2}\left(\sum_{\omega} \left\langle \frac{|Z(\omega, t)|^2}{b(t)} \right\rangle_t + \langle b(t) \rangle_t\right) \quad [5.6]$$

$$= \frac{1}{2}\left(\sum_{\omega} U'(\omega)\left\langle \frac{X'(\omega, t)X'(\omega, t)^H}{b(t)} \right\rangle_t U'(\omega)^H + \langle b(t) \rangle_t\right) \quad [5.7]$$

$$= F(U'(1), \ldots, U'(\Omega), b(1), \ldots, b(T)) \quad [5.8]$$

$$Z(\omega, t) = U'(\omega)X'(\omega, t) = U'(\omega)P(\omega)X(\omega, t) \quad [5.9]$$

$$b(t) = \|Z(t)\|_2 = \left(\sum_{\omega} |Z(\omega, t)|^2\right)^{1/2} \quad [5.10]$$

$$U'(\omega) = \underset{U'(\omega)}{\operatorname{argmin}}\, U'(\omega)\left\langle \frac{X'(\omega, t)X'(\omega, t)^H}{b(t)} \right\rangle_t U'(\omega)^H \quad [5.11]$$

$$\left\langle \frac{X'(\omega, t)X'(\omega, t)^H}{b(t)} \right\rangle_t = A(\omega)B(\omega)A(\omega)^H \quad [5.12]$$

$$A(\omega) = [A_1(\omega), \ldots, A_n(\omega)] \quad [5.13]$$

$$B(\omega) = \begin{bmatrix} b_1(\omega) & & 0 \\ & \ddots & \\ 0 & & b_n(\omega) \end{bmatrix} \quad [5.14]$$

$$U'(\omega) = A_n(\omega)^H \quad [5.15]$$

$$\langle X(\omega, t)X(\omega, t)^H \rangle_t = V(\omega)D(\omega)V(\omega)^H \quad [5.16]$$

$$V(\omega) = [V_1(\omega), \ldots, V_n(\omega)] \quad [5.17]$$

$$D(\omega) = \begin{bmatrix} d_1(\omega) & & 0 \\ & \ddots & \\ 0 & & d_n(\omega) \end{bmatrix} \quad [5.18]$$

$$P(\omega) = D(\omega)^{-1/2}V(\omega)^H \quad [5.19]$$

$$\left\langle \frac{X'(\omega, t)X'(\omega, t)^H}{b(t)} \right\rangle_t = P(\omega)\left\langle \frac{X(\omega, t)X(\omega, t)^H}{b(t)} \right\rangle_t P(\omega)^H \quad [5.20]$$

As described earlier with reference to FIG. 3, the L-2 norm ||Z(t)||_2 of the extraction result Z is equivalent to the temporal envelope, which is an outline of the sound volume of the target sound in time direction, and the value of each frame t of the temporal envelope is substituted into the auxiliary variable b(t).

Modifying equation [5.1] yields the inequality of equation [5.3]. The equal-sign holding condition for this inequality is also equation [5.2]

Applying equation [5.3] to the objective function G(U') of equation [4.20] shown above yields equation [5.4]. The right-hand side of this inequality is altered into equation [5.5] according to equation [3.14] shown above.

Further, since averaging for frame t and summation for frequency bin ω can be interchanged in order in equation [5.5], equation [5.5] is modified into equation [5.6]. Further, by application of equation [4.14], equation [5.7] is obtained. Equation [5.7] is defined as F, and this function is called auxiliary function.

The auxiliary function F may be denoted as a function that has variables U'(1) to U'(Ω) and variables b(1) to b(T) as arguments as equation [5.8].

That is, the auxiliary function F has two kinds of argument, (a) and (b):

(a): U'(1) to U'(ω), which are extracting filters for respective frequency bins ω, where Ω is the number of frequency bins, and (b): b(1) to b(T), which are auxiliary variables for respective frames t, where T is the number of frames.

The auxiliary function method solves the minimization problem by alternately repeating the operation of varying and minimizing one of the two arguments while fixing the other argument.

(Step S1) Fix U'(1) to U'(Ω) and determine b(1) to b(T) that minimize auxiliary function F.

(Step S2) Fix b(1) to b(T) and determine U'(1) to U'(Ω) that minimize auxiliary function F.

The steps are described using FIG. 4.

The first step S1 is equivalent to a step to find the position at which the objective function G(U') shown in FIG. 4 is tangent to the auxiliary function (such as the initial set point 45 and corresponding point a 47), for example.

The next step S2 is equivalent to a step to determine a filter value (such as U'fs1 and U'fs2) corresponding to the minimum value of the auxiliary function shown in FIG. 4 (such as minimum value a 46 or b 48).

Using equation [5.7] as the auxiliary function F, both the steps S1 and S2 can be easily calculated, which is described below.

For step S1, b(t) that minimizes the auxiliary function F shown in equation [5.7] should be determined for each value of t. According to equation [5.3] which is an inequality from which the auxiliary function is derived, such b(t) can be calculated with equation [5.2].

That is, the filter U'(ω) determined at the preceding step is used to compute the extraction result Z(ω,t). This can be computed using equation [5.9].

Next, using the computed extraction result Z(ω,t), b(t) is calculated according to equation [5.10].

Computation of b(t) by equation [5.10] is equivalent to updating the auxiliary variable b(t) based on Z(ω,t), i.e., the result of application of the extracting filter U'(ω) to the observed signal. Specifically, the application result Z(ω,t) for the extracting filter U'(ω) is generated, the L-2 norm (the temporal envelope of FIG. 3) of the vector [Z(1, t), . . . , Z(Ω, t)], which is the spectrum of the application result (Ω is the number of frequency bins), is calculated for each frame t, and the value is substituted to b(t) as the updated value of the auxiliary variable.

For step S2, U'(ω) that minimizes F should be determined for each value of w under the constraint of equation [4.18]. To this end, the minimization problem of equation [5.11] is solved. This equation is the same as an equation described in Japanese Unexamined Patent Application Publication No. 2012-234150, and the same solution using eigenvalue decomposition is possible. This solution is described below.

As indicated by equation [5.12], the eigenvalue decomposition is applied to the term < . . . >_t in equation [5.11]. The left-hand side of equation [5.12] is a weighted covariance matrix for the decorrelated observed signal with a weight of 1/b(t), while the right-hand side is the result of the eigenvalue decomposition.

A(ω) on the right-hand side is a matrix including eigenvectors A_1 (ω) to A_n(ω) of the weighted covariance matrix. A(ω) is indicated by equation [5.13].

B(ω) is a diagonal matrix including eigenvalues b_1 (ω) to b_n(ω) of the weighted covariance matrix. B(ω) is indicated by equation [5.14].

Since eigenvectors have a magnitude of 1 and are orthogonal to each other, they satisfy A(ω)^HA(ω)=I.

U'(ω), the solution of the minimization problem of equation [5.12], is represented as the Hermitian transpose of an eigenvector corresponding to the smallest eigenvalue. Given that eigenvalues are arranged in descending order in equation [5.14], the eigenvector corresponding to the smallest eigenvalue is A_n(ω), so that U'(ω) is represented as equation [5.15].

After U'(ω) has been determined for all co, step S1, namely equations [5.9] and [5.10] are executed again. Then, after b(t) has been determined for all t, step S2, namely equations [5.12] to [5.15] are executed again. These operations are repeated until U'(ω) converges (or a predetermined number of times).

This iterative process is equivalent to sequentially computing the auxiliary function Fsub2 from the auxiliary function Fsub1 and further computing the auxiliary functions Fsun3, Fsub4, . . . and so on which are closer to the local minimum A 42 from the auxiliary function Fsub2 in FIG. 4.

Here, two matters are additionally described in relation to equations [4.1] to [4.20], and [5.1] to [5.20] shown above: one is about how a decorrelating matrix can be determined and the other one is about the way to calculate a weighted covariance matrix for the decorrelated observed signal.

The decorrelating matrix P(ω) used in equation [4.1] is calculated with equations [5.16] to [5.19]. The left-hand side of equation [5.16] is a covariance matrix for the observed signal before decorrelation and the right-hand side is the result of application of eigenvalue decomposition to it. V(ω) on the right-hand side is a matrix composed of eigenvectors V_1 (w) to V_n(ω) of the observed signal covariance matrix (equation [5.17]), and D(ω) is a diagonal matrix composed of the eigenvalues d_1 (ω) to d_n(ω) of the observed signal covariance matrix (equation [5.18]). Since eigenvectors have a magnitude of 1 and are orthogonal to each other, they satisfy V(ω)ˆHV(ω)=I. P(ω) is calculated from equation [5.19].

The second matter concerns the way to calculate a weighted covariance matrix for the decorrelated observed signal appearing on the left-hand side of equation [5.12]. Using the relation of equation [4.1], the left-hand side of equation [5.12] is modified as equation [5.20]. Specifically, by once calculating a weighted covariance matrix for the observed signal before decorrelation using the inverse number of the auxiliary variable as weight, and then multiplying P(ω) and P(ω)ˆH to before and after the resulting matrix, a matrix identical to the weighted covariance matrix for the decorrelated observed signal can be generated. As generation of the decorrelated observed signal X'(ω,t) can be skipped when calculation is performed according to the right-hand side of equation [5.20], computational complexity and memory can be saved compared to calculation according to the left-hand side.

(Relation Between the Auxiliary Function Method and the Initial Value for the Learning)

The auxiliary function method is often referred to for its ability to stably and speedily make the objective function converge, and this feature is mentioned as the advantageous effect of a disclosed technique in Japanese Unexamined Patent Application Publication No. 2011-175114, for example. It also has the effect of facilitating use of extraction results generated with other schemes as initial values for the learning, and the sound signal processing apparatus according to an embodiment of the present disclosure makes use of this feature. This will be described below.

Importance of the initial value for the learning is described first using FIG. 4 again.

As described earlier, the objective function G(U') of FIG. 4 has two local minimums, the local minimum A 42 corresponding to extraction of the target sound and the local minimum B 43 corresponding to extraction of interfering sound.

If the filter value U's corresponding to the initial set point 45 is used as the initial value for the learning following the aforementioned procedure, it is likely to converge to the local minimum A 42 corresponding to the target sound. In contrast, if the filter value U'x shown in FIG. 4 is used as the initial value, it is likely to converge to the local minimum B 43 corresponding to interfering sound.

As the initial value for the learning is closer to the convergence point, fewer iterations are entailed until convergence. In the example shown in FIG. 4, convergence to the local minimum A 42 is faster when learning is started from the filter value U'fs1 corresponding to the corresponding point a 47, for example, than from the filter value U's corresponding to the initial set point 45.

Convergence to the local minimum A 42 becomes even faster when learning is started from the filter value U'fs2 corresponding to the corresponding point b 49.

The challenge is therefore to generate a initial value for the learning that is likely to converge to a local minimum corresponding to the target sound and generate a initial value for the learning as close to the convergence point as possible so that learning converges in a small number of iterations. Such an initial value will be called an appropriate initial value (for the learning).

Typically, in a problem setting to find the filter value U' corresponding to a local minimum of the objective function G(U'), the initial filter value U' of a particular value is used as the initial value for the learning. It is generally difficult to directly determine an appropriate initial filter value U', however. For example, while it is possible to build an extracting filter according to the delay-and-sum array method and use it as the initial value for the learning, there is no guarantee it is an appropriate initial value for the learning.

In the auxiliary function method, extraction results generated with other schemes can be used in estimation of an auxiliary variable in addition to a filter itself. This will be described using equations [5.9] and [5.10] given above.

Equation [5.10], which is an equation to determine b(t) that minimizes the auxiliary function F with the extracting filters U'(1) to U'(Ω) fixed, is equivalent to an equation for determining the temporal envelope of the extraction result, namely the L-2 norm ||Z(t)||_2 of the spectrum Z(t) shown in FIG. 3. That is, if equation [5.7] is used as the auxiliary function, the value of the auxiliary variable corresponds to the temporal envelope of an extraction result obtained in the course of learning.

At a time when the extracting filter U'(ω) has almost converged, the extraction result Z(ω,t) obtained in the course of learning using that extracting filter U'(ω) is considered to approximately match the target sound, so that the auxiliary variable b(t) at that point in time is considered to substantially agree with the temporal envelope of the target sound. In the following step, the updated extracting filter U'(ω) for extracting the target sound further accurately is estimated from that auxiliary variable b(t) (equations [5.11] to [5.15]).

This consideration implies that if the temporal envelope ||Z(t)||_2 of the target sound could be estimated with high accuracy with some means, substituting the estimated temporal envelope to the auxiliary variable b(t) and further solving equation [5.11] could determine the extracting filter U'(ω). Such an extracting filter U'(ω) is likely to be a filter positioned near the convergence point, that is, in the vicinity of the extracting filter U'a corresponding to the local minimum A 42 corresponding to the target sound shown in FIG. 3, for example. It is therefore expected that the number of iterations until convergence of learning will be small.

Thus, by using the temporal envelope of the target sound estimated with other scheme as the initial value for the learning, for example, in application of the auxiliary function method using the auxiliary function shown in equations [5.4] to [5.7], the extracting filter for target sound extraction can be computed efficiently and reliably.

This feature constitutes an advantage over other learning algorithms. For example, in the gradient method mentioned above, the initial value for the learning is U'(ω) itself and the elements of its vector are complex numbers.

For the value to be an appropriate initial value for the learning, both the phase and amplitude of the complex numbers have to be accurately estimated, but it is difficult. There is also a method that utilizes a result of target sound estimation in time-frequency domain as the initial value for the learning as mentioned later, in which case it is again difficult to accurately estimate both the amplitude and phase of the target sound for each frequency bin.

In contrast, the temporal envelope used as the initial value for the learning herein is easy to estimate, because only one value has to be estimated for all frequency bins instead of per frequency bin and, moreover, it may be a positive real number, not a complex number.

Next, a scheme based on time-frequency masking will be described as a method for estimating such a temporal envelope.

[4-3. Process Using Time-Frequency Masking Using the Target Sound Direction and Phase Difference Between Microphones as Initial Values for the Learning]

A process that uses time-frequency masking based on the target sound direction and phase difference between microphones as initial values for the learning is described below.

As mentioned above, frequency masking is a technique to extract the target sound by multiplying different coefficients for different frequencies to mask (reduce) frequency components in which interfering sound is dominant while leaving frequency components in which the target sound is dominant.

Time-frequency masking is a scheme in which the mask coefficient is varied over time instead of being fixed. When the mask coefficient is denoted as M(ω,t), extraction can be represented by equation [2.2] described earlier.

The time-frequency masking used herein is similar to the one disclosed by Japanese Unexamined Patent Application Publication No. 2012-234150, in which the mask value is calculated in time-frequency domain based on similarity between a steering vector calculated from the target sound direction and the observed signal vector.

As noted above, a steering vector is a vector representing the phase difference between microphones for sound originating from a certain direction. The extraction result can be obtained by computing a steering vector corresponding to the target sound direction θ and following the equation [2.1] described earlier.

First, generation of a steering vector will be described with FIG. 5 and equations [6.1] to [6.3] shown below.

$$q(\theta) = \begin{bmatrix} \cos\theta \\ \sin\theta \\ 0 \end{bmatrix} \quad [6.1]$$

$$S_k(\omega, \theta) = \exp\left(j\pi \frac{(\omega - 1)F_x}{(\Omega - 1)C} q(\theta)^T (m_k - m)\right) \quad [6.2]$$

-continued $$S(\omega, \theta) = \frac{1}{\sqrt{n}} \begin{bmatrix} S_1(\omega, \theta) \\ \vdots \\ S_n(\omega, \theta) \end{bmatrix} \quad [6.3]$$

$$M(\omega, t) = \frac{|S(\omega, \theta)^H X(\omega, t)|}{\sqrt{X(\omega, t)^H X(\omega, t)}} \quad [6.4]$$

$$Q(\omega, t) = M(\omega, t)^J X_k(\omega, t) \quad [6.5]$$

$$Q(\omega, t) = M(\omega, t)^J S(\omega, \theta)^H X(\omega, t) \quad [6.6]$$

$$Q'(\omega, t) = \frac{Q(\omega, t)}{\{\langle |Q(\omega, t)|^2 \rangle_t\}^{1/2}} \quad [6.7]$$

$$b(t) = \left\{ \sum_{\omega} |Q'(\omega, t)|^2 \right\}^{1/2} \quad [6.8]$$

$$b(t) = \left\{ \sum_{\omega} |M(\omega, t)|^L \right\}^{1/L} \quad [6.9]$$

$$q(\theta, \psi) = \begin{bmatrix} \cos\psi \cdot \cos\theta \\ \cos\psi \cdot \sin\theta \\ \sin\psi \end{bmatrix} \quad [6.10]$$

Figure 5:
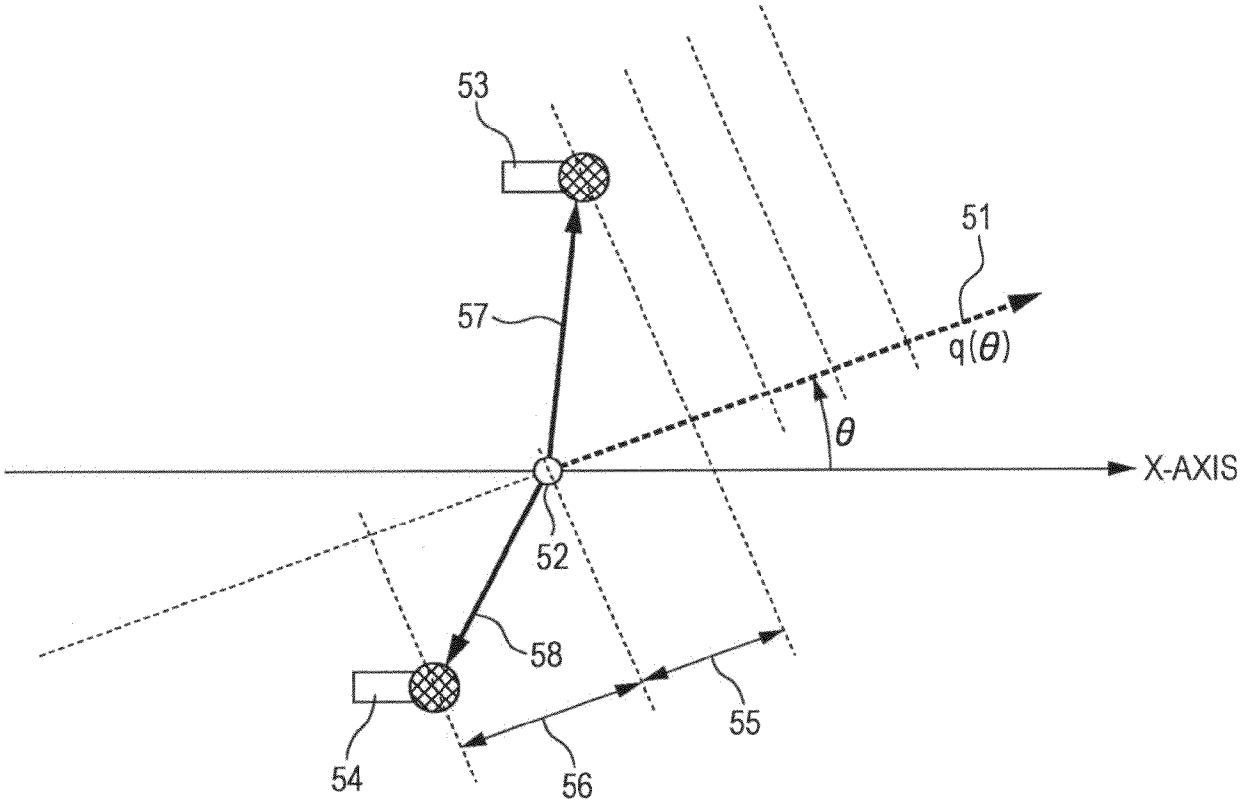
FIG. 5 is a diagram describing how a steering vector is generated.

A reference point m 52 shown in FIG. 5 is defined as the reference point for direction measurement. The reference point m 52 may be any position near the microphones; for example, it may be positioned at the barycenter of the microphones or aligned with one of the microphones. The position vector (i.e., coordinates) of reference point 52 is represented as m.

In order to represent the direction of arrival of sound, a vector having a length of 1 starting at the reference point m 52 is prepared and defined as a direction vector q(θ) 51. If the sound source position is at about the same height as the microphones, the direction vector q(θ) 51 may be considered to be a vector on an X-Y plane (the vertical direction being the Z axis) and its components can be represented by equation [6.1], where direction θ is an angle formed with the X axis.

In FIG. 5, sound originating from the direction of direction vector q(θ) arrives at the k-th microphone 53 first, then the reference point m 52, and then the i-th microphone 54. The phase difference of the k-th microphone 53 with respect to the reference point m 52 can be represented by equation [6.2].

In equation [6.2], j: imaginary unit

Ω: number of frequency bins

F_s: sampling frequency

C: speed of sound m_k: position vector of the k-th microphone, and superscript T represents normal transpose.

That is, assuming a plane wave, the k-th microphone 53 is closer to the sound source than the reference point m 52 by a distance 55 shown in FIG. 5; conversely the i-th microphone 54 is farther by a distance 56. These differences in distance can be represented, using the inner product of the vector, as $q(\theta)\hat{}T(m_k-m)$, and $q(\theta)\hat{}T(m_i-m)$.

Converting the distance difference to phase difference yields equation [6.2].

A vector composed of phase differences among microphones is represented by equation [6.3] and called a steering vector. The purpose of dividing by the square root of the number of microphones n is to normalize the vector norm to 1.

If the microphone position and the sound source position are not on the same plane, $q(\theta,\psi)$ which also reflects elevation $\psi$ in the sound source direction vector is calculated with equation [6.10] and $q(\theta,\psi)$ is used in place of $q(\theta)$ in equation [6.2].

As the value of the reference point m 52 does not affect the masking result, the following description assumes m=0 (i.e., the coordinate origin).

Next, how a mask can be generated will be described.

The mask value is calculated based on the degree of similarity between the steering vector and the observed signal vector. For the degree of similarity, a cosine similarity calculated with equation [6.4] is used. Specifically, if the observed signal vector $X(\omega,t)$ is composed only of sound originating from direction $\theta$, the observed signal vector $X(\omega,t)$ is considered to be substantially parallel with the steering vector of direction $\theta$, so the cosine similarity assumes a value close to 1.

In contrast, if the observed signal $X(\omega,t)$ contains sound from a direction other than direction $\theta$, the value of cosine similarity is lower (closer to 0) than when no such sound is present. Further, when the observed signal $X(\omega,t)$ is composed only of sound originating from a direction other than direction $\theta$, the value of cosine similarity is even closer to zero.

Thus, the time-frequency mask is calculated according to equation [6.4]. The time-frequency mask generated with equation [6.4] has the property of the mask value becoming greater (closer to 1) as the observed signal vector is closer to the orientation of the steering vector corresponding to direction $\theta$.

Calculation of a temporal envelope, namely the auxiliary variable b(t), from a mask is a process similar to the one that is disclosed by Japanese Unexamined Patent Application Publication No. 2012-234150 as a method of reference signal calculation. The auxiliary variable b(t) described in connection with the process according to an embodiment of the present disclosure is mentioned as reference signal in Japanese Unexamined Patent Application Publication No. 2012-234150. A major difference between the two techniques is that the auxiliary variable b(t) used herein is updated over time in iterative learning, whereas the reference signal used in Japanese Unexamined Patent Application Publication No. 2012-234150 is not updated.

Specific methods for calculating a temporal envelope, namely the auxiliary variable b(t), from a mask include:

(1) Applying a mask to the observed signal to generate a masking result and calculating the temporal envelope from the masking result.

(2) Directly generating data analogous a temporal envelope from a mask.

These methods will be described below.

[(1) Method that Applies a Mask to the Observed Signal to Generate a Masking Result and Calculates the Temporal Envelope from the Masking Result]

First, the method that applies a mask to the observed signal to generate a masking result and calculates the temporal envelope, namely the initial value of the auxiliary variable b(t), from the masking result will be described.

The masking result $Q(\omega,t)$ is obtained with equation [6.5] or [6.6]. Equation [6.5] applies a mask to the observed signal from the k-th microphone, whereas equation [6.6] applies a mask to the result of a delay-and-sum array. J is a positive real number for controlling the mask effect; the mask effect becomes higher as J increases. In other words, this mask has the effect of attenuating more a sound source that is positioned further off the direction $\theta$; the degree of attenuation increases as J becomes greater.

The masking result $Q(\omega,t)$ is normalized for variance in time direction and the result thereof is defined as $Q'(\omega,t)$. This is the process shown in equation [6.7].

The auxiliary variable b(t) is calculated as the temporal envelope of the normalized masking result $Q'(\omega,t)$ as shown in equation [6.8].

The purpose of normalizing the masking result $Q(\omega,t)$ is to make the forms of calculated temporal envelopes as close to each other as possible in the first and the following calculations of the auxiliary variable. On the second and subsequent calculations, the auxiliary variable b(t) is calculated according to equation [5.10], and the extraction result $Z(\omega,t)$ computed with equation [5.10] is under the constraint of variance=1 as indicated by equation [4.19]. Thus, in order to impose a similar constraint in the initial computation, the variance of the masking result $Q(\omega,t)$ is normalized to 1.

Normalization of the masking result is also aimed at reducing the influence of interfering sound in calculation of the temporal envelope. Sound generally has greater power at lower frequencies, while the ability of time-frequency masking based on phase difference to eliminate interfering sounds degrades at lower frequencies. Accordingly, the masking result $Q(\omega,t)$ can still contain interfering sound that has not completely been eliminated as large power in low frequencies, and simple calculation of the temporal envelope from $Q(\omega,t)$ can result in an envelope different from the one of the target sound due to interfering sound remaining in low frequencies. In contrast, applying variance normalization to the masking result $Q(\omega,t)$ reduces the influence of such interfering sound in low frequencies, so that an envelope close to the target sound envelope can be obtained.

[(2) A Method that Directly Generates Data Analogous to Temporal Envelope from a Mask]

It is also possible to calculate data analogous to a temporal envelope directly from a mask. An equation for such direct calculation is represented by equation [6.9]. L in equation [6.9] represents a positive real number. For the mechanism by which data analogous to a temporal envelope can be produced with this equation, reference may be made to Japanese Unexamined Patent Application Publication No. 2012-234150.

The temporal envelope of the target sound is used as the initial value for the learning in the auxiliary function method.

[4-4. Process that Uses Time-Frequency Masking Also on Extraction Results Generated in the Course of Learning]

Next, a process that uses time-frequency masking also on extraction results generated in the course of learning will be described.

Section [4-2. Introduction of auxiliary function] demonstrated that the auxiliary variable is the temporal envelope of the extraction result and that substitution of something similar to the target sound envelope into the auxiliary variable can make learning converge in a small number of iterations. These considerations are true not just for the initial learning but for the middle of learning.

That is, in the step to calculate the auxiliary variable b(t) during learning, Section [4-2: Introduction of auxiliary function method] used equations [5.9] and [5.10] to calculate the temporal envelope of the extraction result.

However, if something even closer to the target sound's temporal envelope could be gained by other method, it is expected that the number of iterations before convergence could be further decreased by substituting the temporal envelope into the auxiliary variable.

Thus, time-frequency masking, which was described in Section [4-3. Process that uses time-frequency masking using target sound direction and phase difference between microphones as initial values for the learning], is also applied during learning in addition to generation of the initial value.

Specifically, after generating the extraction result Z(ω,t) (in the course of learning) with equation [5.9], its masking result Z'(ω,t) is further generated.

The masking result is generated according to equation [7.1] below.

$$Z'(\omega, t) = M(\omega, t)^J Z(\omega, t) \quad [7.1]$$

$$b(t) = \|Z'(t)\|_2 = \left(\sum_{\omega} |Z'(\omega, t)|^2\right)^{1/2} \quad [7.2]$$

M(ω,t) and J in equation [7.1] are the same as the ones appearing in equation [6.5] and others. Then, using equation [7.2], the auxiliary variable b(t) is calculated.

This process is equivalent to applying a time-frequency mask that attenuates sounds from directions off the sound source direction of the target sound to Z(ω,t), which is the result of application of the extracting filter U'(ω) to the observed signal, to generate the masking result Q(ω,t), then calculating the L-2 norm of the vector [Q(1,t), . . . , Q(Ω,t)] (Ω is the number of frequency bins), which represents the spectrum of the generated masking result, for each frame t, and substituting the value to the auxiliary variable b(t).

Since the auxiliary variable b(t) calculated with equation [7.2] reflects time-frequency masking unlike b(t) calculated with equation [5.10], the auxiliary variable b(t) is considered to be even closer to the temporal envelope of the target sound. It is accordingly expected that convergence could be further speeded up by using the auxiliary variable b(t) computed with equation [7.2].

Further, interpreting equation [7.2], which is an equation for calculating the auxiliary variable, as an equation for estimating the temporal envelope of the target sound, it is possible to modify this equation. For example, if this scheme is used in an environment where frequency bands containing much interfering sound are known, frequency bins that contain much interfering sound are eliminated in calculation of the sigma in equation [7.2]. Alternatively, considering that the target sound is human voice, calculation of the sigma in equation [7.2] is performed only for frequency bins corresponding to frequency bands that contain mainly voice. The value of b(t) thus obtained is expected to be even closer to the temporal envelope of the target sound.

[5. Other Objective Functions and Masking Methods]

Next, an embodiment employing other objective functions and auxiliary functions different from the above-described embodiment will be presented.

The above-described embodiment illustrated a process that uses the objective function G(U') and the auxiliary function fsub described with reference to FIG. 4 and other figures to obtain the extraction result Z with increased accuracy. An accurate extraction result Z could be similarly obtained using other objective functions and/or auxiliary functions.

A different masking scheme than the above-described embodiment may be used in generation of the initial value for the learning and convergence initialization as well. Such alternatives will be described below.

[5-1. Process that Uses Other Objective Functions and Auxiliary Functions]

The objective function G(U') represented by equation [4.20] described earlier is derived by minimization of the KL information. The KL information is a measure indicating the degree of separation of individual sound sources from an observed signal which is a mixed signal of multiple sounds as mentioned above.

A measure for indicating the degree of separation of individual sound sources from a mixed signal of multiple sounds is not limited to KL information but may be other kind of data. Using other data, a different objective function is derived.

The following description shows an example where a value computed with equation [8.1] below is used as the measure indicating the degree of separation.

$$\text{Kurtosis}(\|Z(t)\|_2) = \langle \|Z(t)\|_2^4 \rangle_t - 3\langle \|Z(t)\|_2^2 \rangle_t^2 \quad [8.1]$$

$$\langle \|Z(t)\|_2^2 \rangle_t^2 = \text{const} \quad [8.2]$$

$$(\|Z(t)\|_2^2 - b(t)^2)^2 \geq 0 \quad [8.3]$$

$$\|Z(t)\|_2^4 \geq 2b(t)^2 \|Z(t)\|_2^2 - b(t)^4 \quad [8.4]$$

$$G(U') = \langle \|Z(t)\|_2^4 \rangle_t \quad [8.5]$$

$$\geq 2\langle b(t)^2 \|Z(t)\|_2^2 \rangle_t - \langle b(t)^4 \rangle_t \quad [8.6]$$

$$= 2\sum_{\omega} U'(\omega)\langle b(t)^2 X'(\omega, t)X'(\omega, t)^H \rangle_t U'(\omega)^H - \langle b(t)^4 \rangle_t \quad [8.7]$$

$$= F(U'(1), \ldots, U'(\Omega), b(1), \ldots, b(T)) \quad [8.8]$$

$$U'(\omega) = \underset{U'(\omega)}{\operatorname{argmax}}\ U'(\omega)\langle b(t)^2 X'(\omega, t)X'(\omega, t)^H \rangle_t U'(\omega)^H \quad [8.9]$$

$$\langle b(t)^2 X'(\omega, t)X'(\omega, t)^H \rangle_t = A(\omega)B(\omega)A(\omega)^H \quad [8.10]$$

$$U'(\omega) = A_1(\omega)^H \quad [8.11]$$

$$\langle b(t)^2 X'(\omega, t)X'(\omega, t)^H \rangle_t = P(\omega)\langle b(t)^2 X(\omega, t)X(\omega, t)^H \rangle_t P(\omega)^H \quad [8.12]$$

The value, Kurtosis (||Z(t)||_2), computed according to equation [8.1] represents the kurtosis of the temporal envelope of the extraction result Z. Kurtosis is an indicator of how far the distribution of ||Z(t)||_2, which is the temporal envelope shown in FIG. 3 for example, deviates from the normal distribution (Gaussian distribution).

Distribution of signals with kurtosis=0 is called Gaussian,
kurtosis>0 is called super-Gaussian and
kurtosis<0 is called sub-Gaussian.

An intermittent signal such as voice (sound that is not being emitted at all times) is super-Gaussian.

Also, by the central limit theorem, the more signals are mixed, the closer to the normal distribution the distribution of the resulting mixed signal tends to be.

That is, considering the relation between the degree of signal mixing and its kurtosis, if the distribution of the target sound is super-Gaussian, the kurtosis of the target sound alone assumes a greater value than the kurtosis of a signal in which the target sound and interfering sound are mixed.

In other words, in a plot of the relationship between the extracting filter U' and the kurtosis of the corresponding extraction result, multiple local maxima are present and one of the maxima corresponds to extraction of the target sound.

Even with the same mixing ratio of the target sound and an interfering sound, the kurtosis value varies depending on the scale of the target sound. For keeping the scale of extraction results constant, the constraint of equation [8.2] is placed on the extraction result Z. As discussed later, using decorrelation on the observed signal and eigenvalue decomposition of a weighted covariance matrix, the condition of equation [4.19] given above is satisfied and consequently equation [8.2] is automatically satisfied.

Due to the constraint of equation [8.2], it is sufficient to consider only the first term on the right-hand side of equation [8.1] for addressing the kurtosis maxima. Thus, the first term on the right-hand side of equation [8.1] is used as the objective function G(U') (equation [8.5]). Plotting the relationship between the objective function and the extracting filter U' gives a curve 61 in FIG. 6.

Figure 6:
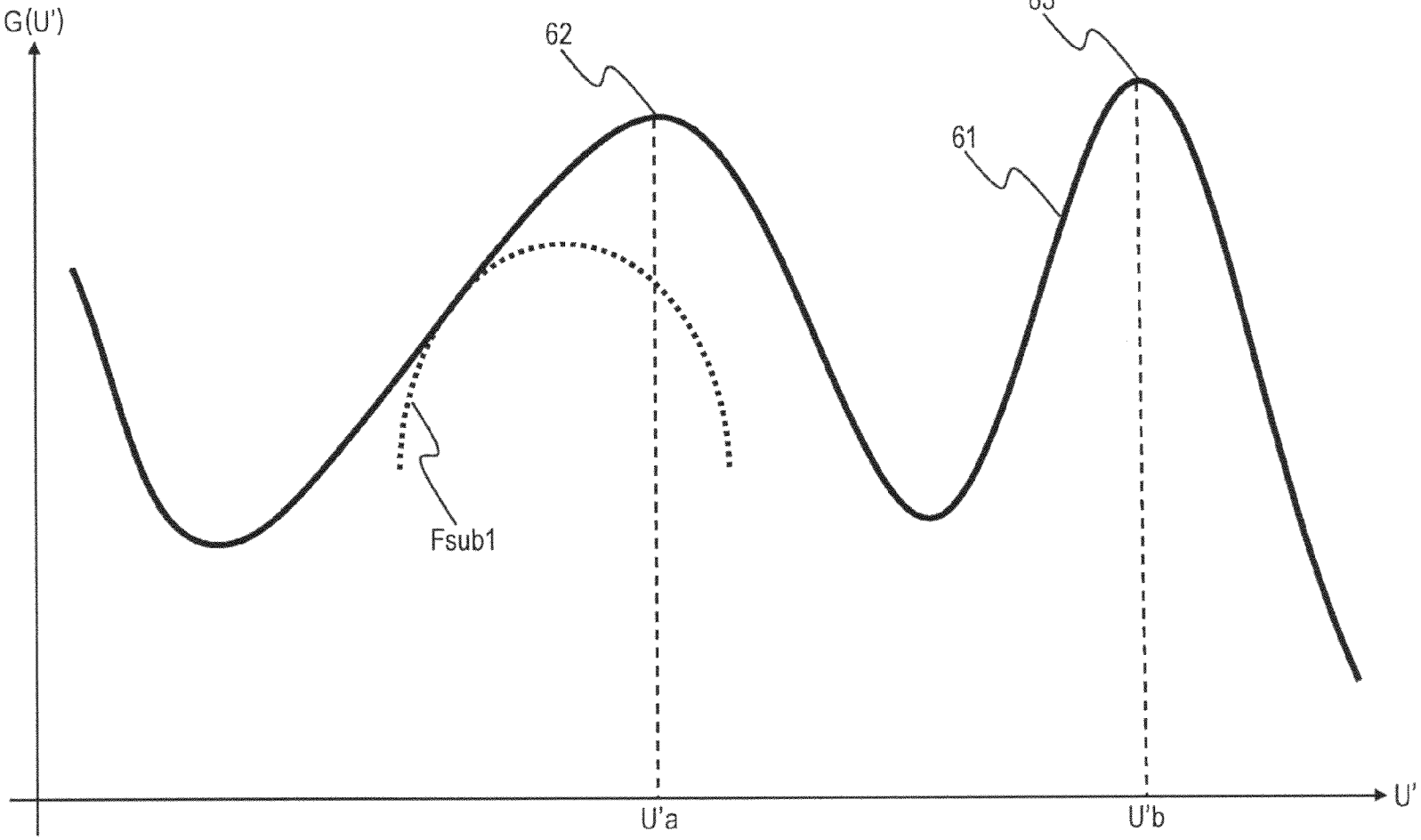
FIG. 6 is a diagram describing computation of the extracting filter employing an objective function and an auxiliary function.

The objective function G(U') 61 shown in FIG. 6 has maxima (e.g., maximum A 62 and maximum B 63) as many as sound sources and one of the maxima corresponds to extraction of the target sound.

Extracting filters U' positioned at the maxima A 62 and B 63, namely extracting filter U'a and extracting filter U'b are the optimal filters for extracting the two sound sources independently.

Accordingly, consider solving this problem using an appropriate initial value for the learning and the auxiliary function method.

To the end, an inequality like equation [8.3] is prepared and modified into equation [8.4].

The condition for the equal sign to hold in these inequalities is equation [5.2] as with the auxiliary function described earlier.

Applying equation [8.4] to the objective function G(U') of equation [8.5] yields equation [8.7] via equation [8.6]. Equation [8.7] is defined as the auxiliary function F. FIG. 6 shows an auxiliary function Fsub1 as an example of the auxiliary function.

The auxiliary function F can be represented as a function that is based on variables U'(1) to U'(Ω) and variables b(1) to b(T) as in equation [8.8].

That is, the auxiliary function F has two kinds of argument:

(a) U'(1) to U'(Ω), which are extracting filters respectively for frequency bins ω, where Ω is the number of frequency bins, and (b) b(1) to b(T), which are auxiliary variables respectively for frames t, where T is the number of frames.

To determine the maxima of the objective function of equation [8.5] using the auxiliary function F of equation [8.7], the following steps are repeated. (As this is a problem to determine maxima, a) and b) below are both maximization).

(Step S1) Fix U'(1) to U'(Ω) and determine b(1) to b(T) that maximize F.

(Step S2) Fix b(1) to b(T) and determine U'(1) to U'(Ω) that maximize F.

Equation [5,10] (or equation [5.2]) gives b(1) to b(T) that satisfy step S1.

Computation of b(t) according to equation [5.10] is equivalent to the process to update the auxiliary variable b(t) based on Z(ω,t), which is the result of application of the extracting filter U'(ω) to the observed signal. Specifically, the application result Z(ω,t) for the extracting filter U'(ω) is generated, the L-2 norm of the vector [Z(1,t), . . . , Z(Ω,t)] (Ω is the number of frequency bins) representing the spectrum of the result is calculated for each frame t, and the value is substituted to b(t) as the updated value of the auxiliary variable.

U'(1) to U'(Ω) that satisfy step S2 can be obtained with equation [8.9].

For solving equation [8.9], eigenvalue decomposition like equation [8.10] is performed and the transpose of the eigenvector corresponding to the largest eigenvalue among the eigenvectors constituting A(ω) is defined as the extracting filter U'(ω)(equation [8.11]).

In processing employing the objective function and auxiliary function shown in FIG. 6, it is possible to use a method in which time-frequency masking is applied during iterative learning, which was described in the section [4-4. Process using time-frequency masking also on extraction results generated in mid-course of learning] in the previous embodiment. That is, at step S1, the auxiliary variables b(1) to b(T) are calculated using equations [7.1] and [7.2] instead of [5.10].

A modification similar to equation [5.20] is applicable to equation [8.10]. That is, instead of calculating the left-hand side of equation [8.10], the right-hand side of equation [8.12] may be calculated, thereby omitting the generation of the decorrelated observed signal X'(ω,t).

[5-2. Other Examples of Masking]

The aforementioned embodiment illustrated use of the time-frequency mask M(ω,t) shown in equation [6.4] as time-frequency mask.

A characteristic of the time-frequency mask of equation [6.4] is that the mask value becomes greater (closer to 1) as the observed signal vector is closer to the orientation of the steering vector corresponding to direction θ.

It is also possible to use a mask with other characteristics in place of one with the aforementioned characteristic.

For example, a mask may be used that only allows the observed signal to pass when the orientation of the observed signal vector falls within a predetermined range. That is, if orientations in the predetermined range are denoted as θ−α to θ+α, the mask passes the observed signal only when the observed signal is composed of sounds originating from directions in that range. Such a mask will be described with reference to FIG. 7.

Figure 7:
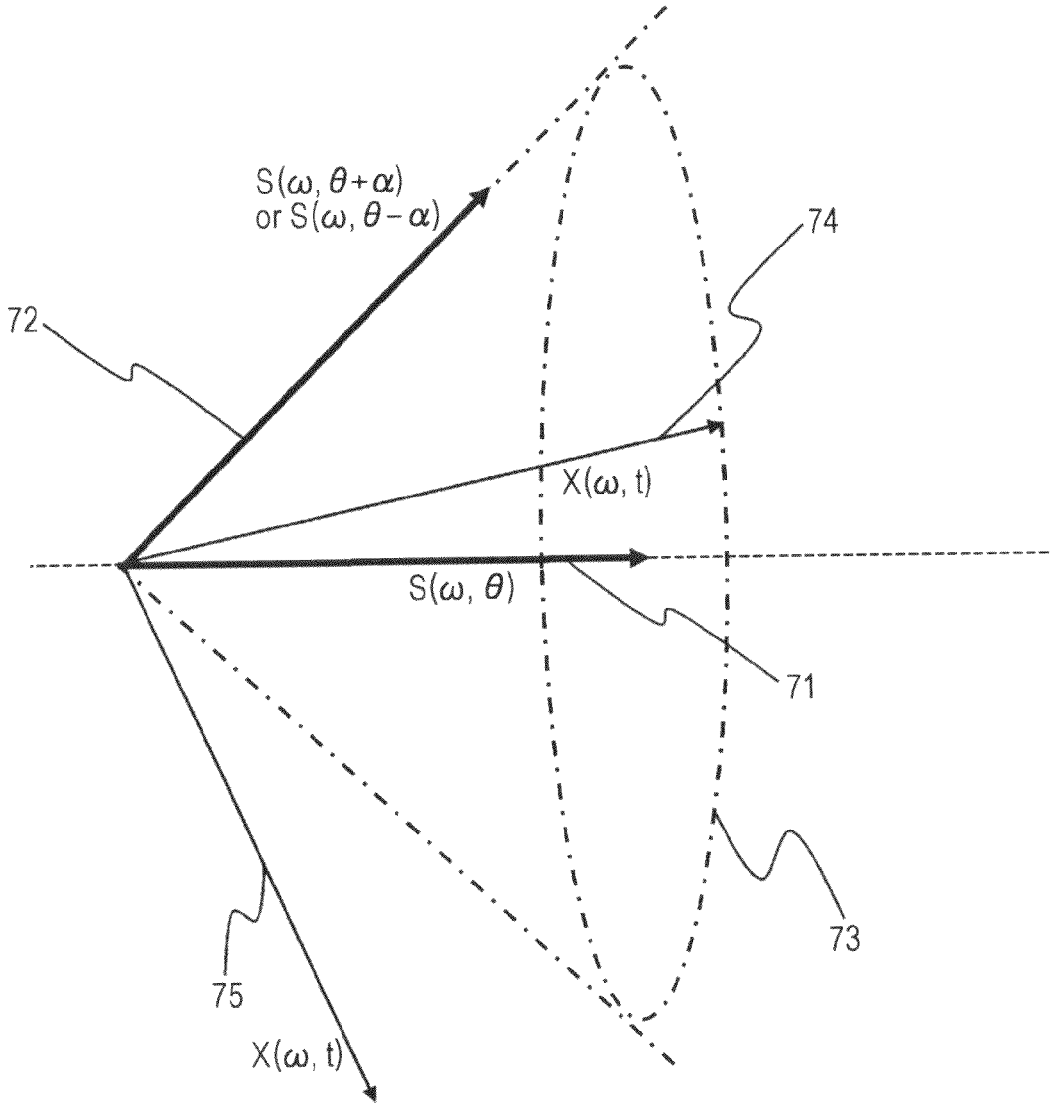
FIG. 7 is a diagram describing a mask that passes observed signals originating from a particular direction.

A steering vector S(Ω,θ) corresponding to direction θ and a steering vector S(ω,θ+α) corresponding to direction θ+α are prepared. In FIG. 7, they are conceptually represented as a steering vector S(ω,θ) 71 and a steering vector S(ω,θ+α) 72.

As an actual steering vector is an n-dimensional complex vector and may not be depicted, the illustration is an image. For the same reason, the steering vector S(ω,θ) is distinct from the sound source direction vector q(θ), so the angle formed by S(ω,θ) and S(ω,θ+α) is not α.

Rotating the steering vector S(ω,θ+α) 72 about the steering vector S(ω,θ) 71 forms a cone 73 with its apex positioned at the starting point of the steering vector S(ω,θ) 71. Then, whether the observed signal vector X(ω,t) is positioned inside or outside the cone is determined.

FIG. 7 shows examples of observed signal vector X(ω,t):

an observed signal vector X(ω,t) 74 positioned inside the cone, and an observed signal vector X(ω,t) 75 positioned outside the cone.

Similarly, for the steering vector S(ω,θ−α) corresponding to direction θ−α, a cone with its apex positioned at the starting point of the steering vector S(ω,θ) is formed and whether the observed signal vector X(ω,t) is positioned inside or outside the cone is determined.

If X(ω,t) is positioned inside one or both of the cones, the mask value is set to 1. Otherwise, the mask value is set to zero or β which is a positive value close to zero.

The above process is represented by the equations given below.

$$\mathrm{sim}(a, b) = \frac{|a^H b|}{\sqrt{a^H a}\sqrt{b^H b}} \quad [9.1]$$

$$M(\omega, t) = \begin{cases} 1 & \ldots \begin{pmatrix} \mathrm{sim}(X(\omega, t), S(\omega, \theta)) \geq \mathrm{sim}(S(\omega, \theta - \alpha), S(\omega, \theta)) \\ \text{or} \\ \mathrm{sim}(X(\omega, t), S(\omega, \theta)) \geq \mathrm{sim}(S(\omega, \theta + \alpha), S(\omega, \theta)) \end{pmatrix} \\ \beta & \ldots(\text{otherwise}) \end{cases} \quad [9.2]$$

Equation [9.1] is definition of the cosine similarity between two column vectors a and b, meaning that the two vectors are closer to parallel as the value is closer to 1. Using the cosine similarity, the value of the time-frequency mask M(ω,t) is calculated with equation [9.2].

That is, sim(X(ω,t),S(ω,θ))≥sim(S(ω,θ−α),S(ω,θ)) means that X(ω,t) is positioned inside a cone centering on S(ω,θ) formed by rotating S(ω,θ−α).

This corresponds to the observed signal vector X(ω,t) 75 shown in FIG. 7.

Therefore, if at least one of $$\mathrm{sim}(X(\omega,t),S(\omega,\theta))\geq\mathrm{sim}(S(\omega,\theta-\alpha),S(\omega,\theta)) \text{ and}$$

$$\mathrm{sim}(X(\omega,t),S(\omega,\theta))\geq\mathrm{sim}(S(\int,\theta+\alpha),S(\omega,\theta))$$

holds, the observed signal vector X(ω,t) is positioned inside at least one of the two cones.

The mask value is accordingly set to 1. The other cases mean that the observed signal vector X(ω,t) is positioned outside the two cones, so the mask value is set to β.

The value of β varies depending on what are used as the objective function and the auxiliary function. If the objective function and auxiliary function described in equations [8.1] to [8.12] above are used, β may be 0.

If the objective function and auxiliary function of equations [7.1] and [7.2] are used, β is set to a positive value close to 0.

This is aimed at preventing occurrence of a zero division in an equation that uses the inverse of b(t) as weight, e.g., equation [5.11].

That is, if M(ω,t)=0 for all ω, calculating the auxiliary variable b(t) with equations [7.1] and [7.2] results in b(t)=0. Thus, when equation [5.11] is used as the objective function, a zero division occurs in equation [7.6], for example.

While the value of α may be set in any way, an exemplary method is to determine it depending on the step size of null beam scanning in the MUSIC method. By way of example, if the scanning step size used in the MUSIC method is 5 degrees, α is also set to 5 degrees. Alternatively, it may be set to the step size multiplied by a certain value. For example, α is set to 1.5 times the step size, i.e., 7.5.

[6. Differences Between the Sound Source Extraction Process According to an Embodiment of the Present Disclosure and Related-Art Schemes]

This section describes differences between the sound source extraction process performed by the sound signal processing apparatus disclosed herein and related-art processes, including the related art:

(A) Related art 1: Japanese Unexamined Patent Application Publication No. 2012-234150

(B) Related art 2: Paper ["Eigenvector Algorithms with Reference Signals for Frequency Domain BSS", Masanori Ito, Mitsuru Kawamoto, Noboru Ohnishi, and Yujiro Inouye, Proceedings of the 6th International Conference on Independent Component Analysis and Blind Source Separation (ICA2006), pp. 123-131, March 2006.]

[6-1. Difference from Related Art 1 (Japanese Unexamined Patent Application Publication No. 2012-234150)]

Related art 1 (Japanese Unexamined Patent Application Publication No. 2012-234150) discloses a sound source extraction process using reference signal.

A difference from the process according to an embodiment of the present disclosure is whether iteration is included or not. The reference signal used in related art 1 is equivalent to the initial value for the learning in the process according to an embodiment of the present disclosure, namely the initial value of the auxiliary variable b(t).

Estimation of the extracting filter in related art 1 is equivalent to executing equation [5.11] only once using an auxiliary variable serving as such an initial value for the learning.

In the process according to an embodiment of the present disclosure, equation [5.7] is used as the auxiliary function F and the two steps below are alternately repeated as noted above.

(Step S1) Fix U'(1) to U'(Ω) and determine b(1) to b(T) that minimize F.

(step S2) Fix b(1) to b(T) and determine U'(1) to U'(Ω) that minimize F.

As already described with FIG. 4, these steps are equivalent to the following operations.

The first step S1 is equivalent to finding positions at which the objective function G(U') is tangent to the auxiliary function shown in FIG. 4, for example (such as initial set point 45 and corresponding point a 47).

The following step S2 is equivalent to determining the filter values (such as U'fs1 and U'fs2) that correspond to the minimum values of the auxiliary function shown in FIG. 4 (such as minimum values a 46 and b 48).

The processing at step S1 is a process for executing equations [5.9] and [5.10]. Once b(t) is determined for all t in this process, step S2, namely equations [5.12] to [5.15] are executed. When U'(ω) has been determined for all ω, step S1 is executed again. These are repeated until U'(ω) converges (or a predetermined number of times).

The local minimum A shown in FIG. 4 is determined in this manner and the extracting filter U'a optimum for target sound extraction is computed.

Estimation of the extracting filter in related art 1 (Japanese Unexamined Patent Application Publication No. 2012-234150) involves setting the auxiliary variable b(t) which is the initial value for the learning as reference signal and applying equation [5.11], which is the equation for extracting filter computation, only once using the reference signal to compute extracting filter U'.

This is equivalent to determining the extracting filter U'fs1 corresponding to the minimum value a 46 of the auxiliary function fsub1 in FIG. 4.

In the process according to an embodiment of the present disclosure, in contrast, repetitive execution of steps S1 and S2 makes it possible to further approach the local minimum A 42 of the objective function G(U') and compute the optimal extracting filter U'a for target sound extraction.

[6-2. Differences from Related Art 2]

Next, differences from related art 2, namely the paper ["Eigenvector Algorithms with Reference Signals for Frequency Domain BSS", Masanori Ito, Mitsuru Kawamoto, Noboru Ohnishi, and Yujiro Inouye, Proceedings of the 6th International Conference on Independent Component Analysis and Blind Source Separation (ICA2006), pp. 123-131, March 2006.] will be discussed.

The related art 2 discloses a sound source separation process using a reference signal. By preparing an appropriate reference signal and solving the problem of minimizing a measure called 4th-order cross-cumulant between the reference signal and the result of separation, a separating matrix for separating all sound sources can be determined without iterative learning.

A difference between this scheme and the present disclosure lies in the nature of the reference signal (the initial value for the learning herein). Related art 2 rests on the premise that different complex number signals are respectively prepared for frequency bins as reference signals. As mentioned earlier, it is practically difficult to prepare such reference signals, however.

The process according to an embodiment of the present disclosure can determine the initial value for the learning based on extraction results and/or filters that are obtained using a technique such as time-frequency masking which is based on the target sound direction and inter-microphone phase difference, for example.

That is, the extracting filter U's corresponding to the initial set point 45 in FIG. 4 may be obtained with a technique such as time-frequency masking based on the target sound direction and inter-microphone phase difference, and the initial set point 45 may be determined according to the extracting filter U's.

As described, the process according to an embodiment of the present disclosure can reduce the number of iterations before learning convergence by introduction of the auxiliary function method and also can use a rough extraction result produced by other scheme as the initial value for the learning.

[7. Exemplary Configuration of the Sound Signal Processing Apparatus According to an Embodiment of the Present Disclosure]

Now referring to FIG. 8 and subsequent figures, an exemplary configuration of the sound signal processing apparatus according to an embodiment of the present disclosure will be described.

Figure 8:
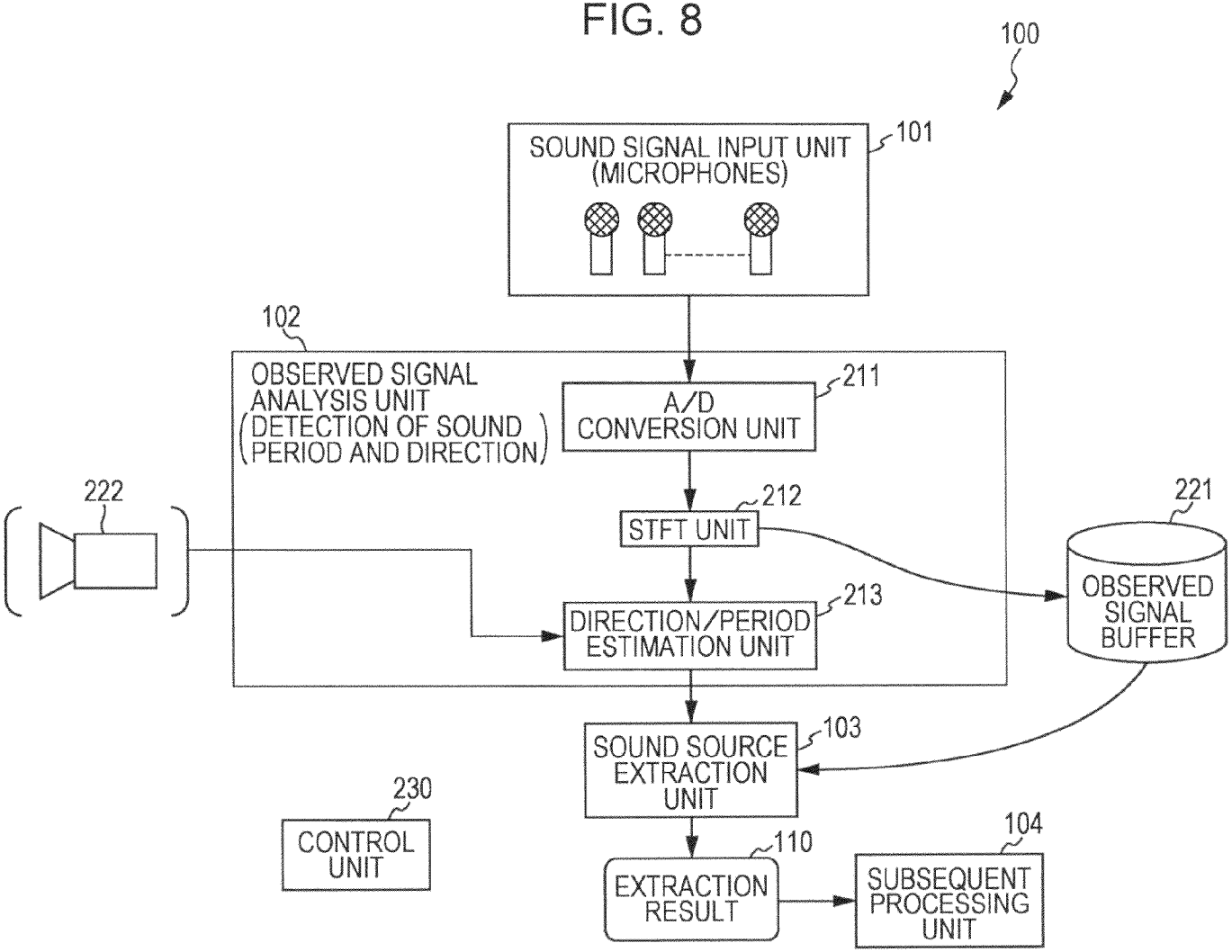
FIG. 8 shows an exemplary configuration of a sound signal processing apparatus.

As shown in FIG. 8, a sound signal processing apparatus 100 according to an embodiment of the present disclosure includes a sound signal input unit 101 formed of multiple microphones, an observed signal analysis unit 102 which receives an input signal (an observed signal) from the sound signal input unit 101 and analyzes the input signal, specifically detects the sound segment and direction of the target sound source to be extracted, for example, and a sound source extraction unit 103 that extracts sound of the target sound source from an observed signal (a mixed signal of multiple sounds) for each sound segment of the target sound detected by the observed signal analysis unit 102. An extraction result 110 for the target sound produced by the sound source extraction unit 103 is output to a subsequent processing unit 104, which performs processing such as speech recognition, for example.

As shown in FIG. 8, the observed signal analysis unit 102 has an A/D conversion unit 211, which A-D converts multichannel sound data collected by a microphone array constituting the sound signal input unit 101. Digital signal data generated in the A/D conversion unit 211 is called a (time-domain) observed signal.

The observed signal, which is digital data generated by the A/D conversion unit 211, undergoes short-time Fourier transform (STFT) in an STFT (short-time Fourier transform) unit 212, so that the observed signal is converted to a time-frequency domain signal. This signal is called time-frequency domain observed signal.

Short-time Fourier transform (STFT) performed in the STFT (short-time Fourier transform) unit 212 is described in detail with reference to FIGS. 9A and 9B.

The observed signal waveform x_k(*) shown in FIG. 9A is the waveform x_k(*) of the observed signal observed by the k-th microphone of a microphone array which includes n microphones provided as the speech input unit 101 in the apparatus shown in FIG. 8, for example.

A window function such as Hanning or Hamming window is applied to frames 301 to 303, which are data of a certain length clipped from the observed signal. The unit of data clipping is called a frame. By applying short-time Fourier transform to one frame of data, spectrum X_k(t) which is frequency-domain data is obtained (t is frame number).

Frames being clipped may overlap like the illustrated frames 301 to 303, which can make the spectra X_k(t−1) to X_k(t+1) of consecutive frames smoothly vary. Spectra arranged by frame number are called a spectrogram. The data shown in FIG. 9B is an example of the spectrogram, which represents observed signals in time-frequency domain.

Spectrum X_k(t) is a vector having the number of elements of Ω, where the ωth element is denoted as X_k(ω,t).

The time-frequency domain observed signal generated at the STFT (short-time Fourier transform) unit 212 through short-time Fourier transform (STFT) is sent to an observed signal buffer 221 and a direction/segment estimation unit 213.

The observed signal buffer 221 accumulates observed signals for a predetermined segment of time (or number of frames). Signals accumulated in the observed signal buffer 221 are used by the sound source extraction unit 103 for producing the result of extraction for speech originating from a certain direction. To the end, observed signals are stored being associated with time (or frame number or the like), so that observed signals corresponding to a certain time (or frame number) can be retrieved later.

The direction/segment estimation unit 213 detects a start time of a sound source (the time at which it started emitting sound) and an end time (the time at which it stopped emitting sound), the direction of arrival for the sound source, and the like. As generally described in BACKGROUND, for estimation of the start/end times and direction, a scheme using a microphone array and a scheme using images are available and both may be used herein.

In a configuration employing the microphone array scheme, start/end times and sound source direction are obtained by receiving output from the STFT unit 212 and performing estimation of the sound source direction such as by the MUSIC method and sound source direction tracking in the direction/segment estimation unit 213. For details of this scheme, see Japanese Unexamined Patent Application Publication No. 2010-121975 and Japanese Unexamined Patent Application Publication No. 2012-150237, for instance. If segment and direction are obtained with a microphone array, an imaging element 222 may be omitted.

In the image-based scheme, a face image of a user who is speaking is captured with the imaging element 222, and the position of the lips in the image and the time at which the lips started moving and the time at which they stopped moving are detected. A value representing the lip position as converted to the direction seen from the microphone is used as the sound source direction, and the times at which the lips started and ended movement are used as the start and end times, respectively. For details of the method, see Japanese Unexamined Patent Application Publication No. 10-51889, for example.

When multiple people are simultaneously speaking, if all the speakers' faces are captured by the imaging element, the segment and direction of each speaker's utterance can be obtained by detecting the lip position and the start/end times for each person's lips in the image.

The sound source extraction unit 103 extracts a particular sound source using observed signals corresponding to an utterance segment and/or a sound source direction. Details will be described later.

Results of sound source extraction are sent as extraction result 110 to the subsequent processing unit 104, which implements a speech recognizer, for example, as appropriate. When combined with a speech recognizer, the sound source extraction unit 103 outputs an extraction result in time domain, that is, a speech waveform, and the speech recognizer of the subsequent processing unit 104 performs a recognition process on the speech waveform.

A speech recognizer as the subsequent processing unit 104 may have a speech segment detection feature, though the feature is optional. Also, while a speech recognizer often includes STFT for extracting speech features necessary for the recognition process from a waveform, STFT on the speech recognition side may be omitted when combined with the configuration disclosed herein. If STFT on the speech recognition side is omitted, the sound source extraction unit outputs a time-frequency domain extraction result, i.e., a spectrogram, which is then converted to speech features on the speech recognition side.

These modules are controlled by a control unit 230.

Next, the sound source extraction unit 103 is described in detail with reference to FIG. 10.

Segment information 401 is output from the direction/segment estimation unit 213 shown in FIG. 8 and this information includes the segment of a sound source emitting sound (i.e., the start and end times), its direction and the like.

An observed signal buffer 402 is the same as the observed signal buffer 221 shown in FIG. 8.

A steering vector generating unit 403 generates a steering vector 404 from the sound source direction included in the segment information 401 using equations [6.1] to [6.3].

A time-frequency mask generating unit 405 uses the start and end times of a sound source, which represent the sound source segment stored as segment information 401, to retrieve observed signals for the segment from the observed signal buffer 402, and generates a time-frequency mask 406 from the sound source segment and steering vector 404 using equations [6.4] to [6.7] or [9.2].

An initial value generating unit 407 uses the start and end times of the sound source stored as the segment information 401 to retrieve observed signals for the segment from the observed signal buffer 402 and calculates an initial value for the learning 408 from the observed signals and the time-frequency mask 406. An initial value for the learning described herein is the initial value of auxiliary variable b(t), which is calculated using equations [6.5] to [6.9] for example.

An extracting filter generating unit 409 generates an extracting filter 410 using the steering vector 404, time-frequency mask 406, and initial value for the learning 408 or the like.

In generation of the extracting filter, processing employing equation [5.11] or [8.9] described earlier is performed.

A filtering unit 411 generates a filtering result 412 by applying the extracting filter 410 to the observed signals for the target segment. The filtering result is the spectrogram of the target sound in time-frequency domain.

A post-processing unit 413 further performs additional sound source extraction on the filtering result 412 and also conducts conversion to a data format appropriate for the subsequent processing unit 104 shown in FIG. 8 as necessary. The subsequent processing unit 104 is a data processing unit implementing speech recognition, for example.

The additional sound source extraction performed at the post-processing unit 413 may be applying the time-frequency mask 406 to the filtering result 412, for example. For data format conversion, processing for converting a time-frequency domain filtering result (a spectrogram) to a time-domain signal (i.e., a waveform) through inverse Fourier transform may be performed, for example. The result of processing is stored as an extraction result 414 in a storage unit and supplied to the subsequent processing unit 104 shown in FIG. 8 as necessary.

Next the extracting filter generating unit 409 is described in detail with reference to FIG. 11.

The extracting filter generating unit 409 generates an extracting filter by use of the segment information 401, observed signal buffer 402, time-frequency mask 406, initial value 408 for the learning, and steering vector 404.

Some data are represented by variables: data stored in the observed signal buffer 402 is represented as the observed signal X(ω,t)(or X(t)), time-frequency mask 406 is represented by M(ω,t), and steering vector 404 is represented by S(ω,θ).

A decorrelation unit 501 retrieves the observed signal X(ω,t)(or X(t)) for a certain target segment from the observed signal buffer 402 based on the sound source segment information indicating the end and start times of the sound from the sound source included in segment information 401, and generates a covariance matrix 502 and a decorrelating matrix 503 for the observed signal with equations [5.16] to [5.19] described above.

The covariance matrix 502 and the decorrelating matrix 503 for the observed signal are indicated as variables in equations as shown below:

the observed signal covariance matrix:

$$\langle X(\omega,t)X(\omega,t)^{H}\rangle_{t}, \text{ and}$$

the observed signal decorrelating matrix: P(ω).

Since the decorrelated observed signal X'(ω,t) can be generated if necessary according to the relation XI(ω,t)=P(ω)X(ω,t) as indicated in equation [4.1] described earlier, no buffer for the decorrelated observed signal X'(ω,t) is provided in the configuration according to an embodiment of the present disclosure.

An iterative learning unit 504 generates an extracting filter using the aforementioned auxiliary function method, as discussed in more detail below. The extracting filter generated here is an un-rescaled extracting filter 505 to which rescaling described below has not been applied yet.

A rescaling unit 506 adjusts the magnitude of the un-rescaled extracting filter 505 so that the extraction result, or the target sound, is of a desired scale. In the adjustment, the covariance matrix 502 and decorrelating matrix 503 for the observed signal, and the steering vector 404 are used.

Next, the iterative learning unit 504 is described in detail with reference to FIG. 12.

Figure 12:
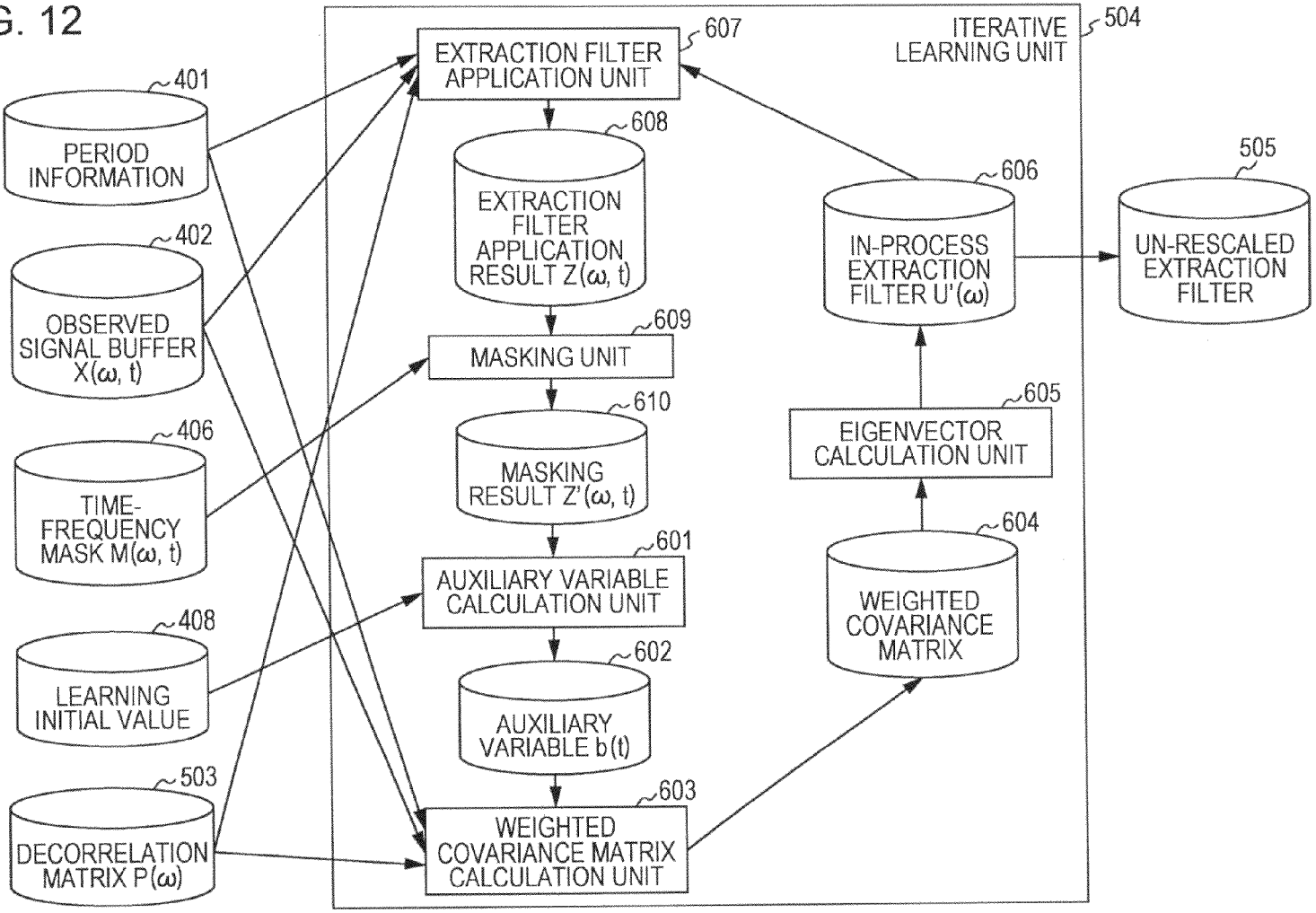
FIG. 12 shows a detailed configuration of an iterative learning unit.

As shown in FIG. 12, the iterative learning unit 504 executes processing with application of the segment information 401, observed signal 402, time-frequency mask 405, initial value for the learning 408, and decorrelating matrix 503 to generate the un-rescaled extracting filter 505.

An auxiliary variable calculation unit 601 calculates the auxiliary variable b(t) from the masking result 610 described later according to equation [7.2] and stores the result as a masking result 610. In the initial calculation only, the value of the initial value for the learning 408 is used as the auxiliary variable b(t) 602.

A weighted covariance matrix calculation unit 603 generates data representing the right-hand side of equation [5.20]

or the right-hand side of equation [8.12] described above using the observed signal for the target segment, the auxiliary variable b(t) 602, and the decorrelating matrix P(ω) 503. The weighted covariance matrix calculation unit 603 generates this data as a weighted covariance matrix 604 and outputs it.

An eigenvector calculation unit 605 determines eigenvalue(s) and eigenvector(s) by applying eigenvalue decomposition to the weighted covariance matrix (12-4) (the right-hand side of equation [5.12] or the right-hand side of equation [8.10]), and further selects an eigenvector based on the eigenvalues. The selected eigenvector is stored as an in-process extracting filter 606 in a storage unit. The in-process extracting filter 606 is denoted as U'(ω) in equations.

An extracting filter application unit 607 applies the in-process extracting filter 606 and the decorrelating matrix 503 to the observed signals of the target segment to generate an extracting filter application result 608.

This process follows the equation [4.14] described earlier.

The extracting filter application result 608 is represented as Z(ω,t) in equations such as shown in equation [4.14].

A masking unit 609 applies the time-frequency mask 406 to the extracting filter application result 608 to generate a masking result 610.

This process corresponds to a process that follows equation [7.1] for example.

The masking result 610 is represented as Z'(ω,t) in equations.

For iterative learning, the masking result 610 is sent to the auxiliary variable calculation unit 601, where it is used for calculation of the auxiliary variable b(t) 602 again.

When the iterative learning 602 conforming to a prescribed algorithm is completed by satisfying a condition such as the number of iterations reaching a preset number of times, the in-process extracting filter 606 that has been generated at the point is output as the un-rescaled extracting filter 505.

The un-rescaled extracting filter 505 is rescaled at the rescaling unit 506 as described with reference to FIG. 11 and output as a rescaled extracting filter 507.

[8. Processing Performed by the Sound Signal Processing Apparatus]

Next, processing performed by the sound signal processing apparatus is described with reference to the flowcharts shown in FIG. 13 and subsequent figures.

[8-1. Overall Sequence of Process Performed by the Sound Signal Processing Apparatus]

Figure 13:
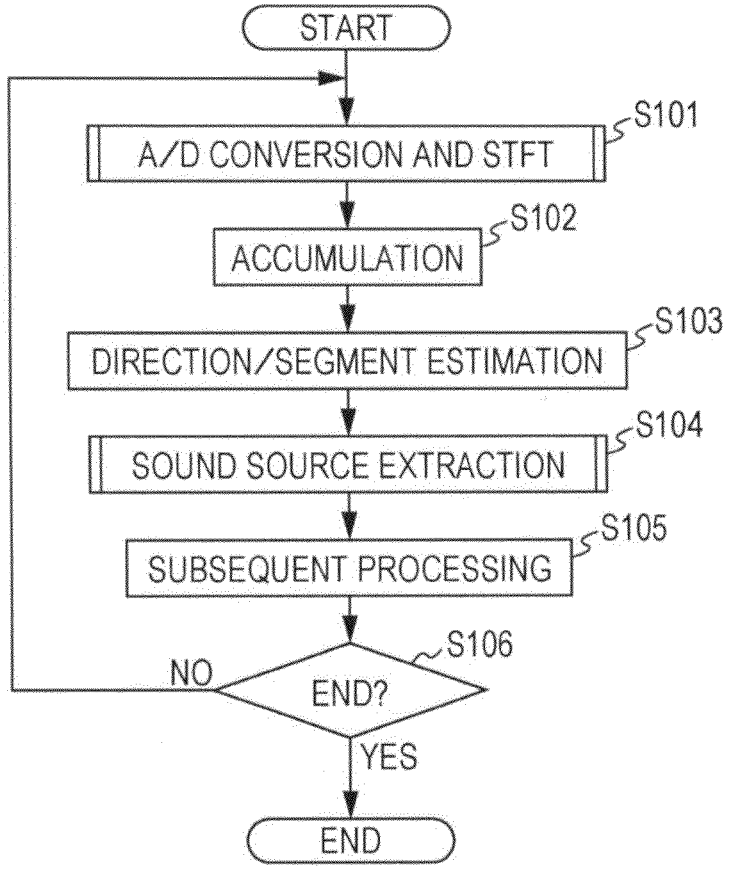
FIG. 13 is a flowchart illustrating a process executed by the sound signal processing apparatus.

First referring to the flowchart of FIG. 13, the overall sequence of the process performed by the sound signal processing apparatus is described.

A/D conversion and STFT at step S101 is a process to convert an analog sound signal which was input to a microphone serving as a sound signal input unit into a digital signal, and further into a time-frequency domain signal (a spectrum) through short-time Fourier transform (STFT). Input may be received from a file or a network as appropriate instead from a microphone. STFT was described above with reference to FIGS. 9A and 9B.

Since there are multiple input channels (as many as microphones) in this embodiment, A/D conversion and STFT are performed as frequently as the number of channels. Hereinafter, the observed signal for channel k, frequency bin ω, and frame t is denoted as X_k(ω,t) (such as in equation [1,1]). Representing the number of STFT points as c, the number of frequency bins Ω per channel can be calculated as Ω=c/2+1.

Accumulation at step S102 is a process to accumulate observed signals converted to time-frequency domain with STFT for a predetermined segment of time (e.g., 10 seconds). In other words, the number of frames equivalent to the time segment is represented as T and observed signals equivalent to T consecutive frames are stored in the observed signal buffer 221 shown in FIG. 8.

The segment and direction estimation at step S103 detects the start time of a sound source (the time at which it started emitting sound) and end time (the time at which it stopped emitting sound), and the direction of arrival for the sound source.

While this process can employ the microphone array-based scheme or the image-based scheme as described above in FIG. 8, both of them can be used herein.

The sound source extraction at step S104 generates (extracts) the target sound corresponding to the segment and direction detected at step S103. Details will be described later.

The subsequent processing at step S105 is a process utilizing the extraction result, e.g., speech recognition.

At the final branch, whether processing is to be continued is decided. If processing is to be continued, the flow returns to step S101. Otherwise, processing is terminated.

[8-2. Detailed Sequence of Sound Source Extraction]

Next, details of the sound source extraction process executed at step S104 is described with reference to the flowchart shown in FIG. 14.

The adjustment of the learning segment at step S201 is a process to calculate an appropriate segment for estimating the extracting filter from the start and end times detected in the segment and direction estimation performed at step S103 of the flow in FIG. 13. This will be described in detail later.

Next, at step S202, a steering vector is generated from the sound source direction of the target sound. The steering vector S(θ,ω) is generated according to equations [6.1] to [6.3] described earlier. The process at step S201 and step S202 does not have to be done in a particular order; either may be performed first or they may take place in parallel.

At step S203, the steering vector generated at step S202 is used to generate a time-frequency mask. The equation for generating a time-frequency mask is equation [6.4] or [9.2].

The time-frequency mask obtained with equation [6.4] is a mask whose value becomes greater (closer to 1) as the observed signal vector becomes closer to the orientation of the steering vector corresponding to direction θ.

The time-frequency mask obtained with equation [9.2] is a mask that only passes the observed signal when the orientation of the observed signal vector is within a predetermined range as described with reference to FIG. 7.

Then, at step S204, extracting filter generation is performed by the auxiliary function method. Details will be described later.

At the stage of step S204, only generation of an extracting filter is performed and no extraction result is generated. At this point, the extracting filter U(ω) has been generated.

Then at step S205, by applying the extracting filter to observed signals corresponding to the segment of the target sound, an extracting filter application result is obtained. Specifically, equation [1.2] is applied for all frames (all t) and for all frequency bins (all ω) relevant to the segment.

After the extracting filter application result has been obtained at step S205, post-processing is further performed at step S206 as necessary. The parentheses shown in the FIG. 14 means that this step is optional. For post-processing, time-frequency masking may be performed again using equation [7.1], for example. Alternatively, conversion to a data format suited for the subsequent processing at step S106 of FIG. 13 may be performed.

Next, details of adjustment to the learning segment at step S201 and the reason to makes such adjustment are described with reference to FIG. 15.

Figure 15:
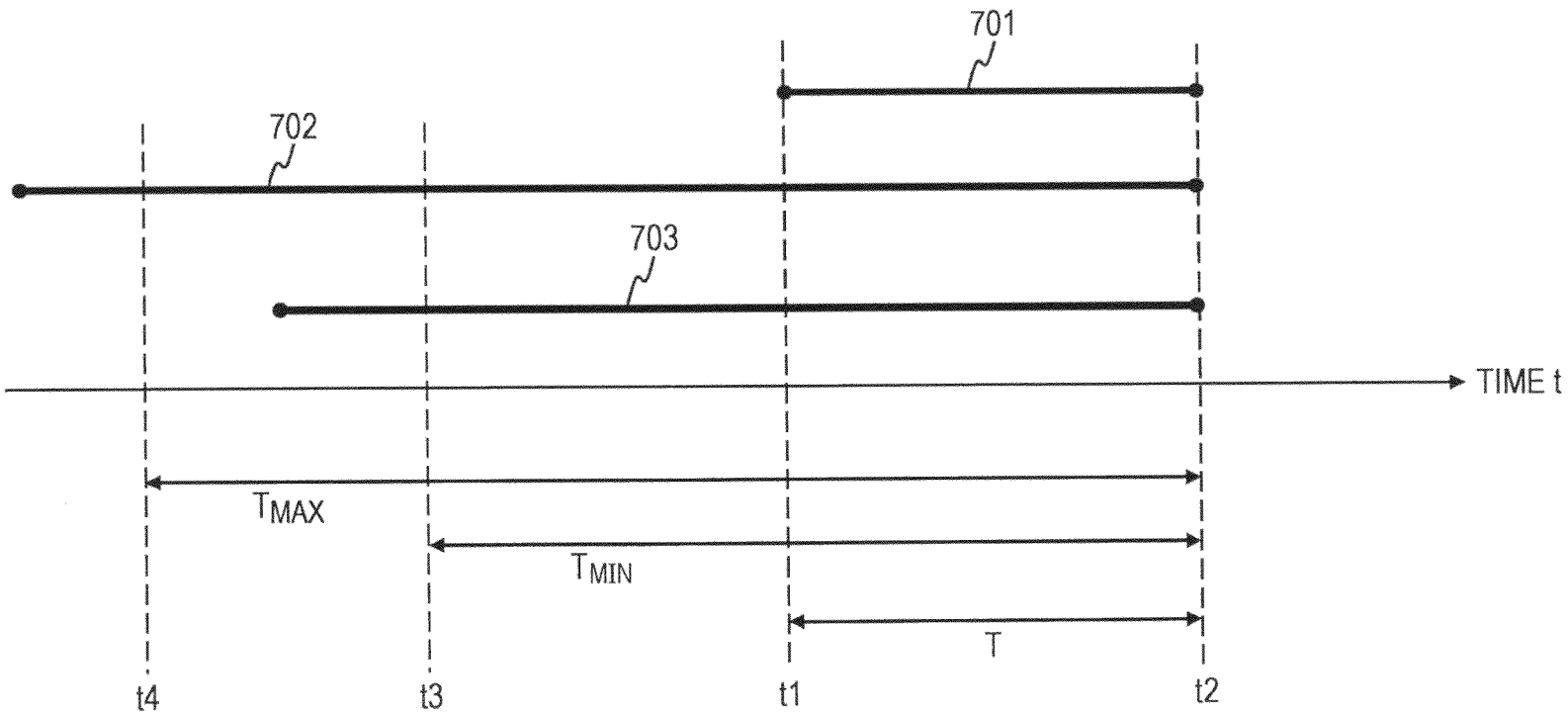
FIG. 15 is a diagram describing details of the segment adjustment performed at step S201 in the flow of FIG. 14 and the reason to make such an adjustment.

FIG. 15 is a conceptual illustration of segments from start of utterance of the target sound to its end, where the horizontal axis represents time (or frame number, which applies hereinafter). The direction/segment estimation unit 213 shown in FIG. 8 detects a segment 701 from the start of utterance of the target sound to its end. The segment 701 is the interval from t1 to t2, t1 being the speech start time and t2 being the speech end time.

The duration of the segment 701 is defined as T as indicated at the bottom of FIG. 15.

The learning segment adjustment carried out at step S201 is a process to determine a segment for use in learning (learning segment) for computing the extracting filter from the segment detected by the direction/segment estimation unit 213.

The learning segment does not have to coincide with the segment of the target sound but a segment different from the target sound segment may be established as the learning segment. That is, observed signals in a learning segment that does not necessarily coincide with the target sound segment are used to compute the extracting filter for extracting the target sound.

The sound source extraction unit 103 has preset shortest segment T_MIN and longest segment T_MAX to be utilized as learning segment.

The sound source extraction unit 103 executes the processing described below upon receiving target sound segment T detected by the direction/segment estimation unit 213.

As shown in FIG. 15, if segment T is shorter than the shortest segment T_MIN, time t3 which is a point in time earlier than the end time t2 of segment T by T_MIN is adopted as the start of the learning segment.

That is, the time segment from t3 to t2 is adopted as the learning segment and learning is conducted using observed signals for this learning segment to generate the extracting filter for the target sound.

If the target sound segment detected by the direction/segment estimation unit 213 is longer than the longest segment T_MAX like a segment 702 shown in FIG. 15, time t4 which is earlier than the end time t2 of the segment 702 by T_MAX is adopted as the start of the learning segment.

If neither is the case, that is, if the target sound segment detected by direction/segment estimation unit 213 falls within the range between the shortest segment T_MIN and the longest segment T_MAX like a segment 703 in FIG. 15, the detected segment is used as the learning segment as it is.

The reason to establish the minimum value for the learning segment is to prevent generation of a low precision extracting filter due to a too small number of learning samples (or frames). The reason to set the maximum value conversely is to keep computational complexity from increasing in generation of the extracting filter.

In the following description on the extracting filter generation at step S204, frame number t corresponding to the learning segment is represented by 1 to T. That is, t=1 represents the first frame of the learning segment and t=T represents the last frame.

[8-3. Detailed Sequence of Extracting Filter Generation]

Next, a detailed sequence of extracting filter generation at step S204 will be described with reference to the flowchart shown in FIG. 16.

Figure 11:
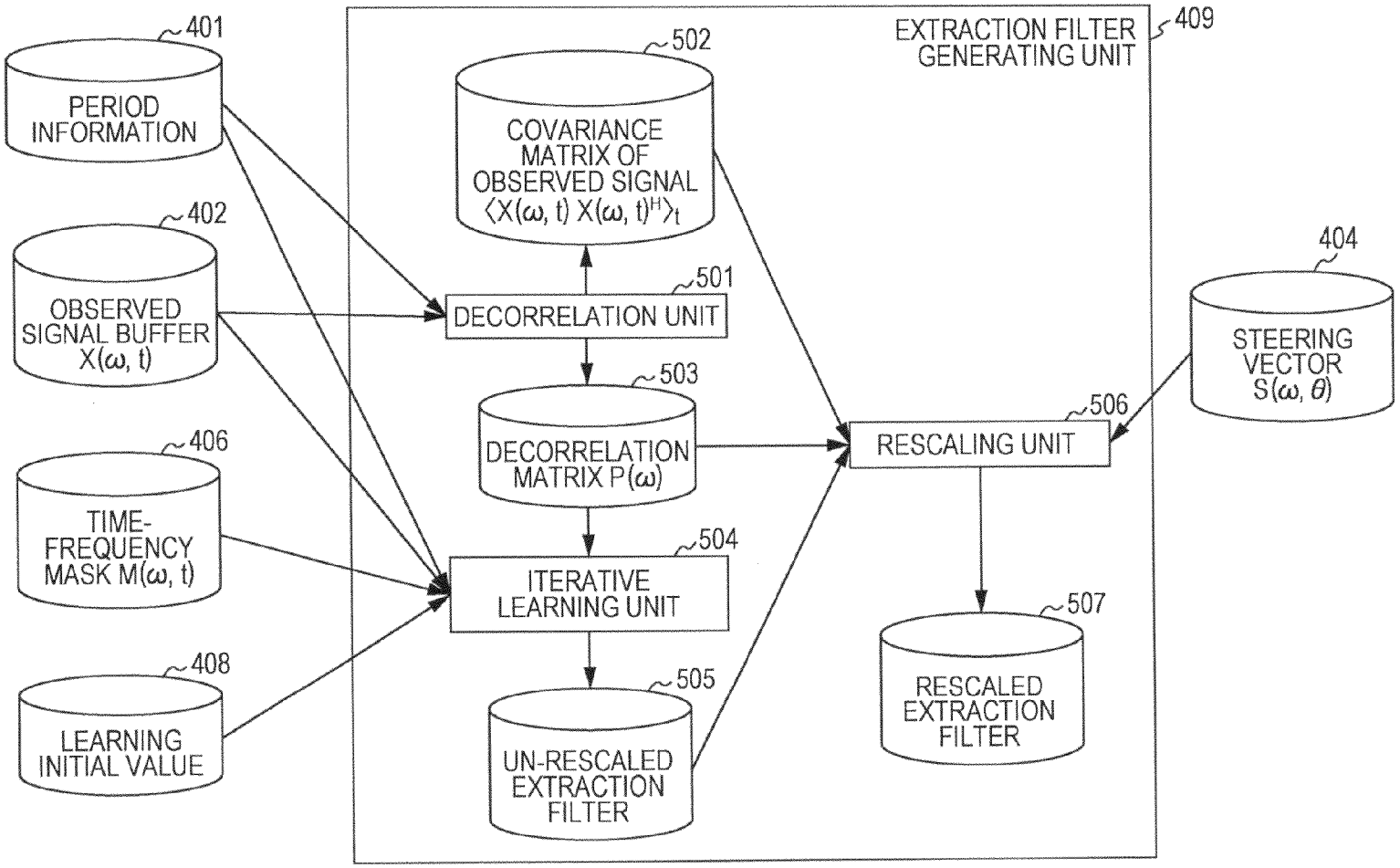
FIG. 11 shows a detailed configuration of an extracting filter generating unit.

Decorrelation at step S301 is a process to calculate the decorrelating matrix 503 shown in FIG. 11. Specifically, equations [5.16] to [5.19] described earlier are calculated for the observed signals in the learning segment determined through the learning segment adjustment at step S201 in the sequence of sound source extraction described with reference to FIG. 14 to compute decorrelating matrix P(ω). Further, an observed signal covariance matrix (the left-hand side of equation [5.16]), which is an intermediate product of this process, is generated.

That is, it is a process in which the decorrelation unit 501 of the extracting filter generating unit 409 shown in FIG. 11 generates the decorrelating matrix P(ω) 503 and the observed signal covariance matrix 502, which is an intermediate product. The decorrelation unit 501 performs processing for all ω at step S301 to generate the decorrelating matrix P(ω) corresponding to all ω and an observed signal covariance matrix as an intermediate product.

In calculation of a covariance matrix on the left-hand side of equation [5.16], an averaging operation is performed for frame number t falling in the learning segment. That is, an averaging operation is performed for t=1 to T.

Steps S302 to S304 are the initial learning and iterative learning for estimating the extracting filter. The initial learning including generation of the initial value for the learning and the like is the process at step S302. This process is executed by the initial value generating unit 407 of FIG. 10 and the iterative learning unit 504 of the extracting filter generating unit 409 in FIG. 11.

The second and subsequent iterative learning is the process from step S303 to S304, which is performed by the iterative learning unit 504 of the extracting filter generating unit 409 of FIG. 11.

Details of the processes will be described later.

The process described in Japanese Unexamined Patent Application Publication No. 2012-234150 is equivalent to a sequence in which only the process of step S302 is executed and thereafter the process of step S305 is executed without conducting the iterative learning at steps S303 and S304.

Step S304 is determination of whether the iterative learning at step S303 has been completed or not. For example, it may be determined according to whether iterative learning has been performed a predetermined number of times. If it is determined that learning has been completed, the flow proceeds to step S305. If learning has not been completed, the flow returns to step S303 to repeat execution of learning.

Rescaling at step S305 is a process to set the scale of the extraction result representing the target sound to a desired scale by adjusting the scale of the extracting filter resulting from iterative learning. This process is executed by the rescaling unit 506 shown in FIG. 11.

The iterative learning at step S303 is performed under the constraints on scale represented by equations [4.18] and [4.19], but they are different from the scale of the target sound. Rescaling is a process to adapt the result of learning to the scale of the target sound.

Rescaling is carried out according to the equations given below.

$$g(\omega)=S(\omega,\theta)^H\langle X(\omega,t)X(\omega,t)^H\rangle_t\{U'(\omega)P(\omega)\}^H \quad [10.1]$$

$$U(\omega)=g(\omega)U'(\omega)P(\omega) \quad [10.2]$$

These are equations for adapting the scale of the target sound contained in the extracting filter application result to the scale of the target sound contained in the result of application of a delay-and-sum array. First, a rescaling factor g(ω) is calculated by equation [10.1]. In this equation, S(ω,t) is the steering vector generated in the steering vector generation at step S204 of the flow shown in FIG. 14.

Figure 10:
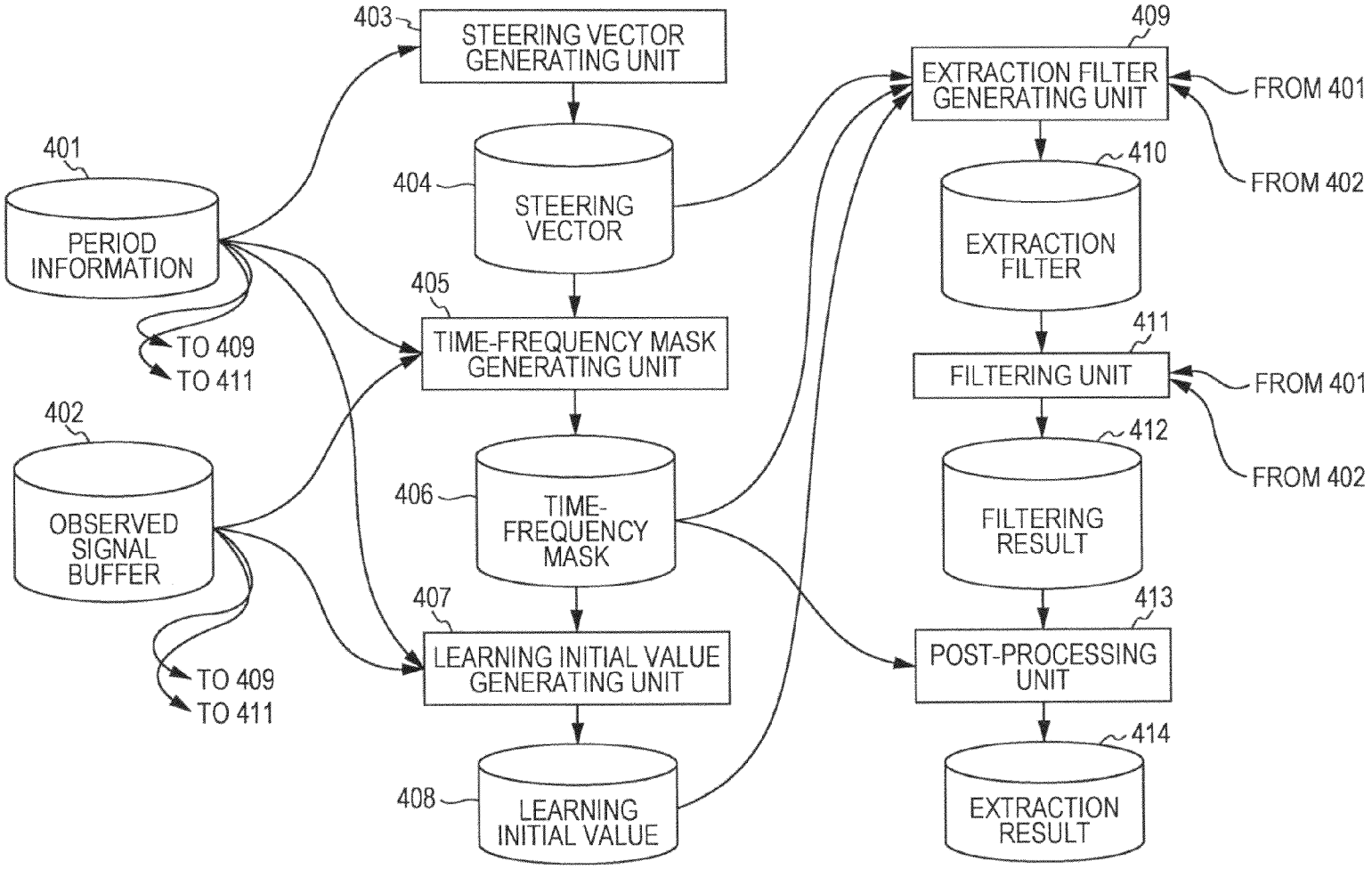
FIG. 10 shows a detailed configuration of a sound source extraction unit.

It is the steering vector 404 generated by the steering vector generating unit 403 shown in FIG. 10.

Figure 16:
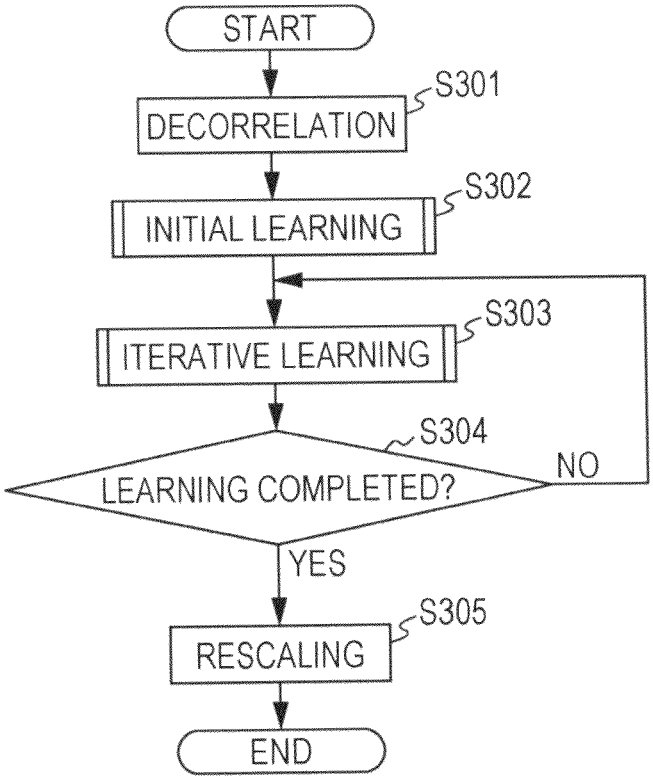
FIG. 16 is a flowchart illustrating the detailed process of the extracting filter generation executed at step S204 in the flow of FIG. 14.

<X(ω,t)X(ω,t)ˆH>_t shown on the right-hand side of equation [10.1] is the observed signal covariance matrix 502 generated by the decorrelation unit 501 shown in FIG. 11 in the decorrelation at step S301 in the flow of FIG. 16.

Similarly, P(ω) is the decorrelating matrix 503 generated by the decorrelation unit 501 shown in FIG. 11 in the decorrelation at step S301 in the flow of FIG. 16.

U'(ω) is the un-rescaled extracting filter 505 shown in FIG. 11 generated in the most recent round of iterative learning (step S303).

By calculation of equation [10.2] for the rescaling factor g(ω) obtained according to equation [10.1], the rescaled extracting filter U(ω) is obtained.

This is the rescaled extracting filter U(ω) 507 shown in FIG. 11.

Since the decorrelating matrix P(ω) is multiplied from the right of the un-rescaled extracting filter U'(ω) on the right-hand side of equation [10.2], the extracting filter U(ω) is able to directly extract the target sound from the observed signal before decorrelation X(ω,t).

In rescaling at step S305, calculations of equations [10.1] to [10.2] are performed for all frequency bins co.

The extracting filter U(ω) thus determined is a filter to generate the extraction result Z(ω,t)(rescaled), which is the target sound, from the observed signal before decorrelation according to equation [1.2] shown above.

[8-4. Detailed Sequence of Initial Learning]

Next, the detailed sequence of the initial learning at step S302 shown in the extracting filter generating flow of FIG. 16 is described with reference to the flowchart shown in FIG. 17.

This process is executed by the initial value generating unit 407 of FIG. 10 and the extracting filter generating unit 409 of FIG. 11.

In generation of the initial value for the learning at step S401, the initial auxiliary variable to be used as the initial value for the learning is calculated. This process is executed by the initial value generating unit 407 of FIG. 10.

Figure 14:
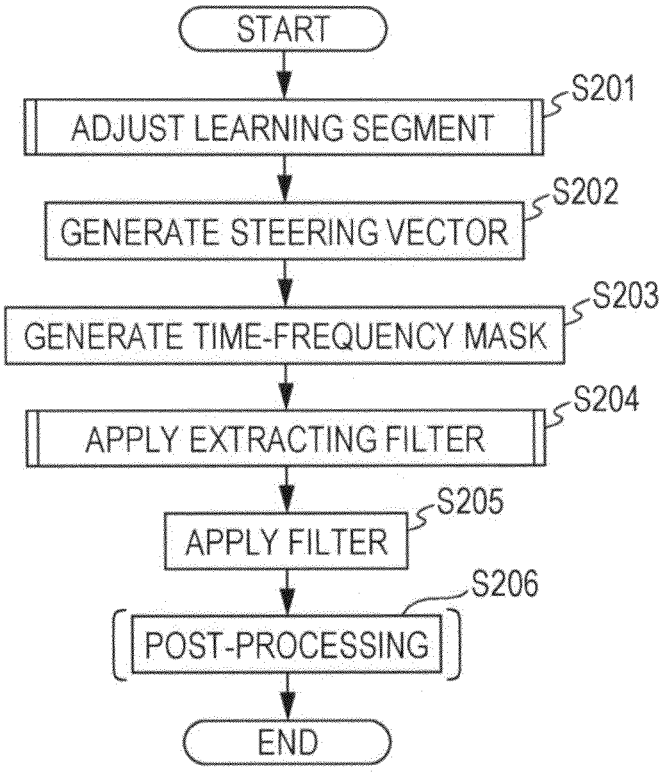
FIG. 14 is a flowchart illustrating the detailed process of the sound source extraction executed at step S104 in the flow of FIG. 13.

The initial value generating unit 407 shown in FIG. 10 calculates the auxiliary variable b(t) by equations [6.5] to [6.9] described earlier, using the time-frequency mask 406 generated by the time-frequency mask generating unit 405 at step S203 in the flow of FIG. 14.

This process is carried out for t=1 (the start of the learning segment) to t=T (the end of the learning segment).

Steps S402 to S406 constitute a loop for frequency bins in the initial learning using the initial value for the learning, where steps S403 to S405 are performed for ω=1 to Ω. This process is executed by the extracting filter generating unit 409.

At step S403, a weighted covariance matrix of the decorrelated observed signal is calculated based on equation [5.20] or [8.12] described earlier.

This process is executed by the weighted covariance matrix calculation unit 603 of the iterative learning unit 504 shown in FIG. 12 for generating the weighted covariance matrix 604 shown in FIG. 12.

In step S404, the eigenvalue decomposition represented by equation [5.12] or [8.10] described above is applied to the weighted covariance matrix determined at step S403. This results in n eigenvalues and eigenvectors respectively corresponding to the eigenvalues.

At step S405, an eigenvector appropriate for the extracting filter is selected from the eigenvectors obtained at step S404. If equation [5.20] is used as the weighted covariance matrix, the eigenvector corresponding to the smallest eigenvalue is selected (equation [5.15]). If equation [8.12] is used as the weighted covariance matrix, the eigenvector corresponding to the largest eigenvalue is selected (equation [8.11]).

The process from steps S404 to S405 is executed by the eigenvector calculation unit 605 shown in FIG. 12.

For finding the eigenvector corresponding to the largest eigenvalue, an efficient algorithm specifically designed for directly determining such an eigenvector is available. Thus, the eigenvector may be determined at step S404 and step S405 may be skipped.

Finally, at step S406, the frequency bin loop is closed.

[8-5. Detailed Sequence of Iterative Learning]

Next, the detailed sequence of the iterative learning at step S303 in the extracting filter generating flow shown in FIG. 16 is described with reference to the flowchart of FIG. 18.

This process is executed by the iterative learning unit 504 shown in FIGS. 11 and 12.

At step S501, the most recently obtained in-process extracting filter U'(ω) is applied to the observed signal to obtain the extracting filter application result Z(ω,t), which is a provisional extraction result during learning. Specifically, the calculation with equation [5.9] described earlier is performed for ω=1 to Ω and t=1 to T.

Then at step S502, a time-frequency mask is applied to the extracting filter application result Z(ω,t) to obtain the masking result Z'(ω,t). That is, calculation of equation [7.1] is performed for ω=1 to Ω and t=1 to T.

Then at step S503, the auxiliary variable b(t) is calculated using equation [7.2] from the masking result Z'(ω,t) determined at step S502. This calculation is performed for t=1 to T.

Figure 17:
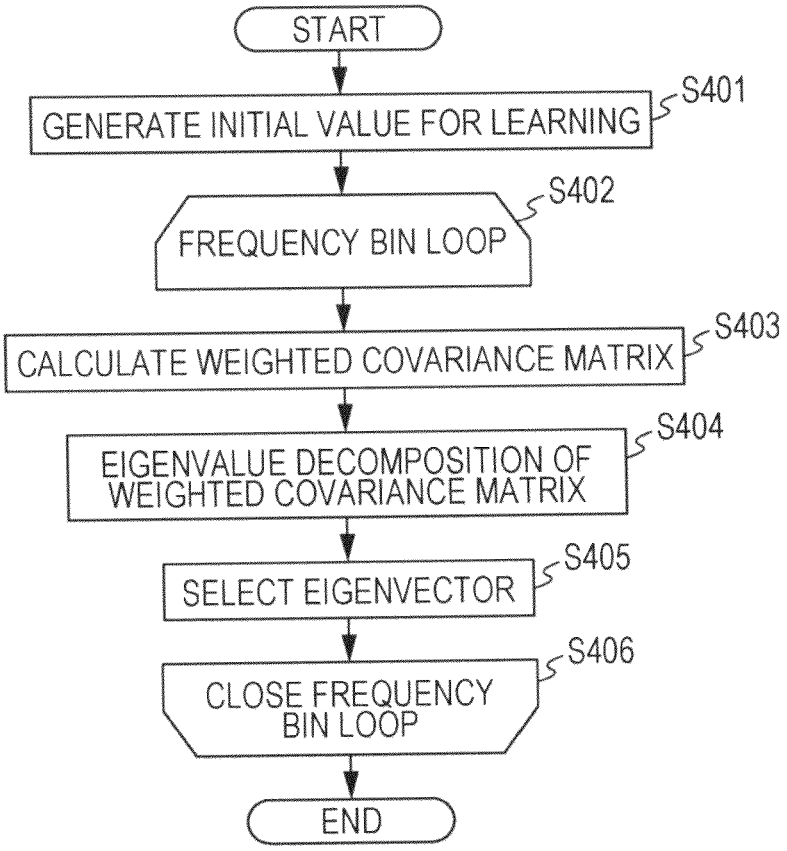
FIG. 17 is a flowchart illustrating the detailed process of the initial learning executed at step S302 in the flow of FIG. 16.

Steps S504 to S508 are the same process as step S402 to S406 in the initial learning flow of FIG. 17 described above.

Descriptions of the iterative learning as well as the whole process are now concluded.

[9. Verification of Effects of the Sound Source Extraction Implemented by the Sound Signal Processing Apparatus According to an Embodiment of the Present Disclosure]

Next, the effects of the sound source extraction implemented by the sound signal processing apparatus according to an embodiment of the present disclosure will be demonstrated.

For assessing the difference from the process described in Japanese Unexamined Patent Application Publication No. 2012-234150 as related art, an experiment to compare the precision of sound source extraction was conducted. The contents and results of the experiment are shown hereafter.

Figure 19:
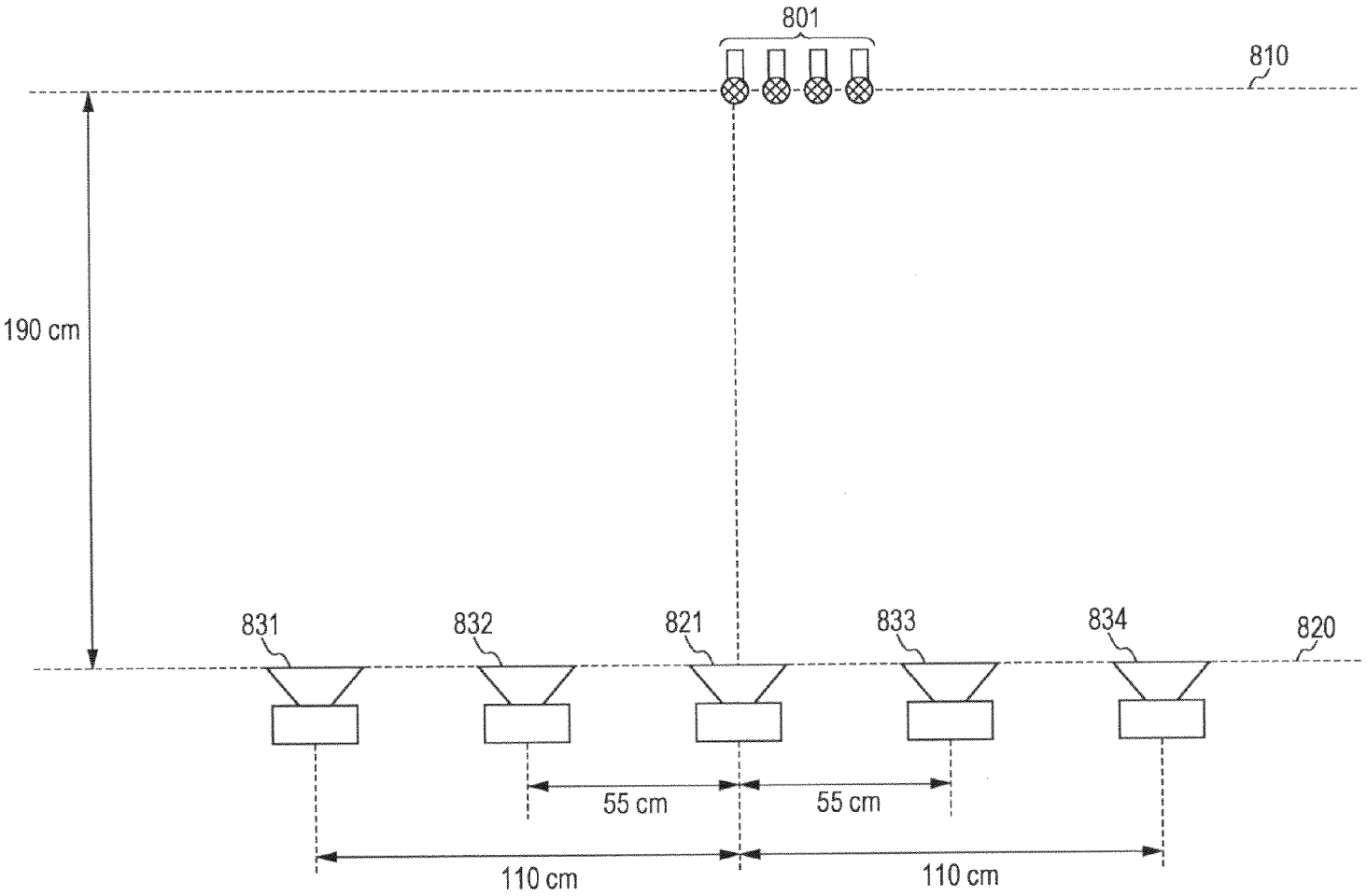
FIG. 19 illustrates the recording environment in which an assessment experiment was conducted for verifying the effects of sound source extraction according to an embodiment of the present disclosure.

Sound data used for assessment was recorded in the environment illustrated in FIG. 19.

A microphone array 801 was installed along a straight line 810. The interval between microphones is 2 cm.

On a straight line 820 at a distance of 190 cm from the straight line 810, five loud speakers were arranged. A loud speaker 821 is positioned almost opposite the microphone array 801.

Loud speakers 831, 832 were placed at the distances of 110 cm and 55 cm from the loud speaker 821 respectively on the left side of the loud speaker 821. Loud speakers 833, 834 were placed at the distances of 55 cm and 110 cm from the loud speaker 821 respectively on the right side of the loud speaker 821.

The loud speakers independently emitted sound, which was recorded with the microphone array 801 at a sampling frequency of 16 kHz.

The loud speaker 821 emitted only the target sound. Fifteen utterances given by each one of three persons were previously recorded and the 45 utterances were output from this loud speaker in sequence. Accordingly, the segment during which the target sound is being emitted is the segment during which speech is being uttered and the number of the utterances is 45.

Loud speakers 831 to 834 are loud speakers for solely emitting interfering sound and they emitted one of two kinds of sound: music and street noise.

Interfering Sound 1: Music

Music file "beet9.wav" available at the URL:

http://sound.media.mit.edu/ica-bench/sources/.

Interfering Sound 2: Street Noise

Noise file "street.wav" available at the URL:

http://sound.media.mit.edu/ica-bench/sources/.

For description about audio data provided at the URLs, see the URL, http://sound.media.mit.edu/ica-bench/.

In the experiment, separately recorded sounds were mixed in a computer. Mixing was done on one target sound and one interfering sound. The target sound and the interfering sound were mixed at three power ratios, −6 dB, 0 dB, and +6 dB. These power ratios will be called signal-to-interference ratio (SIR) (of the observed signal).

By mixing, 45 (the number of utterances)×4 (the number of interfering sound positions)×2 (the number of interfering sounds)×3 (the number of mixing ratios)=1,080 pieces of assessment data were generated.

For each one of the 1,080 combinations, sound source extraction was carried out in accordance with the process disclosed herein and the process described in Japanese Unexamined Patent Application Publication No. 2012-234150 as related art.

The following parameters were common in all settings:

sampling frequency: 16 kHz

STFT window length: 512 points

STFT shift width: 128 points

θ of target sound direction: 0 radian mask generation: used equation [6.4]

generation of initial value for the learning: used equation [6.9], where L=20, and post-processing (step S206): only conversion from a spectrogram to a waveform.

The following five schemes (1) to (5) were carried out as sound source extraction schemes and compared.

(1) Related-Art Method 1: A Scheme Corresponding to Japanese Unexamined Patent Application Publication No. 2012-234150 (a First Method)

A sound source extraction process that applies an extracting filter computed by executing equation [5.11] only once using b(t) computed with equation [6.9] as the initial value for the learning.

The related-art method 1 is a process that uses the amount of Kullback-Leibler information (the KL information) which is equivalent to the objective function G(U') shown in FIG. 4 as the measure of independence, and executes the initial learning in the extracting filter generating flow (step S302) of FIG. 16 but not the iterative learning (step S303).

(2) Related-Art Method 2: A Scheme Corresponding to Japanese Unexamined Patent Application Publication No. 2012-234150 (a Second Method)

A sound source extraction process which applies an extracting filter computed by executing equation [8.9] only once using b(t) computed with equation [6.9] as the initial value for the learning.

The related-art method 2 is a process that uses the kurtosis of the temporal envelope of the extraction result Z, which is equivalent to the objective function G(U') shown in FIG. 6, as the measure of independence, and executes the initial learning (step S302) in the extracting filter generating flow of FIG. 16 but not the iterative learning (step S303).

(3) Proposed Method 1 (Process 1 According to an Embodiment of the Present Disclosure)

Basically, it performs the extracting filter generation following the flow of FIG. 16.

The initial learning at step S302 of the flow in FIG. 16 was performed in accordance with the flow of FIG. 17.

Figure 18:
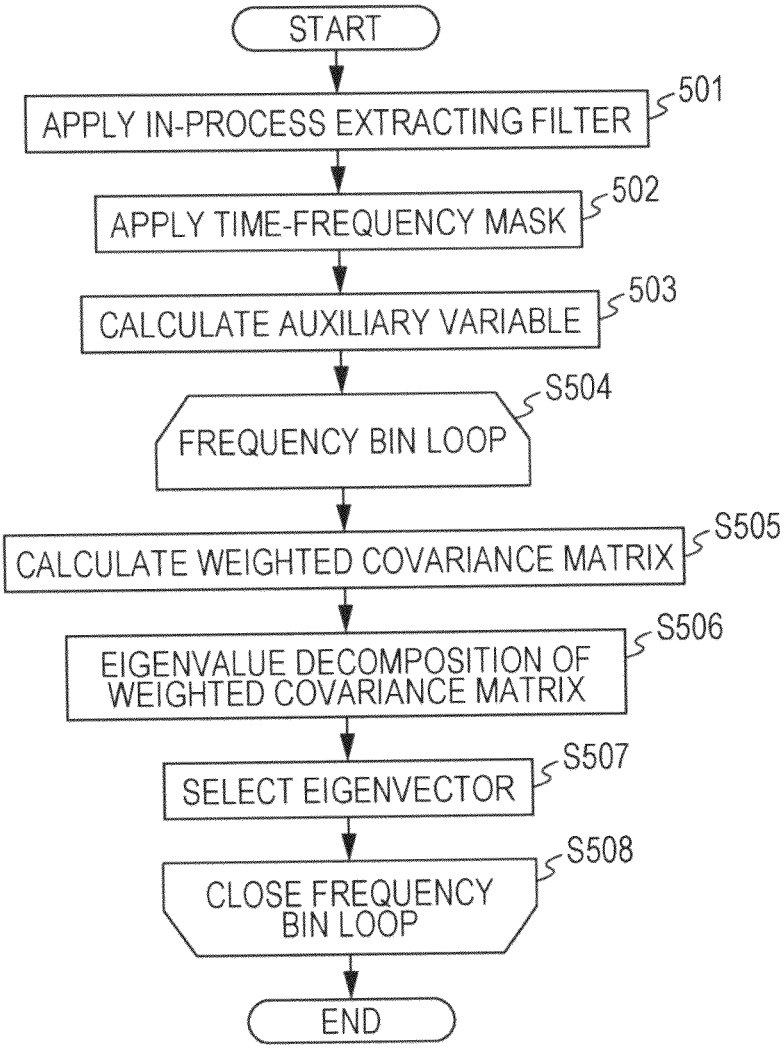
FIG. 18 is a flowchart illustrating the detailed process of the iterative learning executed at step S303 in the flow of FIG. 16.

In the iterative learning at step S303 of the flow in FIG. 16, however, the processing at step S502 in the flow of FIG. 18, namely time-frequency masking in the course of learning was omitted.

That is, equation [5.11] was executed once as the initial learning using b(t) calculated with equation [6.9] as the initial value for the learning and computation of the auxiliary variable b(t) according to equations [5.9], [5.10] and computation of the extracting filter U'(ω) according to equation [5.11] were repeatedly executed as iterative learning.

This process uses the amount of Kullback-Leibler information (the KL information) as the measure of independence and employs the objective function G(U') described with reference to FIG. 4, namely equation [4.20].

(4) Proposed Method 2 (Process 2 According to an Embodiment of the Present Disclosure)

Basically, generation of the extracting filter following the flow of FIG. 16 is implemented.

The initial learning at step S302 of the flow in FIG. 16 was performed in accordance with the flow of FIG. 17.

The iterative learning at step S303 in the flow of FIG. 16 was also performed in accordance with the flow of FIG. 18. The processing at step S502, namely time-frequency masking in the course of learning was also executed.

That is, equation [5.11] was executed once as the initial learning using b(t) calculated with equation [6.9] as the initial value for the learning and further, computation of the auxiliary variable b(t) with application of time-frequency masking during learning according to equations [5.9], [7.1], and [7.2] and computation of the extracting filter U'(ω) according to equation [5.11] were repeatedly executed as iterative learning. In equation [7.1], J was set to 20.

This process also uses the amount of Kullback-Leibler information (the KL information) as the measure of independence and employs the objective function G(U') described with reference to FIG. 4, namely equation [4.20].

(5) Proposed Method 3 (Process 3 According to an Embodiment of the Present Disclosure)

Basically, generation of the extracting filter following the flow of FIG. 16 is implemented.

The initial learning at step S302 of the flow in FIG. 16 was performed in accordance with the flow of FIG. 17.

The iterative learning at step S303 in the flow of FIG. 16 was also performed in accordance with the flow of FIG. 18. The processing at step S502, namely time-frequency masking during learning was also executed.

That is, equation [5.11] was executed once as the initial learning using b(t) calculated with equation [6.9] as the initial value for the learning and further, computation of the auxiliary variable b(t) with application of time-frequency masking during learning according to equations [5.9], [7.1], and [7.2] and computation of the extracting filter U'(ω) according to equation [8.10] were repeatedly executed as iterative learning. In equation [7.1], J was set to 20.

This process uses the kurtosis of the temporal envelope of extraction result Z as the measure of independence and employs the objective function G(U') described with reference to FIG. 6, namely equation [8.5].

The number of iterations in the schemes according to an embodiment of the present disclosure, (3) proposed method 3 to (5) proposed method 5, that is, the number of times the iterative learning at step S303 in the extracting filter generating flow of FIG. 16 is repeated was set to the following numbers:

(3) proposed method 1 (Process 1 according to an embodiment of the present disclosure): 1, 2, 5, and 10

(4) proposed method 2 (Process 2 according to an embodiment of the present disclosure): 1, 2, 5, and 10

(5) proposed method 3 (Process 3 according to an embodiment of the present disclosure): 1, 2, and 5

When each of the number of iterations was completed, the waveform of the extraction result was generated, and a measure called SIR mentioned above was calculated for the waveform, and also how much the SIR was improved compared to the observed signal was calculated.

By way of example, given that the SIR of the observed signal is +6 dB and the SIR of the extraction result is 20 dB, the degree of improvement is 20−6=12 dB.

Averaging the SIR improvement across the 1,080 pieces of assessment data for each scheme yielded the results shown in the table of FIG. 20. In the table, numerical values are represented in decibel (dB).

Figure 21:
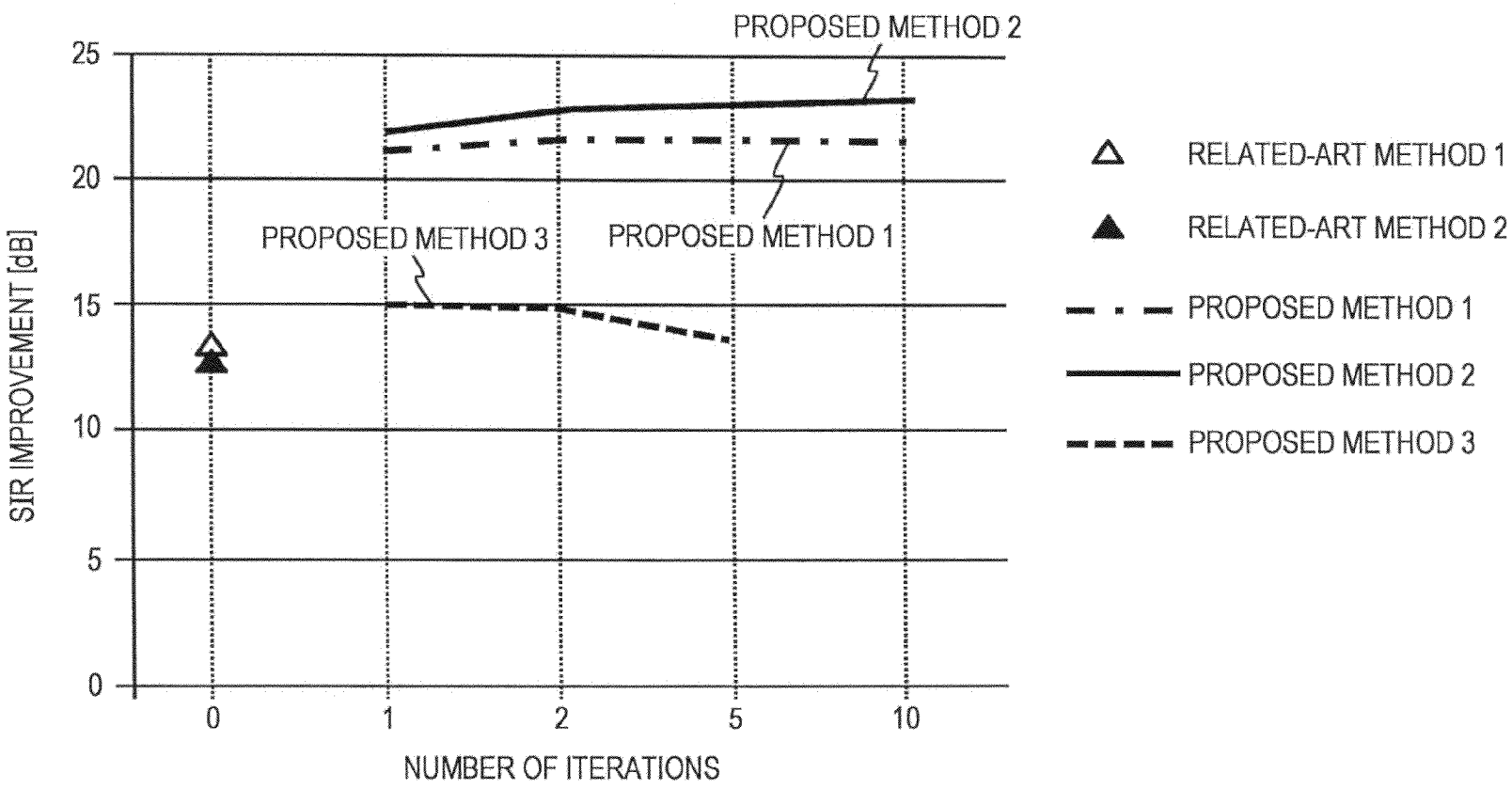
FIG. 21 is a diagram showing SIR improvement data for the sound source extraction implemented according to an embodiment of the present disclosure and related-art schemes.

A graph showing the number of times learning was repeated on the horizontal axis and SIR on the vertical axis for the related-art methods 1 to 2 and proposed methods 1 to 3 is shown in FIG. 21.

As mentioned above, related-art methods 1 to 2 execute only the initial learning step S302 in the extracting filter generating flow shown in FIG. 16 and do not execute the iterative learning at step S303, thus the number of iteration being 0. For the proposed methods 1 to 3, data for the following iteration number settings were obtained.

Proposed method 1 (process 1 according to an embodiment of the present disclosure): 1, 2, 5, and 10

Proposed method 2 (process 2 according to an embodiment of the present disclosure): 1, 2, 5, and 10

Proposed method 3 (process 3 according to an embodiment of the present disclosure): 1, 2, and 5.

The plot for the proposed method 1 (process 1 according to an embodiment of the present disclosure) indicates that the degree of SIR improvement, namely accuracy of extraction increases (13.42 dB→21.11 dB) even with a single iteration compared to the related-art method 1 with 0 iteration, and that convergence is almost reached on the second and subsequent iterations.

Next, the proposed method 1 is compared to the proposed method 2. They are different in whether time-frequency mask is applied in iterative learning or not. In the stage of auxiliary function calculation in iterative learning, proposed method 1 directly calculates the auxiliary variable b(t) from the extracting filter application result $Z(\omega,t)$ using equation [5.10]. That is, it does not apply a time-frequency mask. Proposed method 2 applies time-frequency mask $M(\omega,t)$ to the extracting filter application result $Z(\omega,t)$ to once generate the masking result $Z'(\omega,t)$ (equation [7.1]), and then uses equation [7.2] to calculate the auxiliary variable b(t) from the masking result $Z'(\omega,t)$.

As can be seen from the result of the proposed method 2, at the point of the first iteration, an improvement in SIR comparable to that with the proposed method 1 at the time of convergence (the second and subsequent iterations) has been achieved. As the number of iterations increases, convergence is almost reached on the fifth and subsequent iterations, and the SIR improvement at that point is higher than the proposed method 1 by about 1.5 dB. This implies that application of time-frequency mask in iterative learning also has the effect of increasing the accuracy of extraction gained at the time of convergence in addition to speeding up convergence.

Next, the proposed method 3 is compared to the related-art method 2 (zero iteration). While both use the auxiliary function of equation [8.7], the proposed method 3 includes iterative learning as well as application of time-frequency mask during the iterative learning unlike related-art method 2. A trend exhibited by proposed method 3 was that improvement in SIR reached the peak with one or two iterations and instead degraded as the number of iterations was further increased. Its peak value is lower than the values of proposed methods 1 and 2 at the time of convergence. However, the improvement in SIR is higher than related-art method 2 owing to iteration.

The sound source extraction process implemented by the sound signal processing apparatus according to an embodiment of the present disclosure has the following effects, for example.

In sound source extraction using an auxiliary function, accurate sound source extraction results are obtained by calculating the auxiliary variable using time-frequency masking and further implementing iteration.

In iterative learning, calculation of the auxiliary variable using time-frequency masking gives faster convergence and further increased accuracy of sound source extraction results.

The process according to an embodiment of the present disclosure further enhances the following effect, which is provided by the configuration disclosed in Japanese Unexamined Patent Application Publication No. 2012-234150.

With the process according to an embodiment of the present disclosure, the target sound can be extracted with high accuracy even when the estimated sound source direction of the target sound contains an error. Specifically, by use of time-frequency masking based on phase difference, the temporal envelope of the target sound is generated with high accuracy even with an error in the target sound direction, and the temporal envelope is used as the initial value for the learning in sound source extraction to extract the target sound with high accuracy.

In comparison with existing sound source extraction techniques other than the configuration described in Japanese Unexamined Patent Application Publication No. 2012-234150, the process according to an embodiment of the present disclosure has advantages including:

(a) Compared with minimum variance beam former and Griffith-Jim beam former, it is less susceptible to an error in the target sound direction. That is, since the process according to an embodiment of the present disclosure executes learning using a temporal envelope approximately the same as that of the target sound, the extracting filter resulting from the learning is also resistant to direction errors even if the initially determined direction of the target sound has an error.

(b) Compared with independent component analysis in batch processing form, due to single channel output, calculation and/or memory for generating signals other than the target sound can be saved and also the problem of selecting a wrong output channel is avoided.

(c) Compared with time-frequency masking, since the extracting filter obtained in the process according to an embodiment of the present disclosure is a linear filter, musical noise is suppressed.

Further, combining the present disclosure with a speech segment detector that supports multiple sound sources and has sound source direction estimation feature and with a speech recognizer improves recognition accuracy in the presence of noise or multiple sound sources. In an environment where speech and noise temporally overlap or multiple people are simultaneously speaking, the individual sound sources can be accurately extracted if the sound sources are positioned in different directions, which in turn improves the accuracy of speech recognition.

[10. Summary of the Configuration According to an Embodiment of the Present Disclosure]

While embodiments of the present disclosure have been described in detail with reference to specific examples thereof, it will be appreciated that a person skilled in the art may make modifications or substitutions of the embodiments without departing from the scope and spirit of the present disclosure. That is, the present disclosure has been presented by way of illustration and is not to be construed as limitative. For determining the scope of the present disclosure, reference is to be made to Claims.

The techniques disclosed herein can take the following configurations.

(1) A sound signal processing apparatus including:

an observed signal analysis unit that receives as an observed signal a sound signal for a plurality of channels obtained by a sound signal input unit formed of a plurality of microphones placed at different positions and estimates a sound direction and a sound segment of a target sound which is sound to be extracted; and a sound source extraction unit that receives the sound direction and sound segment of the target sound estimated by the observed signal analysis unit and extracts the sound signal for the target sound, wherein the observed signal analysis unit includes a short time Fourier transform unit that generates an observed signal in time-frequency domain by applying short time Fourier transform to the sound signal for the plurality of channels received; and a direction/segment estimation unit that receives the observed signal generated by the short time Fourier transform unit and detects the sound direction and sound segment of the target sound, and wherein the sound source extraction unit executes iterative learning in which an extracting filter U' is iteratively updated using a result of application of the extracting filter to the observed signal, prepares, as a function to be applied in the iterative learning, an objective function G(U') that assumes a local minimum or a local maximum when a value of the extracting filter U' is a value optimal for extraction of the target sound, and computes a value of the extracting filter U' which is in a neighborhood of a local minimum or a local maximum of the objective function G(U') using an auxiliary function method during the iterative learning, and applies the computed extracting filter to extract the sound signal for the target sound.

(2) The sound signal processing apparatus according to (1), wherein the sound source extraction unit computes a temporal envelope which is an outline of a sound volume of the target sound in time direction based on the sound direction and the sound segment of the target sound received from the direction/segment estimation unit and substitutes the computed temporal envelope value for each frame t into an auxiliary variable b(t), prepares an auxiliary function F that takes the auxiliary variable b(t) and an extracting filter U'(ω) for each frequency bin (ω) as arguments, executes an iterative learning process in which (1) extracting filter computation for computing the extracting filter U'(ω) that minimizes the auxiliary function F while fixing the auxiliary variable b(t), and (2) auxiliary variable computation for computing the auxiliary variable b(t) based on Z(ω,t) which is the result of application of the extracting filter U'(ω) to the observed signal are repeated to sequentially update the extracting filter U'(ω), and applies the updated extracting filter to extract the sound signal for the target sound.

(3) The sound signal processing apparatus according to (1), wherein the sound source extraction unit computes a temporal envelope which is an outline of the sound volume of the target sound in time direction based on the sound direction and sound segment of the target sound received from the direction/segment estimation unit, substitutes the computed temporal envelope value for each frame t into the auxiliary variable b(t), prepares an auxiliary function F that takes the auxiliary variable b(t) and the extracting filter U'(ω) for each frequency bin (ω) as arguments, executes an iterative learning process in which (1) extracting filter computation for computing the extracting filter U'(ω) that maximizes the auxiliary function F while fixing the auxiliary variable b(t), and (2) auxiliary variable computation for computing the auxiliary variable b(t) based on Z(ω,t) which is the result of application of the extracting filter U' (ω) to the observed signal are repeated to sequentially update the extracting filter U'(ω), and applies the updated extracting filter to the observed signal to extract the sound signal for the target sound.

(4) The sound signal processing apparatus according to (2) or (3), wherein the sound source extraction unit performs, in the auxiliary variable computation, processing for generating Z(ω,t) which is the result of application of the extracting filter U'(ω) to the observed signal, calculating an L-2 norm of a vector [Z(1,t), . . . , Z(Ω,t)] (Ω being a number of frequency bins) which represents a spectrum of the result of application for each frame t, and substituting the L-2 norm value to the auxiliary variable b(t).

(5) The sound signal processing apparatus according to (2) or (3), wherein the sound source extraction unit performs, in the auxiliary variable computation, processing for further applying a time-frequency mask that attenuates sounds from directions off the sound source direction of the target sound to Z(ω,t) which is the result of application of the extracting filter U'(ω) to the observed signal to generate a masking result Q(ω,t), calculating for each frame t the L-2 norm of the vector [Q(1,t), . . . , Q(Ω, t)] representing the spectrum of the generated masking result, and substituting the L-2 norm value to the auxiliary variable b(t).

(6) The sound signal processing apparatus according to any one of (1) to (5), wherein the sound source extraction unit generates a steering vector containing information on phase difference among the plurality of microphones that collect the target sound, based on sound source direction information for the target sound, generates a time-frequency mask that attenuates sounds from directions off the sound source direction of the target sound based on an observed signal containing interfering sound which is a signal other than the target sound and on the steering vector, applies the time-frequency mask to observed signals in a predetermined segment to generate a masking result, and generates an initial value of the auxiliary variable based on the masking result.

(7) The sound signal processing apparatus according to any one of (1) to (5), wherein the sound source extraction unit generates a steering vector containing information on phase difference among the plurality of microphones that collect the target sound, based on sound source direction information for the target sound, generates a time-frequency mask that attenuates sounds from directions off the sound source direction of the target sound based on an observed signal containing interfering sound which is a signal other than the target sound and on the steering vector, and generates the initial value of the auxiliary variable based on the time-frequency mask.

(8) The sound signal processing apparatus according to any one of (1) to (7), wherein the sound source extraction unit, if a length of the sound segment of the target sound detected by the observed signal analysis unit is shorter than a prescribed minimum segment length T_MIN, selects a point in time earlier than an end of the sound segment by the minimum segment length T_MIN as a start position of the observed signal to be used in the iterative learning, and if the length of the sound segment of the target sound is longer than a prescribed maximum segment length T_MAX, selects the point in time earlier than the end of the sound segment by the maximum segment length T_MAX as the start position of the observed signal to be used in the iterative learning, and if the length of the sound segment of the target sound detected by the observed signal analysis unit falls within a range between the prescribed minimum segment length T_MIN and the prescribed maximum segment length T_MAX, uses the sound segment as the sound segment of the observed signal to be used in the iterative learning.

(9) The sound signal processing apparatus according to any one of (1) to (8), wherein the sound source extraction unit calculates a weighted covariance matrix from the auxiliary variable b(t) and a decorrelated observed signal, applies eigenvalue decomposition to the weighted covariance matrix to compute eigenvalue(s) and eigenvector(s), and sets an eigenvector selected based on the eigenvalue(s) as an in-process extracting filter to be used in the iterative learning.

(10) A sound signal processing method for execution in a sound signal processing apparatus, the method including:

performing, at an observed signal analysis unit, an observed signal analysis process in which a sound signal for a plurality of channels obtained by a sound signal input unit formed of a plurality of microphones placed at different positions is received as an observed signal and a sound direction and a sound segment of a target sound which is sound to be extracted are estimated; and performing, at a sound source extraction unit, a sound source extraction process in which the sound direction and sound segment of the target sound estimated by the observed signal analysis unit are received and the sound signal for the target sound is extracted, wherein the observed signal analysis process includes executing a short time Fourier transform process for generating an observed signal in time-frequency domain by applying short time Fourier transform to the sound signal for the plurality of channels received; and executing a direction and segment estimation process for receiving the observed signal generated in the short time Fourier transform process and detecting the sound direction and sound segment of the target sound, and wherein the sound source extraction process includes executing iterative learning in which an extracting filter U' is iteratively updated using a result of application of the extracting filter to the observed signal, generating, as a function to be applied in the iterative learning, an objective function G(U') that assumes a local minimum or a local maximum when a value of the extracting filter U' is a value optimal for extraction of the target sound, and computing a value of the extracting filter U' which is in a neighborhood of a local minimum or a local maximum of the objective function G(U') using an auxiliary function method during the iterative learning, and applying the computed extracting filter to extract the sound signal for the target sound.

(11) A program for causing a sound signal processing apparatus to execute sound signal processing, the program including:

causing an observed signal analysis unit to perform an observed signal analysis process for receiving as an observed signal a sound signal for a plurality of channels obtained by a sound signal input unit formed of a plurality of microphones placed at different positions and estimating a sound direction and a sound segment of a target sound which is sound to be extracted; and causing a sound source extraction unit to perform a sound source extraction process for receiving the sound direction and sound segment of the target sound estimated by the observed signal analysis unit and extracting the sound signal for the target sound, wherein the observed signal analysis process includes executing a short time Fourier transform process for generating an observed signal in time-frequency domain by applying short time Fourier transform to the sound signal for the plurality of channels received; and executing a direction and segment estimation process for receiving the observed signal generated in the short time Fourier transform process and detecting the sound direction and sound segment of the target sound, and wherein the sound source extraction process includes executing iterative learning in which an extracting filter U' is iteratively updated using a result of application of the extracting filter to the observed signal, generating, as a function to be applied in the iterative learning, an objective function G(U') that assumes a local minimum or a local maximum when a value of the extracting filter U' is a value optimal for extraction of the target sound, and computing a value of the extracting filter U' which is in a neighborhood of a local minimum or a local maximum of the objective function G(U') using an auxiliary function method during the iterative learning, and applying the computed extracting filter to extract the sound signal for the target sound.

The processes described herein may be executed in hardware, software, of a combination thereof. For implementing processing in software, a program describing a processing sequence may be installed in a memory of a computer incorporated in dedicated hardware and executed, or the program may be installed and executed in a general purpose computer capable of executing various kinds of processing. The program may be prestored on a recording medium, for example. Aside from being installed from a recording medium to a computer, the program may be received over a network such as a local area network (LAN) or the Internet and installed in an internal recording medium such as a hard disk.

The processes described herein may be executed not only in sequence according to their descriptions but may take place in parallel or independently depending on the throughput of the apparatus executing them or as demanded. A system described herein means a logical collection of multiple apparatuses, and apparatuses from different configurations are not necessarily present in the same housing.

It should be understood by those skilled in the art that various modifications, combinations, sub-combinations and alterations may occur depending on design requirements and other factors insofar as they are within the scope of the appended claims or the equivalents thereof.

What is claimed is:

1. A sound signal processing apparatus comprising:

an observed signal analysis circuit configured to receive as an observed signal a sound signal for a plurality of channels obtained by a sound signal input unit formed of a plurality of microphones placed at different positions and estimate a sound direction and a sound segment of a target sound which is sound to be extracted; and a sound source extraction circuit configured to receive the sound direction and sound segment of the target sound estimated by the observed signal analysis circuit and extract the sound signal for the target sound, wherein the observed signal analysis circuit includes:

a short time Fourier transform circuit configured to generate an observed signal in time-frequency domain by applying short time Fourier transform to the sound signal for the plurality of channels received; and a direction/segment estimation circuit configured to receive the observed signal generated by the short time Fourier transform circuit and detect the sound direction and sound segment of the target sound, and wherein the sound source extraction circuit is configured to:

execute iterative learning in which an extracting filter U' is iteratively updated using a result of application of the extracting filter to the observed signal, prepare, as a function to be applied in the iterative learning, an objective function G(U') that assumes a local minimum or a local maximum when a value of the extracting filter U' is a value optimal for extraction of the target sound, and compute a value of the extracting filter U' which is in a neighborhood of a local minimum or a local maximum of the objective function G(U') using an auxiliary function method during the iterative learning, and apply the computed extracting filter to extract the sound signal for the target sound.

2. The sound signal processing apparatus according to claim 1, wherein the sound source extraction circuit is configured to:

compute a temporal envelope which is an outline of a sound volume of the target sound in time direction based on the sound direction and the sound segment of the target sound received from the direction/segment estimation circuit and substitute the computed temporal envelope value over frame t into an auxiliary variable b(t), prepare an auxiliary function F that takes the auxiliary variable b(t) and an extracting filter U'(ω) for each frequency bin (ω) as arguments, execute an iterative learning process in which (1) extracting filter computation for computing the extracting filter U'(ω) that minimizes the auxiliary function F while fixing the auxiliary variable b(t), and (2) auxiliary variable computation for computing the auxiliary variable b(t) based on Z(ω,t) which is the result of application of the extracting filter U'(ω) to the observed signal are repeated to sequentially update the extracting filter U'(ω), and applies the updated extracting filter to extract the sound signal for the target sound.

3. The sound signal processing apparatus according to claim 1, wherein the sound source extraction circuit is configured to:

compute a temporal envelope which is an outline of the sound volume of the target sound in time direction based on the sound direction and sound segment of the target sound received from the direction/segment estimation circuit and substitute the computed temporal envelope value for each frame t into the auxiliary variable b(t), prepare an auxiliary function F that takes the auxiliary variable b(t) and the extracting filter U'(ω) for each frequency bin (ω) as arguments, execute an iterative learning process in which (1) extracting filter computation for computing the extracting filter U'(ω) that maximizes the auxiliary function F while fixing the auxiliary variable b(t), and (2) auxiliary variable computation for computing the auxiliary variable b(t) based on Z(ω,t) which is the result of application of the extracting filter U'(ω) to the observed signal are repeated to sequentially update the extracting filter U'(ω), and applies the updated extracting filter to the observed signal to extract the sound signal for the target sound.

4. The sound signal processing apparatus according to claim 2, wherein the sound source extraction circuit is configured to perform, in the auxiliary variable computation, processing for generating Z(ω,t) which is the result of application of the extracting filter U'(ω) to the observed signal, calculating an L-2 norm of a vector [Z(1,t), . . . , Z(Ω,t)], Ω being a number of frequency bins and the vector representing a spectrum of the result of application for each frame t, and substituting the L-2 norm value to the auxiliary variable b(t).

5. The sound signal processing apparatus according to claim 2, wherein the sound source extraction circuit is configured to perform, in the auxiliary variable computation, processing for further applying a time-frequency mask that attenuates sounds from directions off the sound source direction of the target sound to Z(ω,t) which is the result of application of the extracting filter U'(ω) to the observed signal to generate a masking result Q(ω,t), calculating for each frame t the L-2 norm of the vector [Q(1,t), . . . , Q(Ω, t)], Ω being the number of frequency bins and the vector representing the spectrum of the generated masking result, and substituting the L-2 norm value to the auxiliary variable b(t).

6. The sound signal processing apparatus according to claim 1, wherein the sound source extraction circuit is configured to:

generate a steering vector containing information on phase difference among the plurality of microphones that collect the target sound, based on sound source direction information for the target sound, generate a time-frequency mask that attenuates sounds from directions off the sound source direction of the target sound based on an observed signal containing interfering sound which is a signal other than the target sound and on the steering vector, apply the time-frequency mask to observed signals in a predetermined segment to generate a masking result, and generate an initial value of the auxiliary variable based on the masking result.

7. The sound signal processing apparatus according to claim 1, wherein the sound source extraction circuit is configured to:

generate a steering vector containing information on phase difference among the plurality of microphones that collect the target sound, based on sound source direction information for the target sound, generate a time-frequency mask that attenuates sounds from directions off the sound source direction of the target sound based on an observed signal containing interfering sound which is a signal other than the target sound and on the steering vector, and generate the initial value of the auxiliary variable based on the time-frequency mask.

8. The sound signal processing apparatus according to claim 1, wherein the sound source extraction circuit is configure to:

in a case that a length of the sound segment of the target sound detected by the observed signal analysis circuit is shorter than a prescribed minimum segment length T_MIN, select a point in time earlier than an end of the sound segment by the minimum segment length T_MIN as a start position of the observed signal to be used in the iterative learning, in a case that the length of the sound segment of the target sound is longer than a prescribed maximum segment length T_MAX, select the point in time earlier than the end of the sound segment by the maximum segment length T_MAX as the start position of the observed signal to be used in the iterative learning, and in a case that the length of the sound segment of the target sound detected by the observed signal analysis circuit falls within a range between the prescribed minimum segment length T_MIN and the prescribed maximum segment length T_MAX, use the sound segment as the sound segment of the observed signal to be used in the iterative learning.

9. The sound signal processing apparatus according to claim 1, wherein the sound source extraction circuit is configured to:

calculate a weighted covariance matrix from the auxiliary variable b(t) and a decorrelated observed signal, apply eigenvalue decomposition to the weighted covariance matrix to compute eigenvalue(s) and eigenvector(s), and set an eigenvector selected based on the eigenvalue(s) as an in-process extracting filter to be used in the iterative learning.

10. A sound signal processing method for execution in a sound signal processing apparatus, the method comprising:

performing, at an observed signal analysis circuit, an observed signal analysis process in which a sound signal for a plurality of channels obtained by a sound signal input unit formed of a plurality of microphones disposed at different positions is received as an observed signal and a sound direction and a sound segment of a target sound which is sound to be extracted are estimated; and performing, at a sound source extraction circuit, a sound source extraction process in which the sound direction and sound segment of the target sound estimated by the observed signal analysis circuit are received and the sound signal for the target sound is extracted, wherein the observed signal analysis process includes:

executing a short time Fourier transform process for generating an observed signal in time-frequency domain by applying short time Fourier transform to the sound signal for the plurality of channels received; and executing a direction and segment estimation process for receiving the observed signal generated in the short time Fourier transform process and detecting the sound direction and sound segment of the target sound, and wherein the sound source extraction process includes:

executing iterative learning in which an extracting filter U' is iteratively updated using a result of application of the extracting filter to the observed signal, preparing, as a function to be applied in the iterative learning, an objective function G(U') that assumes a local minimum or a local maximum when a value of the extracting filter U' is a value optimal for extraction of the target sound, and computing a value of the extracting filter U' which is in a neighborhood of a local minimum or a local maximum of the objective function G(U') using an auxiliary function method during the iterative learning, and applying the computed extracting filter to extract the sound signal for the target sound.

11. A non-transitory computer readable medium including executable instructions, which when executed by a computer cause the computer to:

perform, using observed signal analysis circuit, an observed signal analysis process for receiving as an observed signal a sound signal for a plurality of channels obtained by a sound signal input unit formed of a plurality of microphones placed at different positions and estimating a sound direction and a sound segment of a target sound which is sound to be extracted; and perform a sound source extraction process for receiving the sound direction and sound segment of the target sound estimated by the observed signal analysis circuit and extracting the sound signal for the target sound, wherein the observed signal analysis process includes:

executing a short time Fourier transform process for generating an observed signal in time-frequency domain by applying short time Fourier transform to the sound signal for the plurality of channels received; and executing a direction and segment estimation process for receiving the observed signal generated in the short time Fourier transform process and detecting the sound direction and sound segment of the target sound, and wherein the sound source extraction process includes:

executing iterative learning in which an extracting filter U' is iteratively updated using a result of application of the extracting filter to the observed signal, preparing, as a function to be applied in the iterative learning, an objective function G(U') that assumes a local minimum or a local maximum when a value of the extracting filter U' is a value optimal for extraction of the target sound, and computing a value of the extracting filter U' which is in a neighborhood of a local minimum or a local maximum of the objective function G(U') using an auxiliary function method during the iterative learning, and applying the computed extracting filter to extract the sound signal for the target sound.

* * * * *